US008414118B2

(12) United States Patent
Makuta et al.

(10) Patent No.: US 8,414,118 B2
(45) **Date of Patent: *Apr. 9, 2013**

(54) IMAGE FORMING METHOD

(75) Inventors: Toshiyuki Makuta, Kanagawa-ken (JP); Yasuhiko Kachi, Kanagawa-ken (JP); Hiroshi Yamamoto, Kanagawa-ken (JP); Terukazu Yanagi, Kanagawa-ken (JP); Misato Sasada, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 416 days.

This patent is subject to a terminal disclaimer.

(21) Appl. No.: 12/470,962

(22) Filed: May 22, 2009

(65) Prior Publication Data

US 2009/0291215 A1 Nov. 26, 2009

(30) Foreign Application Priority Data

May 23, 2008 (JP) ..... 2008-135622

(51) Int. Cl.
*B41J 2/01* (2006.01)

(52) U.S. Cl. ..... 347/104; 347/102; 347/100

(58) Field of Classification Search ..... 347/104, 347/105, 101, 100, 95, 103, 102; 400/642, 400/621, 613, 618, 582; 101/118, 216, 177, 101/169

See application file for complete search history.

(56) References Cited

U.S. PATENT DOCUMENTS 4,538,160 A 8/1985 Uchiyama
5,816,155 A 10/1998 Stephan
6,257,716 B1 7/2001 Yanagawa et al.
6,341,854 B1 1/2002 Takemoto
6,378,425 B1 4/2002 Stephan
(Continued)

FOREIGN PATENT DOCUMENTS

EP 0893271 A1 1/1999
JP 3-169644 A 7/1991
(Continued)

*Primary Examiner* — Manish S Shah
(74) *Attorney, Agent, or Firm* — Birch, Stewart, Kolasch & Birch, LLP

(57) ABSTRACT

The method forms an image using an inkjet recording apparatus, which includes: an image formation unit having a line head type inkjet head disposed opposite a circumferential surface of an image formation drum, the inkjet head depositing the aqueous ink onto the recording medium while the recording medium is held and conveyed in rotation on the circumferential surface of the image formation drum; and a drying unit arranged on a downstream side of the image formation unit, the drying unit having a drying device disposed opposite a circumferential surface of a drying drum, the drying device drying a solvent in the aqueous ink deposited on the recording medium, the drying unit drying the solvent by means of the drying device while the recording medium is held and conveyed in rotation on the circumferential surface of the drying drum; using, as the recording medium, a special paper which is a recording medium successively laminated from a base paper, a first layer containing a binder and a second layer containing a white pigment, the base paper with the first layer provided thereon having a Cobb water absorbency of not higher than 5.0 g/m2 with a contact time of 15 seconds based on a water absorbency test stipulated in JIS P8140, and the second layer having a water absorption amount of not lower than 2 ml/m2 and not higher than 8 ml/m2 with a contact time of 0.5 seconds according to Bristow's method, and having a layer surface pH of not higher than 5.5 after pH adjustment.

10 Claims, 16 Drawing Sheets

U.S. PATENT DOCUMENTS

| | | | | |
|---|---|---|---|---|
| 6,402,317 | B2 | 6/2002 | Yanagawa et al. | |
| 6,612,569 | B2 | 9/2003 | Schaum | |
| 7,524,005 | B2 | 4/2009 | Inoue | |
| 7,722,180 | B2 | 5/2010 | Mashima | |
| 7,726,802 | B2 | 6/2010 | Morimoto | |
| 2006/0009544 | A1 | 1/2006 | Miyagawa et al. | |
| 2006/0109295 | A1 | 5/2006 | Kusunoki | |
| 2008/0055385 | A1 | 3/2008 | Houjou | |
| 2008/0098910 | A1* | 5/2008 | Koto et al. | 101/118 |
| 2009/0053409 | A1* | 2/2009 | Yamamoto et al. | 428/32.18 |
| 2009/0079784 | A1 | 3/2009 | Chiwata et al. | |
| 2009/0128611 | A1* | 5/2009 | Kariya et al. | 347/106 |
| 2009/0231377 | A1* | 9/2009 | Kachi | 347/16 |
| 2009/0244237 | A1* | 10/2009 | Kachi | 347/102 |
| 2009/0311426 | A1* | 12/2009 | Nakazawa et al. | 347/102 |

FOREIGN PATENT DOCUMENTS

| | | | |
|---|---|---|---|
| JP | 04-018462 | A | 1/1992 |
| JP | 8-244206 | A | 9/1996 |
| JP | 10-138526 | A | 5/1998 |
| JP | 11-188858 | A | 7/1999 |
| JP | 2000-37942 | A | 2/2000 |
| JP | 2000-168047 | A | 6/2000 |
| JP | 2002-292956 | A | 10/2002 |
| JP | 2004-10633 | A | 1/2004 |
| JP | 2004-090596 | A | 3/2004 |
| JP | 2005-138336 | A | 6/2005 |
| JP | 2006-037088 | A | 2/2006 |
| JP | 2006-264068 | A | 10/2006 |
| JP | 2007-015130 | A | 1/2007 |
| JP | 2007-160879 | A | 6/2007 |
| JP | 2007160664 | A * | 6/2007 |
| JP | 2007-216456 | A | 8/2007 |
| JP | 2007-217508 | A | 8/2007 |
| JP | 2007-261206 | A | 10/2007 |

* cited by examiner

FIG.16

| EXPERIMENT | INKJET RECORDING APPARATUS | RECORDING MEDIUM | AQUEOUS INK | LANDING INTERFERENCE | IMAGE CONTRACTION | TEXT REPRODUCIBILITY | CURL | REMARKS |
|---|---|---|---|---|---|---|---|---|
| 1 | 1 | S-1 | C-1, M-1, Y-1, Bk-1 | GOOD | GOOD | GOOD | GOOD | PRESENT INVENTION |
| 2 | 1 | S-1 | C-3, M-3, Y-3, Bk-3 | POOR | GOOD | POOR | GOOD | COMPARATIVE EXAMPLE |
| 3 | 1 | S-1 | C-4, M-4, Y-4, Bk-4 | POOR | GOOD | POOR | GOOD | COMPARATIVE EXAMPLE |
| 4 | 1 | TOKUBISHI ART | C-1, M-1, Y-1, Bk-1 | GOOD | POOR | GOOD | POOR | COMPARATIVE EXAMPLE |
| 5 | 1 | TOKUBISHI ART | C-3, M-3, Y-3, Bk-3 | POOR | GOOD | POOR | POOR | COMPARATIVE EXAMPLE |
| 6 | 1 | TOKUBISHI ART | C-4, M-4, Y-4, Bk-4 | POOR | GOOD | POOR | POOR | COMPARATIVE EXAMPLE |
| 7 | 2 | S-1 | C-1, M-1, Y-1, Bk-1 | GOOD | GOOD* | POOR | GOOD | COMPARATIVE EXAMPLE |
| 8 | 2 | S-1 | C-3, M-3, Y-3, Bk-3 | GOOD | GOOD | POOR | GOOD | COMPARATIVE EXAMPLE |
| 9 | 2 | S-1 | C-4, M-4, Y-4, Bk-4 | POOR | GOOD | POOR | GOOD | COMPARATIVE EXAMPLE |
| 10 | 2 | TOKUBISHI ART | C-1, M-1, Y-1, Bk-1 | POOR | GOOD | POOR | POOR | COMPARATIVE EXAMPLE |
| 11 | 2 | TOKUBISHI ART | C-2, M-2, Y-2, Bk-2 | GOOD | POOR | POOR | POOR | COMPARATIVE EXAMPLE |
| 12 | 2 | TOKUBISHI ART | C-3, M-3, Y-3, Bk-3 | POOR | GOOD | POOR | POOR | COMPARATIVE EXAMPLE |
| 13 | 1 | S-2 | C-1, M-1, Y-1, Bk-1 | GOOD | GOOD | GOOD | GOOD | PRESENT INVENTION |
| 14 | 1 | S-1 | C-2, M-2, Y-2, Bk-2 | GOOD | GOOD | GOOD | GOOD | PRESENT INVENTION |
| 15 | 1 | S-2 | C-2, M-2, Y-2, Bk-2 | GOOD | GOOD | GOOD | GOOD | PRESENT INVENTION |

FIG.17

| EXPERIMENT | RECORDING MEDIUM | COBB WATER ABSORBENCY (g/m2) | WATER ABSORPTION AMOUNT (g/m2) | LAYER SURFACE pH | LANDING INTERFERENCE | IMAGE CONTRACTION | TEXT REPRODUCIBILITY | CURL | REMARKS |
|---|---|---|---|---|---|---|---|---|---|
| 1 | S-2 | 1.4 | 3.1 | 3.5 | GOOD | GOOD | GOOD | GOOD | PRESENT INVENTION |
| 2 | S-3 | 5.5 | 3.1 | 3.5 | POOR | GOOD | FAIR | POOR | COMPARATIVE EXAMPLE |
| 3 | S-4 | 5.0 | 3.1 | 3.5 | GOOD | GOOD | GOOD | GOOD | PRESENT INVENTION |
| 4 | S-5 | 3.0 | 3.1 | 3.5 | GOOD | GOOD | GOOD | GOOD | PRESENT INVENTION |
| 5 | S-6 | 1.4 | 8.5 | 3.5 | POOR | GOOD | FAIR | FAIR | COMPARATIVE EXAMPLE |
| 6 | S-7 | 1.4 | 8.0 | 3.5 | GOOD | GOOD | GOOD | GOOD | PRESENT INVENTION |
| 7 | S-8 | 1.4 | 5.0 | 3.5 | GOOD | GOOD | GOOD | GOOD | PRESENT INVENTION |
| 8 | S-9 | 1.4 | 2.0 | 3.5 | GOOD | GOOD | GOOD | GOOD | PRESENT INVENTION |
| 9 | S-10 | 1.4 | 1.5 | 3.5 | GOOD | POOR | POOR | GOOD | COMPARATIVE EXAMPLE |
| 10 | S-11 | 1.4 | 3.1 | 6.0 | POOR | GOOD | POOR | GOOD | COMPARATIVE EXAMPLE |
| 11 | S-12 | 1.4 | 3.1 | 5.5 | GOOD | GOOD | GOOD | GOOD | PRESENT INVENTION |
| 12 | S-13 | 1.4 | 3.1 | 4.5 | GOOD | GOOD | GOOD | GOOD | PRESENT INVENTION |
| 13 | S-14 | 1.4 | 3.1 | 2.5 | GOOD | GOOD | GOOD | GOOD | PRESENT INVENTION |
| 14 | S-15 | 1.4 | 3.1 | 1.5 | GOOD | GOOD | GOOD | GOOD | PRESENT INVENTION |
| 15 | S-16 | 5.0 | 3.1 | 8 | GOOD | GOOD | GOOD | GOOD | PRESENT INVENTION |
| 16 | S-17 | 5.0 | 3.1 | 2 | GOOD | GOOD | GOOD | GOOD | PRESENT INVENTION |

IMAGE FORMING METHOD

BACKGROUND OF THE INVENTION

1. Field of the Invention

The present invention relates to an image forming method, and more particularly to the improvement of image quality in an image forming method of a direct printing type, in which an image is formed by directly applying an aqueous ink to a recording medium by means of an inkjet recording apparatus.

2. Description of the Related Art

An inkjet recording apparatus is able to record images of good quality by means of a simple composition, and therefore such apparatuses are widely used as domestic printers for individual use and office printers for commercial use. In the case of office printers for commercial use, in particular, there are increasing demands for higher processing speed and higher image quality.

In improving the image quality achieved by an inkjet recording apparatus, generally, it is necessary that there should be little interference between ink droplets ejected from the nozzles of the ink head (hereinafter referred to as "landing interference"), little contraction of the image (hereinafter referred to as "image contraction") and good reproducibility of text characters (hereinafter referred to as "text reproducibility"), and so on.

From the viewpoint of environmental suitability, water is widely used as the solvent in inkjet inks, and such aqueous inks using water as the ink solvent are liable to produce deformation of the recording medium, such as curling or cockling, due to permeation of the water into the recording medium during recording.

Currently, attention has focused on image forming methods based on a two-liquid system using an intermediate transfer body, as a way of improving image quality and suppressing curl in office printers. In an image forming method of this kind, ink and a treatment liquid that causes the ink to aggregate or precipitate are deposited onto an intermediate transfer body, thereby forming an ink aggregate body (desirably, the residual solvent is dried and driven off), whereupon the ink aggregate body is transferred to a recording medium. By forming an ink aggregate body on an intermediate transfer body, and then transferring same to a recording medium after drying the residual solvent in this way, images of high quality are obtained and curl becomes less liable to occur.

For example, Japanese Patent Application Publication No. 2004-010633 discloses an ink set used in a two-liquid method, which includes at least an aqueous ink containing a pigment, a water-soluble solvent and water, and a liquid composition that causes the aqueous ink to aggregate, wherein by making one of the aqueous ink and the liquid composition alkaline and the other acidic, it is possible to achieve excellent recording in terms of optical density, bleeding and color bleeding.

Japanese Patent Application Publication No. 11-188858 discloses an image forming method and apparatus which uses an intermediate transfer body, in which images which display little bleeding can be formed on a recording medium by depositing onto the intermediate transfer body a layer of powder (water-soluble resin) which is capable of swelling, increasing in viscosity and separating by reaction with the ink.

Japanese Patent Application Publication No. 2000-037942 discloses technology for improving optical density, bleeding, color mixing and drying duration, by controlling the aggregating properties of pigment on a recording medium through making one of a liquid composition (treatment liquid) and ink acidic and making the other alkaline.

However, since an image forming method which uses an intermediate transfer body is an indirect printing method which first forms an image (ink aggregate body) on an intermediate transfer body and then transfers this image to a recording medium, a greater number of steps are involved compared to a direct printing method which forms an image directly onto a recording medium, and hence the apparatus becomes correspondingly more complicated. Furthermore, improving image quality and suppressing curl in both indirect printing methods and direct printing methods is also important in terms of diversifying technology.

On the other hand, inkjet image recording methods are starting to spread from office use into various other fields. One of these is application in industrial printers. In the field of commercial printing, coated paper is mainly used as recording medium. The reason for using coated paper is the texture of the paper. Coated papers have slower liquid absorption and are therefore more liable to produce landing interference than normal papers or special inkjet papers, and furthermore, since they do not use a non-permeable medium as the base material, as in the case of laminated paper, such as special inkjet paper, then they are liable to produce curl if used in normal inkjet image formation.

In view of these circumstances, there is demand for an image forming method using a direct printing system of forming images by applying an aqueous ink directly onto a recording medium by means of an inkjet recording apparatus, which satisfies the conditions of producing little landing interference or image contraction, having good text reproducibility and making curl not liable to occur.

SUMMARY OF THE INVENTION

The present invention has been contrived in view of these circumstances, an object thereof being to provide an image forming method using a direct printing system of forming an image directly onto a recording medium, which satisfies the conditions of producing little landing interference and image contraction, having good text reproducibility, and making curl not liable to occur.

In order to attain the aforementioned object, the present invention is directed to a method of forming an image by directly depositing aqueous ink ejected from an inkjet recording apparatus onto a recording medium, the method comprising: using, as the inkjet recording apparatus, an apparatus including: an image formation unit having a line head type inkjet head disposed opposite a circumferential surface of an image formation drum, the inkjet head depositing the aqueous ink onto the recording medium while the recording medium is held and conveyed in rotation on the circumferential surface of the image formation drum; and a drying unit arranged on a downstream side of the image formation unit, the drying unit having a drying device disposed opposite a circumferential surface of a drying drum, the drying device drying a solvent in the aqueous ink deposited on the recording medium, the drying unit drying the solvent by means of the drying device while the recording medium is held and conveyed in rotation on the circumferential surface of the drying drum; using, as the recording medium, a special paper which is a recording medium successively laminated from a base paper, a first layer containing a binder and a second layer containing a white pigment, the base paper with the first layer provided thereon having a Cobb water absorbency of not higher than 5.0 g/m$^2$ with a contact time of 15 seconds based on a water absorbency test stipulated in JIS P8140, and the second layer having a water absorption amount of not lower than 2 ml/m$^2$ and not higher than 8 ml/m$^2$ with a contact time of 0.5 seconds according to Bristow's method, and having a layer surface pH of not higher than 5.5 after pH adjustment; and using, as the aqueous ink, a special ink containing at least a resin dispersant (A), a pigment (B) that is dispersed by the resin dispersant (A), self-dispersible polymer micro-particles (C) and an aqueous liquid medium (D).

Since the inkjet recording apparatus used in the image forming method according to the present invention comprises the drums having mutually separate structures, in which the image formation unit includes the inkjet head arranged on the image formation drum and the drying unit includes the drying device arranged on the drying drum, then there is no interference between the processing in the image formation unit and the processing in the drying unit. For example, there is no heating of the image formation drum of the image formation unit due to the drying heat of the drying unit. Accordingly, the ink in the inkjet head arranged in the image formation unit is not dried, the occurrence of ejection failures in the inkjet head can be prevented, and therefore images of high quality can be formed on the recording medium.

Moreover, since the solvent of the aqueous ink that has been deposited on the recording medium by the image formation unit can be dried rapidly by the drying device arranged in the drying unit, then even in the direct printing system, there is no occurrence of image non-uniformities caused by flowing movement of the coloring material on the recording medium, or ink bleeding or color mixing caused by the deposition of a plurality of inks. Accordingly, it is possible to form an image of high quality on the recording medium.

Further, since the recording medium used in the image forming method according to the present invention has the base paper with the first layer having the conditions described above, then a solvent blocking layer is formed structurally on the surface of the paper, and therefore it is possible to prevent infiltration of water and water-soluble organic solvent into the base paper layer. Moreover, by providing the second layer having the conditions described above, an ink absorbing layer having an ink aggregating function is formed on the solvent blocking layer, and therefore after depositing droplets of ink, it is possible to form an ink aggregate body rapidly and prevent the water and water-soluble organic solvent from penetrating into the base paper layer. Accordingly, it is possible to form an image of high quality on the recording medium.

Furthermore, the aqueous ink used in the image forming method according to the present invention includes both the resin dispersant which is used to disperse the pigment and the self-dispersible polymer micro-particles, and therefore it is possible to obtain an aqueous ink for inkjet recording which has good ejection stability, good wearability and high dispersion stability. Accordingly, it is possible to form an image of high quality on the recording medium.

Consequently, in the image forming method according to the present invention, an image is formed by using the inkjet recording apparatus, the recording medium and the aqueous ink having the respective characteristics described above, and therefore in the direct printing method which forms an image directly on the recording medium, it is possible to achieve image formation which satisfies the conditions of little landing interference and image contraction, good text reproducibility and low likelihood of curl.

Preferably, a fixing unit is arranged on a downstream side of the drying unit in the inkjet recording apparatus, the fixing unit having a fixing device disposed opposite a circumferential surface of a fixing drum, the fixing device fixing the ink that has been deposited on the recording medium by applying heat and pressure to the ink, the fixing unit fixing the ink by means of the fixing device while the recording medium is held and conveyed in rotation on the circumferential surface of the drying drum.

According to this aspect of the present invention, by means of the fixing drum, the fixing unit has an independent structure from the drying drum and the image formation drum, and consequently there is no mutual interference between the respective processes of the image formation unit, the drying unit and the fixing unit. Therefore, it is possible to set the temperature achieved by the fixing device freely, and therefore it is possible to carry out processing under appropriate fixing conditions in accordance with the type of aqueous ink, the type of recording medium, or the like.

Preferably, each of the drums in the inkjet recording apparatus includes a holding device which holds a leading end of the recording medium; an intermediate conveyance unit is arranged between the drums, the intermediate conveyance unit including an intermediate conveyance body and a conveyance guide, the intermediate conveyance body having a holding device for holding the leading end of the recording medium, the intermediate conveyance body holding the leading end of the recording medium by means of the holding device and moving the recording medium in rotation, the conveyance guide guiding a non-recording surface of the recording medium which is moved in rotation by the intermediate conveyance body; and the recording medium is conveyed by being transferred by means of the holding device arranged on the drum and the holding device arranged on the intermediate conveyance body.

According to this aspect of the present invention, since the intermediate conveyance bodies each having holding devices are arranged as well as arranging holding devices on the respective drums, and since the recording medium is transferred by means of the holding devices arranged on the drums and the holding devices arranged on the intermediate conveyance bodies, then it is possible to avoid image defects caused by contact with the recording surface of the recording medium, when the recording medium is conveyed by drum conveyance. Accordingly, it is possible to form an image of high quality on the recording medium. Furthermore, in the transfer of the recording medium from the image formation unit to the drying unit, it is possible to convey the recording medium with high precision, even in the case of the recording medium of large size in a semi-wet state by being deposited with the aqueous ink. Consequently, it is possible to ensure the position of the recording medium with high accuracy, and therefore it is possible to form an image of high quality on the recording medium.

Preferably, the line type inkjet head in the inkjet recording apparatus has a head width of not shorter than 50 cm, and nozzles arranged at a nozzle density of not lower than 1000 dpi in a sub-scanning direction.

As in this aspect, the present invention is particularly valuable in a high-definition single-pass inkjet image forming method in which the line head type of inkjet head is arranged at a nozzle density of 1000 dpi or higher in the direction perpendicular to the main scanning direction.

Preferably, the base paper of the recording medium with the first layer provided thereon has a Cobb value of not higher than 5.0 g/m$^2$ with a contact time of 2 minutes as determined using diethylene glycol in the water absorbency test stipulated in JIS P8140, and the second layer has a water absorption amount of not lower than 1 ml/m$^2$ and not higher than 6 ml/m$^2$ with a contact time of 0.9 seconds as determined using pure water containing 30 wt % of diethylene glycol according to Bristow's method.

According to this aspect of the present invention, the conditions relating to the second layer are made more rigorous, and therefore it is possible to form an image of even higher quality on the recording medium.

Preferably, the resin dispersant (A) in the aqueous ink has a hydrophobic structural unit (a) and a hydrophilic structural unit (b); the hydrophobic structural unit (a) includes at least 40 wt % of a hydrophobic structural unit (a1) having an aromatic ring which is not directly bonded to atoms forming a main chain of the resin (A), and at least 15 wt % of a hydrophobic structural unit (a2) derived from an alkyl ester of one of acrylic acid and methacrylic acid having 1 to 4 carbon atoms; and the hydrophilic structural unit (b) includes a structural unit (b1) derived from at least one of acrylic acid and methacrylic acid, and a ratio of the hydrophilic structural unit (b) is not higher than 15 wt %.

According to this aspect of the present invention, a desirable mode of the resin dispersant (A) in the aqueous ink is specified, and by using the aqueous ink of this kind, it is possible to achieve higher image quality.

The composition of the hydrophilic structural unit (b) and the hydrophobic structural unit (a) depends on the degrees of hydrophilic and hydrophobic properties of them, and desirably the hydrophobic structural unit (a) is contained at a rate exceeding 80 wt %, and more desirably, 85 wt % or more, with respect to the total weight of the resin (A). In other words, the content of the hydrophilic structural unit (b) must be equal to or lower than 15 wt %, and if the content of the hydrophilic structural unit (b) is greater than 15 wt %, then the component that does not contribute to the dispersion of pigment but simply dissolves in the aqueous liquid medium (D) becomes greater, the properties, such as dispersion of the pigment (B), become worse, and this causes the ejection properties of the inkjet recording ink to deteriorate.

Preferably, an aromatic ring which is not directly bonded to atoms forming a main chain of the resin dispersant (A) in the aqueous ink is present in a ratio of not lower than 15 wt % and not higher than 27 wt % in the resin dispersant (A).

According to this aspect of the present invention, a desirable mode of the resin dispersant (A) in the aqueous ink is specified, whereby the dispersion stability, ejection stability, cleaning properties and wear resistance of the pigment in the aqueous ink can be improved.

Preferably, the self-dispersible polymer micro-particles (C) in the aqueous ink contain a structural unit derived from an aromatic group-containing (meth)acrylate monomer, a content ratio thereof being 10 wt % to 95 wt %.

According to this aspect of the present invention, a desirable mode of the self-dispersible polymer micro-particles in the aqueous ink is specified, and by using the aqueous ink of this kind, it is possible to achieve higher image quality.

Preferably, the self-dispersible polymer micro-particles (C) in the aqueous ink contain a first polymer having a carboxyl group and an acid number of 25 to 100.

According to this aspect of the present invention, a desirable specific mode of the self-dispersible polymer micro-particles in the aqueous ink is specified, and by using the aqueous ink of this kind, it is possible to achieve higher image quality.

Preferably, the first polymer is prepared in an organic solvent and as a polymer dispersion with water as a continuous phase, by neutralizing at least a portion of the carboxyl group in the first polymer.

According to this aspect of the present invention, a desirable mode of the first polymer which constitutes the self-dispersible polymer micro-particles is specified, and by using the aqueous ink of this kind, it is possible to achieve higher image quality.

Furthermore, in addition to the above-described preferable aspects, in the present invention, it is desirable also to adopt the following aspects in respect of the inkjet recording apparatus, the recording medium and the aqueous ink, with a view to improving image quality and suppressing curl.

<Inkjet Recording Apparatus>

It is preferable that the conveyance guide arranged in the intermediate conveyance unit of the inkjet recording apparatus includes a negative pressure application device which applies a negative pressure to the non-recording surface of the recording medium. According to this aspect, it is possible to promote the permeation into the recording surface of the recording medium of the solvent in the aqueous ink (including high-boiling-point solvent having a boiling point of 100° C. or higher).

Moreover, by providing the negative pressure application device, when conveying the recording medium in tight contact on the circumference of the drum, the rotational movement of the recording medium is guided while applying a force to the recording medium in the opposite direction to the direction of rotation and therefore it is possible to prevent the occurrence of wrinkling or floating up of the recording medium on the circumference of the drum.

It is preferable that a negative pressure control device is provided to control the negative pressure applied by the negative pressure application device. According to this aspect, by controlling the negative pressure when conveying the recording medium in tight contact on the circumference of the drum, it is possible to guide the rotational movement of the recording medium while applying the negative pressure to the non-recording surface more reliably by means of the negative pressure application device. Furthermore, it is possible to control the negative pressure applied and to promote the permeation of the solvent of the aqueous ink into the recording surface of the recording medium, more efficiently.

It is preferable that the negative pressure control device controls the negative pressure in accordance with the type of recording medium. According to this aspect, it is possible to respond to a diversity of recording media.

It is preferable that the negative pressure control device controls the negative pressure in accordance with at least one of the thickness of the recording medium and the porosity of the recording medium. By adopting this aspect, it is possible to respond to a diversity of recording media.

It is preferable that the intermediate transfer body in the intermediate conveyance unit includes a positive pressure application device which applies a positive pressure to the recording surface of the recording medium. According to this aspect, when the recording medium is conveyed in tight contact on the circumference of the drum (which is at least one of the drums of the image formation unit, the drying unit and the fixing unit, the same applies below), then the rotational movement of the recording medium is guided while applying the positive pressure to the recording surface by means of the positive pressure application device. Accordingly, it is possible to prevent the occurrence of wrinkling and floating up of the recording medium on the circumference of the drum, and therefore the quality of the image formed on the recording surface of the recording medium is improved. Furthermore, by applying the positive pressure, it is possible to promote the permeation into the recording surface of the recording medium of the solvent of the aqueous ink.

It is preferable that a positive pressure control device is provided to control the positive pressure applied by the positive pressure application device. By adopting this aspect, it is possible to move the recording medium in rotation along the conveyance guide by means of the positive pressure, in a more reliable fashion. Furthermore, it is possible to control the positive pressure applied and to promote the permeation of the solvent of the aqueous ink into the recording surface of the recording medium, more efficiently.

It is preferable that the positive pressure control device controls the positive pressure in accordance with the type of recording medium. By adopting this aspect, it is possible to respond to a diversity of recording media. Furthermore, the positive pressure control device desirably controls the positive pressure in accordance with at least one of the thickness of the recording medium and the porosity of the recording medium. By adopting this aspect, it is possible to respond to a diversity of recording media.

It is preferable that the positive pressure application device includes a positive pressure restricting device which restricts the positive pressure applied to the recording surface of the recording medium. By adopting this aspect, it is possible to move the recording medium in rotation along the conveyance guide by means of the positive pressure, in a more reliable fashion. Moreover, it is also possible to promote the permeation of the solvent of the aqueous ink into the recording surface of the recording medium, more reliably.

It is preferable that the positive pressure application device includes an air blowing aperture which blows an air flow onto the recording surface of the recording medium. According to this aspect, it is possible to promote the permeation of the solvent of the aqueous ink into the recording surface of the recording medium by blowing an air flow from the air blowing aperture.

It is preferable that the positive pressure control device controls at least one of the temperature and the flow rate of the air flow blown from the air blowing aperture in accordance with the amount of solvent that has been deposited on the recording surface of the recording medium. According to this aspect, it is possible to promote the permeation of the solvent into the recording medium by reducing the viscosity of the solvent.

It is preferable that an attracting device is arranged which causes the recording medium to make tight contact with the circumferential surface of the drum. According to this aspect, it is possible to prevent the occurrence of wrinkling and floating of the recording medium on the circumferential surface of the drum, in a more reliable fashion.

It is preferable that the attracting device includes a suction device which holds the recording medium onto the circumferential surface of the drum by suction. According to this aspect, the recording medium is held to make tight contact with the circumferential surface of the drum by suction, and hence it is possible to prevent the occurrence of wrinkling and floating of the recording medium in a more reliable fashion.

<Recording Medium>

It is preferable that the base paper with the first layer provided thereon has a water absorbency in Cobb method of 2.0 g/m$^2$ or lower with a contact time of 2 minutes based on a water absorbency test as specified in JIS P8140.

It is preferable that the surface pH of the second layer is less than 8.0 before pH adjustment.

It is preferable that the white pigment includes only of white pigment having a pH of less than 8.0 on the basis of a pH test (normal temperature extraction method) as specified in JIS K5101.

It is preferable that the white pigment has a pH of less than 6.0 after adding 0.1 ml of 1 mol/l hydrochloric acid to 10 g of the measurement liquid in a pH test (normal temperature extraction method) as specified in JIS K5101.

It is preferable that the binder in the first layer contains a thermoplastic resin, and desirably, the thermoplastic resin is at least one resin selected from a polyester urethane latex and an acryl silicone latex. More preferably, the first layer also contains a lamina inorganic compound. Desirably, the first layer also contains a white pigment, and furthermore, desirably, the white pigment is kaolin. Kaolin having an aspect ratio of 30 or above is particularly desirable.

It is preferable that the recording medium is manufactured by a method comprising: a first forming step of forming the first layer on the base paper; and a second forming step of forming the second layer on the first layer, wherein, in the first forming step, thermoplastic polymer micro-particles arranged on the surface of the base paper are heat treated in a temperature range at or above the minimum film forming temperature of the thermoplastic polymer micro-particles.

It is preferable that in the manufacture of the recording medium, a coating liquid for forming the second layer has a high shear viscosity not lower than 20 mPa·s and not higher than 150 mPa·s when the shearing speed D which is specified by the coating speed S (m/min) and the film thickness t of the coating layer (μm) ($D=S/(t\times60\times10^{-6})$) is not lower than $10^3$ ($s^{-1}$) and not higher than $10^6$ ($s^{-1}$).

<Aqueous Ink>

It is preferable that the acid value of the resin dispersant (A) is not lower than 30 mg KOH/g and not higher than 100 mg KOH/g. By this means, it is possible to improve the pigment dispersibility and storage stability of the aqueous ink.

It is preferable that the hydrophobic structural unit (a1) having the aromatic ring that is not directly bonded to the atoms forming the main chain of the resin dispersant (A) is a structural unit derived from at least one of benzyl methacrylate, phenoxyethyl acrylate and phenoxyethyl methacrylate.

It is preferable that the hydrophobic structural unit (a1) having the aromatic ring that is not directly bonded to the atoms forming the main chain of the resin dispersant (A) is a structural unit derived from phenoxyethyl acrylate or phenoxyethyl methacrylate.

It is preferable that the self-dispersible polymer micro-particles (C) are a copolymer including a structural unit derived from a monomer containing an aromatic ring.

It is preferable that the pigment (B) is manufactured by a phase inversion method so as to be covered with the resin dispersant (A).

It is preferable that the weight ratio of the pigment (B) and the resin dispersant (A) is 100:25 to 100:140.

It is preferable that the weight-average molecular weight of the resin dispersant (A) is 30000 to 150000. By setting the molecular weight to the range stated above, the steric repulsion effect of the dispersant tends to be good, which is desirable from the viewpoint of the tendency to prevent adhesion to the pigment by means of a steric effect.

It is preferable that the aqueous ink includes at least one type of water-soluble organic solvent.

It is preferable that the aqueous ink includes a surfactant.

It is preferable that the (meth)acrylate monomer containing the aromatic group in the aqueous ink is phenoxyethyl acrylate.

It is preferable that the acid value of the first polymer which constitutes the self-dispersible polymer micro-particles in the aqueous ink is smaller than the acid value of the resin dispersant (A).

According to the image forming method of the present invention, in the direct printing method which forms an image directly on the recording medium, it is possible to satisfy high-quality conditions of producing little landing interference or image contraction, achieving good text reproducibility, and making curl not liable to occur.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 16 is a table showing the experimental conditions and results in Experiment A; and FIG. 17 is a table showing the experimental conditions and results in Experiment B.

DETAILED DESCRIPTION OF THE PREFERRED EMBODIMENTS

The image forming method according to the present invention uses an inkjet recording apparatus, a recording medium, and an aqueous ink as described below.

General Composition of Inkjet Recording Apparatus

Firstly, the overall composition of an inkjet recording apparatus according to an embodiment of the present invention will be described.

Figure 1:
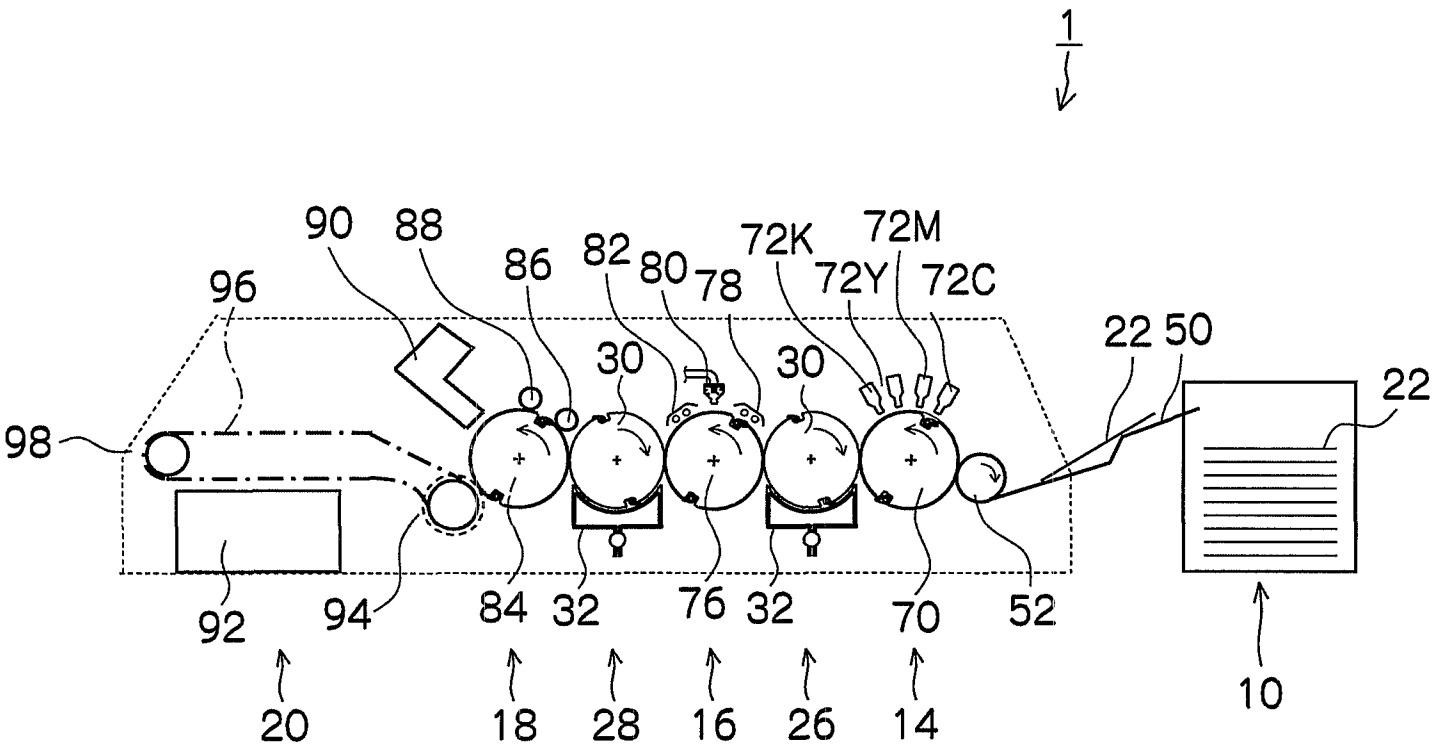
FIG. 1 is a general schematic drawing of an inkjet recording apparatus used in an image forming method according to an embodiment of the present invention.

As shown in FIG. 1, the inkjet recording apparatus 1 according to the present embodiment is an inkjet recording apparatus using a drum-based direct printing method, which is one mode of a direct printing method of forming an image directly on a special recording medium 22 (see FIG. 14) by carrying out printing, drying and setting of the image onto the recording medium 22 on respective drums while conveying the recording medium 22 through the drums.

The inkjet recording apparatus 1 includes, in order from the upstream side in terms of the direction of conveyance of the recording medium 22: a paper supply unit 10, which supplies recording media 22 (cut sheet paper); an image formation unit 14, which forms an image by depositing colored inks onto the recording surface of the recording medium 22; a drying unit 16, which dries the solvent of the colored inks; a fixing unit 18, which makes the image fix securely; and an output unit 20, which conveys and outputs the recording medium 22 on which an image has been formed. In this way, the inkjet recording apparatus 1 has a composition in which the respective image forming processes are disposed in respective units. A first intermediate conveyance unit 26 is provided between the image formation unit 14 and the drying unit 16, and a second intermediate conveyance unit 28 is provided between the drying unit 16 and the fixing unit 18.

<Paper Supply Unit>

The paper supply unit 10 is a mechanism which supplies recording media 22 to the image formation unit 14. A paper supply tray 50 is provided in the paper supply unit 10, and a recording medium 22 is supplied from the paper supply tray 50 to the image formation unit 14. The recording media 22 stored in the paper supply tray 50 are described in detail in the following section "Recording media".

<Image Formation Unit>

Figure 2:
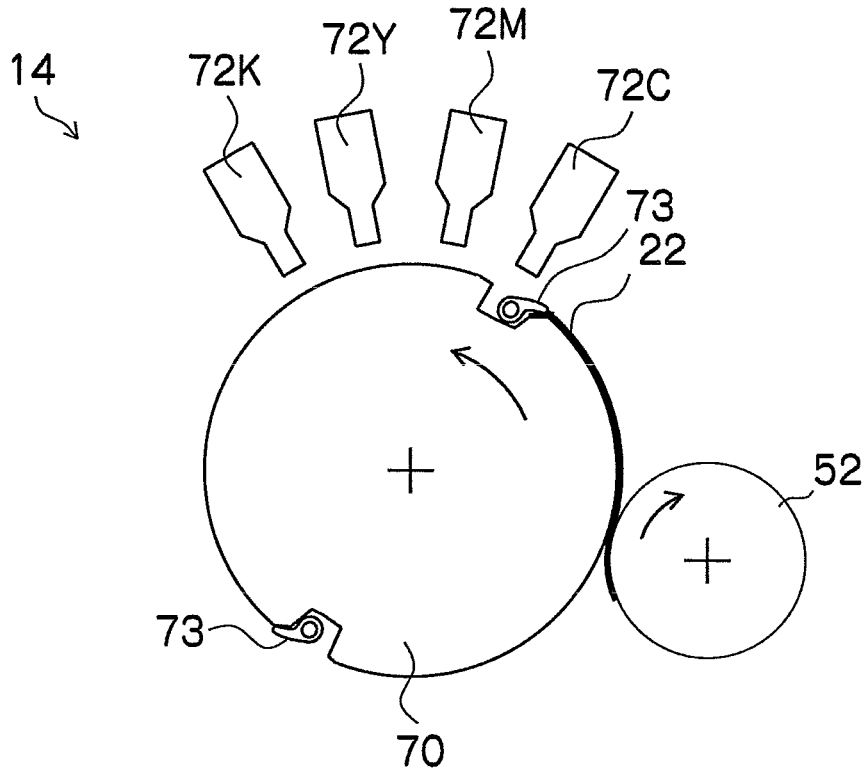
FIG. 2 is a schematic drawing of an image formation unit.

As shown in FIG. 2, the image formation unit 14 is provided with a transfer drum 52 and an image formation drum 70. The transfer drum 52 receives the recording medium 22 from the paper supply tray 50 of the paper supply unit 10 and transfers the recording medium 22 to the image formation drum 70.

The image formation unit 14 is also provided with line-type ink heads 72C, 72M, 72Y and 72K corresponding respectively to inks of the four colors of cyan (C), magenta (M), yellow (Y) and black (K) disposed at positions opposing the outer circumferential surface of the image formation drum 70, in the stated order from the upstream side in terms of the direction of rotation of the image formation drum 70 (the counter-clockwise direction in FIG. 2).

The image formation drum 70 is a drum which has, on the outer circumferential surface thereof, holding devices 73 for conveying the recording medium 22 in rotation by holding the leading end of the recording medium 22 in the direction of conveyance of the medium. The ink heads 72C, 72M, 72Y and 72K are ink deposition devices which deposit inks onto the recording surface of the recording medium 22.

As shown in FIG. 2, the ink heads 72C, 72M, 72Y and 72K each have a length corresponding to the maximum width of the image forming region on the recording medium 22 which is disposed on the outer circumferential surface of the image formation drum 70. The ink heads 72C, 72M, 72Y and 72K are inkjet recording heads (inkjet heads) of a full line type, which each have, formed in the ink ejection surface thereof, nozzle rows in which a plurality of nozzles for ejecting ink are arranged through the full width of the image forming region. The ink heads 72C, 72M, 72Y and 72K are fixed so as to extend in the direction perpendicular to the direction of conveyance of the recording medium 22 (the direction of rotation of the image formation drum 70). It is desirable that the line-type inkjet head has the nozzles arranged in the sub-scanning direction (the direction of conveyance of the recording medium) at the density of at least 1000 dpi and over a width of at least 50 cm.

These ink heads 72C, 72M, 72Y and 72K respectively eject liquid droplets of corresponding colored inks onto the recording surface of the recording medium 22 which is held on the outer circumferential surface of the image formation drum 70. In so doing, the coloring material pigment) dispersed in the ink is caused to aggregate by the later-described aggregating agent existing on the recording surface of the recording medium 22, thereby forming an aggregate of the coloring material in such a manner that a flow of coloring material, or the like, does not occur on the recording medium 22. In this way, an image is formed on the recording medium.

One conceivable example of a reaction between the ink and the aggregating agent uses a mechanism whereby the dispersion of the pigment is broken down and the pigment is caused to aggregate by a reduction in the pH resulting from the introduction of an acid into the aggregating agent, thereby preventing bleeding of the coloring material, color mixing between inks of the respective colors, and droplet deposition interference caused by combination of the liquid of the ink droplets upon landing on the medium.

Furthermore, the droplet ejection timing of the respective ink heads 72C, 72M, 72Y and 72K is synchronized with an encoder 91 (see FIG. 9) which is disposed on the image formation drum 70 and determines the speed of rotation. In this way, it is possible to determine the landing positions with good accuracy. Furthermore, speed variations caused by fluctuations in the image formation drum 70, or the like, are identified in advance, the droplet ejection timing obtained by the encoder 91 is corrected accordingly, and therefore non-uniformities in droplet ejection can be reduced, independently of fluctuations in the image formation drum 70, the accuracy of the rotational axle, or the speed of the outer circumferential surface of the image formation drum 70.

Moreover, a maintenance operation is carried out by withdrawing the head unit from the image formation drum 70, and cleaning the nozzle surfaces of the ink heads 72C, 72M, 72Y and 72K, expelling ink of increased viscosity, and so on.

Furthermore, although a configuration with the four standard colors of C, M, Y and K is described in the present embodiment, the combinations of the ink colors and the number of colors are not limited to those. Light and/or dark inks, and special color inks can be added as required. For example, a configuration is possible in which ink heads for ejecting light-colored inks, such as light cyan and light magenta, are added, and there is no particular restriction on the arrangement sequence of the heads of the respective colors. A more detailed description of the ink heads 72C, 72M, 72Y and 72K is given below.

<Drying Unit>

Figure 3:
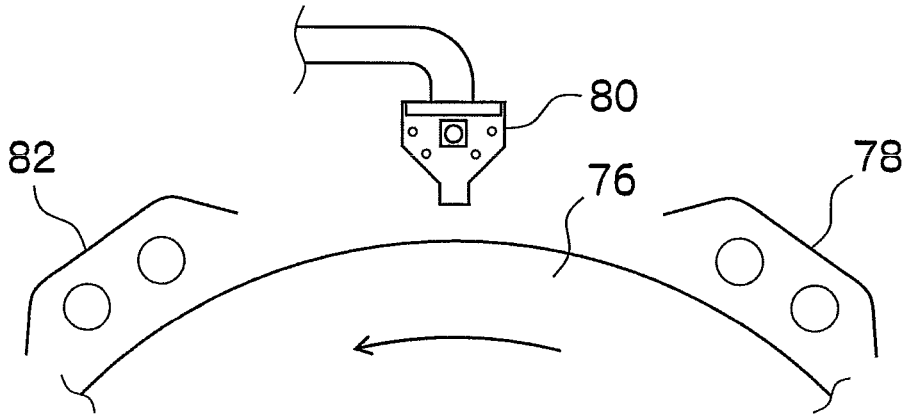
FIG. 3 is a schematic drawing of a drying unit.

As shown in the above-described FIG. 1, the drying unit 16 includes a drying drum 76, and as shown in FIG. 3, the drying unit 16 includes a first IR (infrared) heater 78, a warm-air blow-out nozzle 80, and a second IR heater 82 disposed in positions opposing the circumferential surface of the drying drum 76, in this order from the upstream side in terms of the direction of rotation of the drying drum 76 (the counter-clockwise direction in FIG. 1).

The drying drum 76 is a drum which holds and conveys in rotation the recording medium 22 on the outer circumferential surface thereof. The first IR heater 78, the warm-air blow-out nozzle 80 and the second IR heater 82 are drying devices for drying the moisture (which may include water-soluble organic solvent in some cases) contained in the ink solvent which has been deposited on the recording medium 22.

The drying unit 16 performs a step of drying the moisture contained in the solvent which is separated by the aggregating action of the coloring material, by evaporating off the moisture contained in the ink solvent on the recording surface of the recording medium 22 held on the drying drum 76, by means of the first IR heater 78, the warm-air blow-out nozzle 80 and the second IR heater 82 shown in FIG. 2.

The drying drum 76 holds the leading end of the recording medium 22 by means of a hook-shaped holding device (a device similar to the holding device 73 in FIG. 2) which is provided on the outer circumferential side of the drum. The drying drum 76 may have suction holes provided in the outer circumferential side thereof, in order to hold the recording medium 22 in tight contact by suction through the suction holes.

The temperature of the warm air emitted from the warm-air blow-out nozzle 80 is 50° C. to 70° C., and the evaporated moisture is expelled to the exterior of the apparatus together with the air, by an exhaust device which is not illustrated. It is also possible to cool the recovered air by means of a cooler (radiator), or the like, and to recover the moisture as liquid.

For example, the temperature of the drying drum 76 is set to 60° C. or lower, the temperature of the first IR heater 78 and the second IR heater 82 is set to 180° C., the temperature of the warm air from the warm-air blow-out nozzle 80 is set to 70° C., and the flow rate of the warm air from the warm-air blow-out nozzle 80 is set to 12 $m^3$/minute.

The image formation drum 70 of the image formation unit 14 and the drying drum 76 of the drying unit 16 are formed by separate structures, and therefore it is possible to reduce the occurrence of ink ejection failures in the ink heads 72C, 72M, 72Y and 72K due to drying of the head maintenance unit by heat drying. Furthermore, the temperature of the drying unit 16 can be set freely and therefore an optimal drying temperature can be set.

<Fixing Unit>

Figure 4:
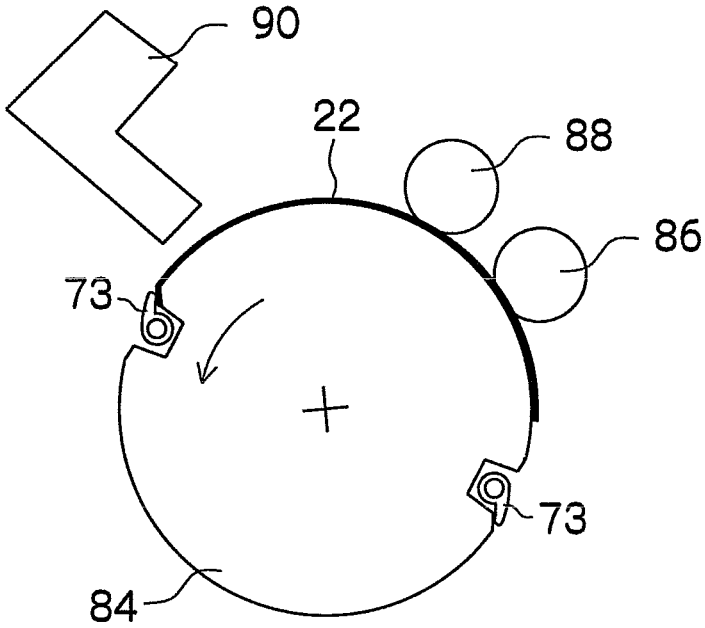
FIG. 4 is a schematic drawing of a fixing unit.

As shown in the above-described FIG. 1, the fixing unit 18 includes a fixing drum 84, and as shown in FIG. 4, the fixing unit 18 includes a first fixing roller 86, a second fixing roller 88 and an in-line sensor 90, disposed in positions opposing the circumferential surface of the fixing drum 84, in this order from the upstream side in terms of the direction of rotation of the fixing drum 84 (the counter-clockwise direction in FIG. 4).

The fixing drum 84 is a drum which holds and conveys in rotation the recording medium 22 on the outer circumferential surface thereof. The first fixing roller 86 and the second fixing roller 88 are roller members for fixing the image formed on the recording medium 22. The in-line sensor 90 is a measurement device for measuring a test pattern, the amount of moisture, the surface temperature, the luster, and the like, of the image fixed on the recording medium 22, and uses a CCD line sensor, or the like.

The fixing drum 84 holds the leading end of the recording medium 22 by means of a hook-shaped holding device (a device similar to the holding device 73 in FIG. 2) which is provided on the outer circumferential side of the drum. The fixing drum 84 may have suction holes provided on the outer circumferential side thereof, similarly to the drying drum 76 described above, in such a manner that the recording medium 22 is held in tight contact with the drum by suction through the suction holes.

In the fixing unit 18, as shown in FIG. 4, the latex particles inside the thin image layer formed by the drying unit 16 on the recording surface of the recording medium 22 which is held on the fixing drum 84 are heated and pressed by the first fixing roller 86 and the second fixing roller 88 and caused to melt, thereby fixing same to the recording medium 22.

The first fixing roller 86 and the second fixing roller 88 are heated rollers which incorporate a halogen lamp inside a metal pipe of aluminum, or the like, which has good thermal conductivity. By applying thermal energy equal to or greater than the Tg temperature (glass transition temperature) of the latex so as to melt the latex particles, the latex is pressed into the undulations in the recording medium 22 and fixed therein, and furthermore, the surface undulations of the image are leveled and a high luster can be obtained.

Furthermore, the first fixing roller 86 and the second fixing roller 88 form nip roller pairs with the fixing drum 84, and at least one of the pair of rollers has an elastic layer on the surface of the roller and thereby forms a uniform nip width with respect to the recording medium 22.

Moreover, the first fixing roller 86 and the second fixing roller 88 may also be provided in a plurality of stages, depending on the thickness of the image layer and the Tg characteristics of the latex particles.

For example, the temperature of the fixing drum 84 is set to 60° C., the temperature of the first fixing roller 86 and the second fixing roller 88 is set to 60° C. to 80° C., and the nip pressure of the first fixing roller 86 and the second fixing roller 88 is set to 1 MPa.

Since the processes in the fixing unit 18 and the other drums are separated in structural terms, then the temperature setting of the fixing unit 18 can be set freely and independently of the image formation unit 14 or the drying unit 16.

<Output Unit>

The output unit 20 is provided after the fixing unit 18. A transfer drum 94, a conveyance belt 96 and a tensioning roller 98 are provided between the fixing drum 84 of the fixing unit 18 and an output tray 92 of the output unit 20, so as to oppose same. The recording medium 22 is sent to the conveyance belt 96 by the transfer drum 94 and then output to the output tray 92.

<Structure of the Ink Head>

Next, the structure of an ink head will be described. The ink heads 72C, 72M, 72Y and 72K of the respective ink colors have the same structure, and a reference numeral 100 is hereinafter designated to any of the ink heads.

Figure 5A:
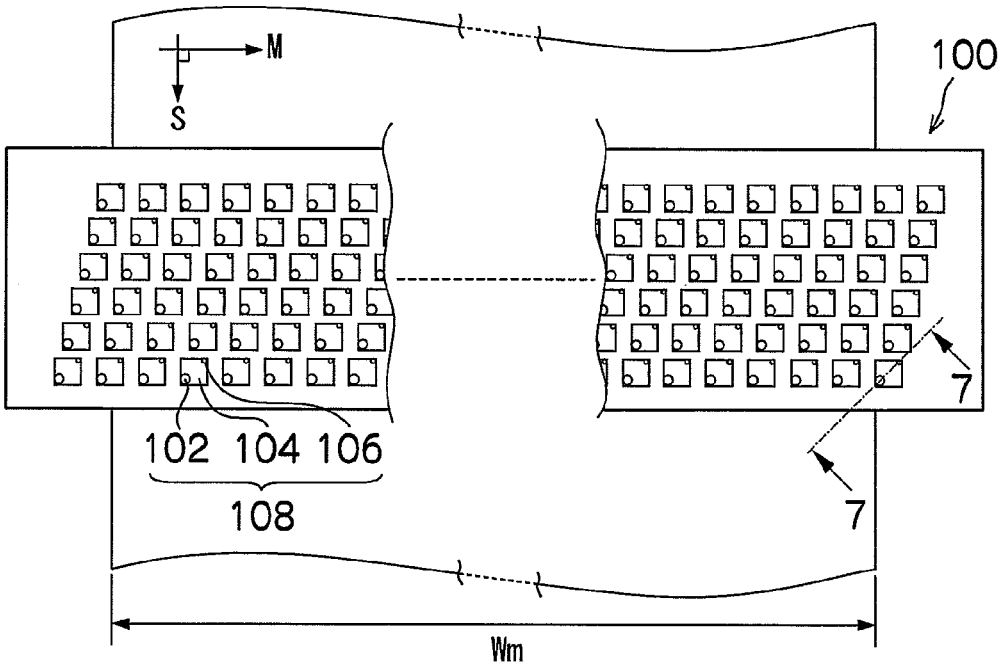
FIGS. 5A and 5B are plan view perspective diagrams showing the internal structure of a head.
Figure 5B:
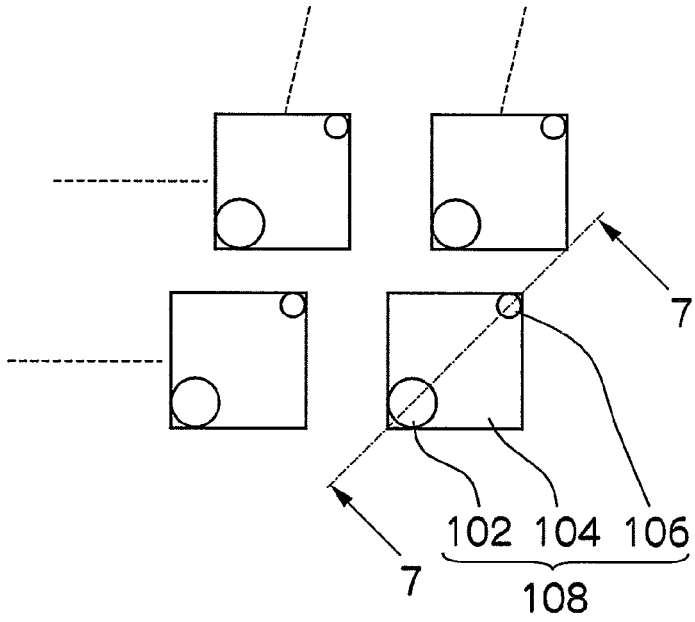

FIG. 5A is a perspective plan view illustrating an embodiment of the configuration of the ink head 100, FIG. 5B is an enlarged view of a portion thereof. The nozzle pitch in the ink head 100 should be minimized in order to maximize the density of the dots printed on the surface of the recording medium 22. As shown in FIGS. 5A and 5B, the ink head 100 according to the present embodiment has a structure in which a plurality of ink chamber units (droplet ejection elements as recording element units) 108, each having a nozzle 102 forming an ink ejection port, a pressure chamber 104 corresponding to the nozzle 102, and the like, are disposed two-dimensionally in the form of a staggered matrix, and hence the effective nozzle interval (the projected nozzle pitch) as projected in the lengthwise direction of the head (the direction perpendicular to the conveyance direction of the recording medium 22) is reduced and high nozzle density is achieved.

Figure 6:
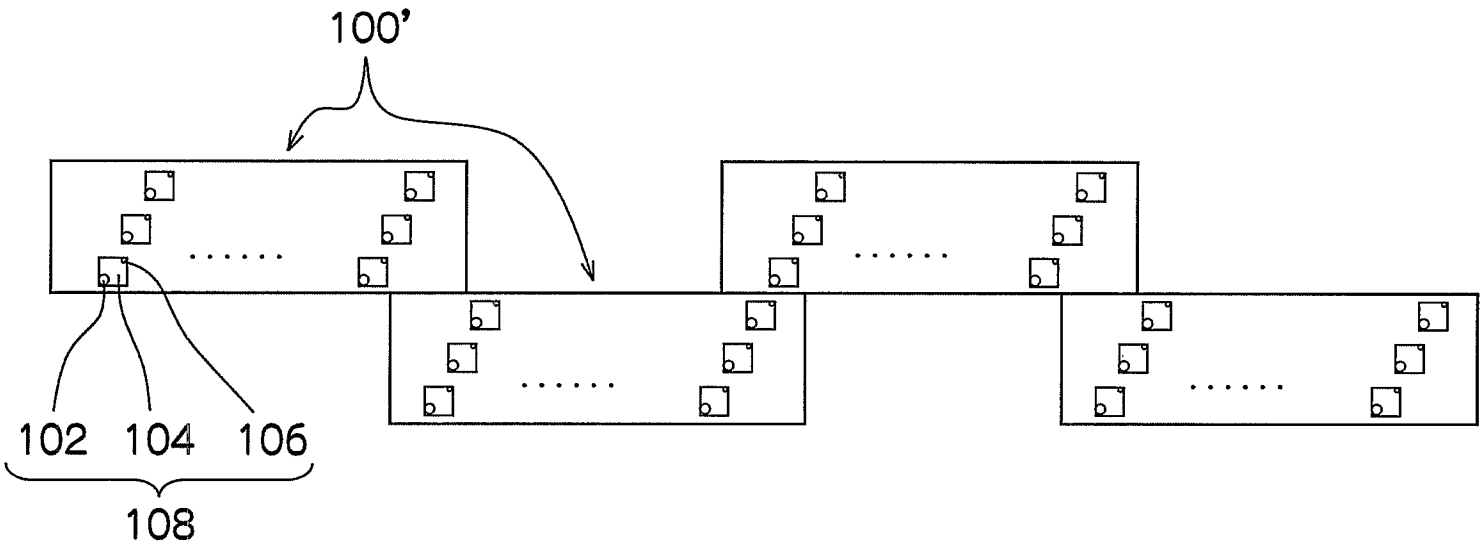
FIG. 6 is a plan diagram showing a further embodiment of the composition of a head.

The mode of composing one or more nozzle rows through a length corresponding to the full width of the image forming region of the recording medium 22 in the direction (the direction indicated by arrow M in FIG. 5A) substantially perpendicular to conveyance direction of the recording medium 22 (arrow S in FIG. 5A) is not limited to the example shown in FIGS. 5A and 5B. For example, instead of the composition in FIG. 5A, as shown in FIG. 6, a line head having nozzle rows of a length corresponding to the entire width of the image forming region of the recording medium 22 can be formed by arranging and combining, in a staggered matrix, short head modules 100' each having a plurality of nozzles 102 arrayed in a two-dimensional fashion.

As shown in FIGS. 5A and 5B, the planar shape of the pressure chamber 104 provided corresponding to each nozzle 102 is substantially a square shape, and an outlet port to the nozzle 102 is provided at one of the ends of a diagonal line of the planar shape, while an inlet port (supply port) 106 for supplying ink is provided at the other end thereof. The shape of the pressure chamber 104 is not limited to that of the present example and various modes are possible in which the planar shape is a quadrilateral shape (diamond shape, rectangular shape, or the like), a pentagonal shape, a hexagonal shape, or other polygonal shape, or a circular shape, elliptical shape, or the like.

Figure 7:
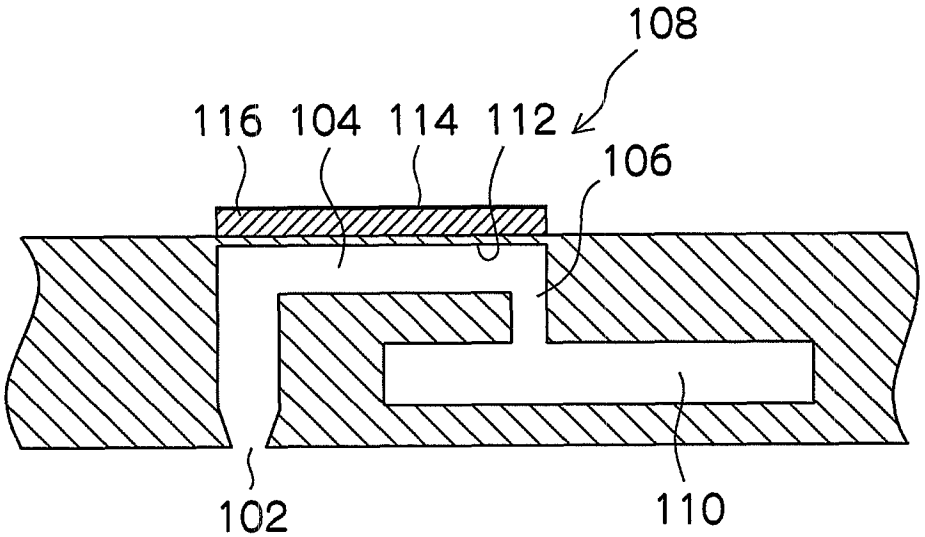
FIG. 7 is a cross-sectional view along line 9-9 in FIGS. 5A and 5B

FIG. 7 is a cross-sectional diagram (along line 7-7 in FIGS. 5A and 5B) illustrating the composition of the liquid droplet ejection element of one channel which forms a recording element unit in the ink head 100 (an ink chamber unit corresponding to one nozzle 102).

As shown in FIG. 7, each pressure chamber 104 is connected to a common channel 110 through the supply port 106. The common channel 110 is connected to an ink tank (not illustrated), which is a base tank that supplies ink, and the ink supplied from the ink tank is supplied, through the common flow channel 110, to the pressure chambers 104.

An actuator 116 provided with an individual electrode 114 is bonded to a pressure plate (a diaphragm that also serves as a common electrode) 112 which forms the surface of one portion (in FIG. 7, the ceiling) of the pressure chambers 104. When a drive voltage is applied to the individual electrode 114 and the common electrode, the actuator 116 deforms, thereby changing the volume of the pressure chamber 104. This causes a pressure change which results in ink being ejected from the nozzle 102. For the actuator 116, it is possible to adopt a piezoelectric element using a piezoelectric body, such as lead zirconate titanate, barium titanate, or the like. When the displacement of the actuator 116 returns to its original position after ejecting ink, the pressure chamber 104 is replenished with new ink from the common flow channel 110, via the supply port 106.

By controlling the driving of the actuators 116 corresponding to the nozzles 102 in accordance with the dot data generated from the input image by a digital half-toning process, it is possible to eject ink droplets from the nozzles 102. By controlling the ink ejection timing of the nozzles 102 in accordance with the speed of conveyance of the recording medium 22, while conveying the recording medium 22 in the sub-scanning direction at a uniform speed, it is possible to record a desired image on the recording medium 22.

Figure 8:
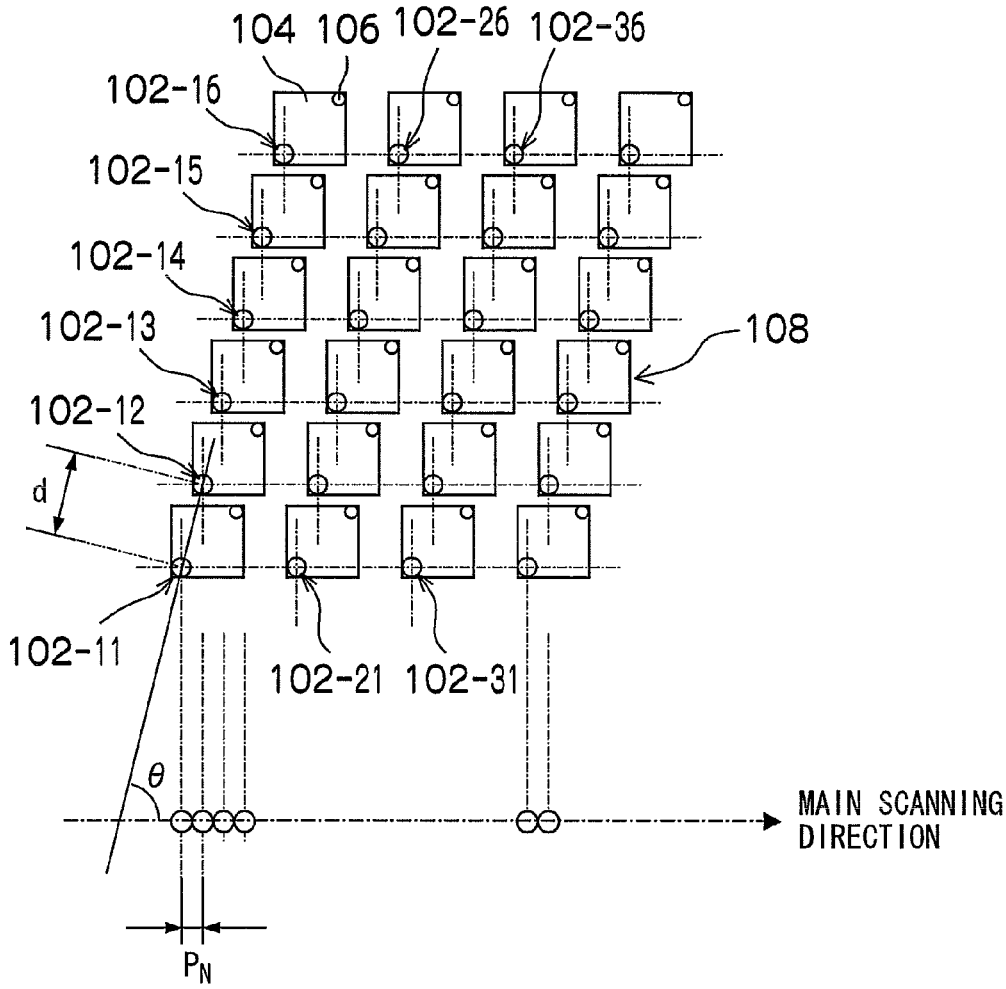
FIG. 8 is a plan diagram showing an embodiment of the arrangement of nozzles in a head.

As shown in FIG. 8, the high-density nozzle head according to the present embodiment is achieved by arranging a plurality of ink chamber units 108 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 108 are arranged at a uniform pitch d in line with a direction forming an angle of θ with respect to the main scanning direction, the pitch $P_N$ of the nozzles projected (orthogonal projection) so as to align in the main scanning direction is d×cos θ, and hence the nozzles 102 can be regarded to be equivalent to those arranged linearly at a fixed pitch $P_N$ along the main scanning direction. By adopting a composition of this kind, it is possible to achieve higher density of the effective nozzles rows when the nozzles are projected to an alignment in the main scanning direction.

In a full-line head comprising rows of nozzles that have a length corresponding to the entire width of the image recordable width, the "main scanning" is defined as printing one line (a line formed of a row of dots, or a line formed of a plurality of rows of dots) in the direction perpendicular to the conveyance direction of the recording medium 22 by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 102 arranged in a matrix such as that illustrated in FIG. 8 are driven, the main scanning according to the above-described (3) is preferred. More specifically, the nozzles 102-11, 102-12, 102-13, 102-14, 102-15 and 102-16 are treated as a block (additionally; the nozzles 102-21, 102-22, . . . , 102-26 are treated as another block; the nozzles 102-31, 102-32, . . . , 102-36 are treated as another block; . . . ); and one line is printed in the direction perpendicular to the conveyance direction of the recording medium 22 by sequentially driving the nozzles 102-11, 102-12, . . . , 102-16 in accordance with the conveyance velocity of the recording medium 22.

On the other hand, "sub-scanning" is defined as to repeatedly perform printing of one line (a line formed of a row of dots, or a line formed of a plurality of rows of dots) formed by the main scanning, while moving the full-line head and the recording medium 22 relatively to each other.

The direction indicated by one line (or the lengthwise direction of a band-shaped region) recorded by the main scanning as described above is called the "main scanning direction", and the direction in which the sub-scanning is performed, is called the "sub-scanning direction". In other words, in the present embodiment, the conveyance direction of the recording medium 22 is called the sub-scanning direction and the direction perpendicular to same is called the main scanning direction. In implementing the present embodiment of the invention, the arrangement of the nozzles is not limited to that of the example illustrated.

Moreover, a method is employed in the present embodiment where an ink droplet is ejected by means of the deformation of the actuator 116, which is typically a piezoelectric element; however, in implementing the present embodiment of the invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

<Control System>

Figure 9:
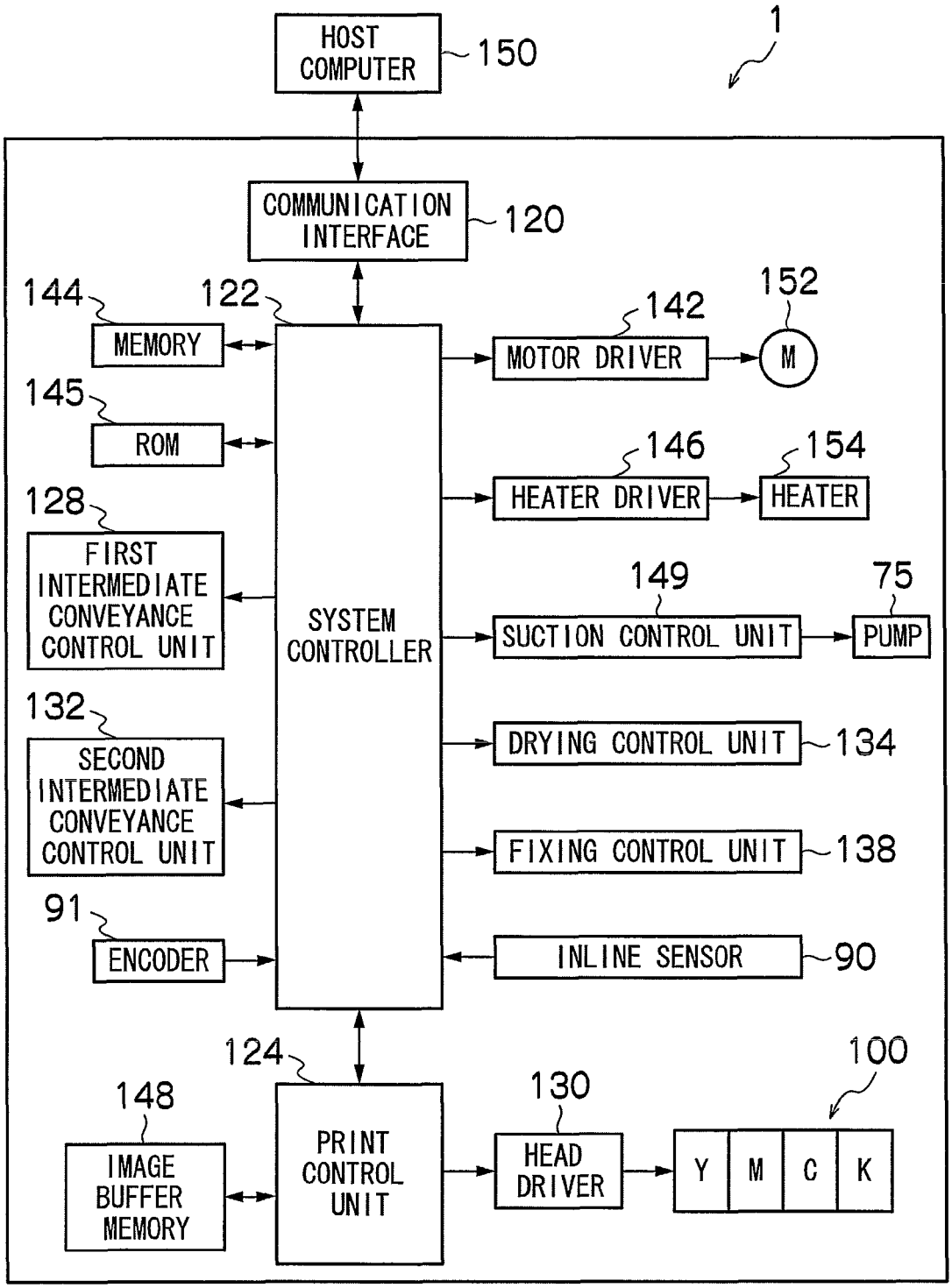
FIG. 9 is a principal block diagram showing the system composition of the inkjet recording apparatus.

FIG. 9 is a principal block diagram illustrating the system composition of the inkjet recording apparatus 1. The inkjet recording apparatus 1 includes a communication interface 120, a system controller 122, a print controller 124, a first intermediate conveyance control unit 128, a head driver 130, a second intermediate conveyance control unit 132, a drying control unit 134, a fixing control unit 138, the in-line sensor 90, the encoder 91, a motor driver 142, a memory 144, a heater driver 146, an image buffer memory 148, a suction control unit 149, and the like.

The communication interface 120 is an interface unit for receiving image data sent from a host computer 150. A serial interface such as USB (Universal Serial Bus), IEEE 1394, Ethernet, wireless network, or a parallel interface such as a Centronics interface may be used as the communication interface 120. A buffer memory (not illustrated) may be mounted in this portion in order to increase the communication speed. The image data sent from the host computer 150 is received by the inkjet recording apparatus 1 through the communication interface 120, and is temporarily stored in the memory 144.

The system controller 122 is constituted of a central processing unit (CPU) and peripheral circuits thereof, and the like, and functions as a control device which controls the whole of the inkjet recording apparatus 1 in accordance with prescribed programs, as well as functioning as a calculation device which carries out various calculations. In other words, the system controller 122 controls the respective sections such as the communication interface 120, the first intermediate conveyance control unit 128, the head driver 130, the second intermediate conveyance control unit 132, the drying control unit 134, the fixing control unit 138, the memory 144, the motor driver 142, the heater driver 146, the suction control unit 149, and the like, and controls communications with the host computer 150 and reading from and writing to the memory 144, and the like, as well as generating control signals for controlling the motor 152 of the conveyance system and the heater 154.

The memory 144 is a storage device which temporarily stores an image input via the communication interface 120, and data is read from and written to the image memory 144 via the system controller 122. The memory 144 is not limited to being a memory comprising a semiconductor element, and may also use a magnetic medium, such as a hard disk.

Programs executed by the CPU of the system controller 122 and the various types of data which are required for control procedures are stored in the ROM 145. The ROM 145 may be a non-rewriteable storage device, or it may be a rewriteable storage device, such as an EEPROM. The memory 144 is used as a temporary storage region for the image data, and it is also used as a program development region and a calculation work region for the CPU.

The motor driver 142 is a driver which drives the motor 152 in accordance with instructions from the system controller 122. In FIG. 9, the motors disposed in the respective sections in the apparatus are represented by the reference numeral 152. For example, the motor 152 shown in FIG. 9 includes motors that drive the rotation of the transfer drum 52, the image formation drum 70, the drying drum 76, the fixing drum 84, the transfer drum 94, and the like in FIG. 1, the drive motor of a pump 75 for creating a negative pressure by suction through the suction holes 74 of the image formation drum 70, the motor of the withdrawal mechanism of the head unit of the ink heads 72C, 72M, 72Y, 72K, and so on.

The heater driver 146 is a driver which drives the heater 154 in accordance with instructions from the system controller 122. In FIG. 9, the plurality of heaters which are provided in the inkjet recording apparatus 1 are represented by the reference numeral 154. For example, the heater 154 shown in FIG. 9 includes a pre-heater (not shown) which heats the recording medium 22 previously to a suitable temperature in the paper supply unit 10.

The print controller 124 has a signal processing function for performing various tasks, compensations, and other types of processing for generating print control signals from the image data stored in the memory 144 in accordance with commands from the system controller 122 so as to supply the generated print data (dot data) to the head driver 130. Required signal processing is carried out in the print controller 124, and the ejection amount and the ejection timing of the ink droplets from the respective ink heads 100 are controlled via the head driver 130, on the basis of the print data. In this way, desired dot size and dot positions can be achieved.

The print controller 124 is provided with the image buffer memory 148; and image data, parameters, and other data are temporarily stored in the image buffer memory 148 when image data is processed in the print controller 124. The aspect illustrated in FIG. 9 is one in which the image buffer memory 148 accompanies the print controller 124; however, the memory 144 may also serve as the image buffer memory 148. Also possible is an aspect in which the print controller 124 and the system controller 122 are integrated to form a single processor.

To give a general description of the sequence of processing from image input to print output, image data to be printed (original image data) is input from an external source via the communications interface 120, and is accumulated in the memory 144. At this stage, RGB image data is stored in the memory 144, for example.

In the inkjet recording apparatus 1, an image which appears to have a continuous tonal graduation to the human eye is formed by changing the droplet deposition density and the dot size of fine dots created by ink (coloring material), and therefore, it is necessary to convert the input digital image into a dot pattern which reproduces the tonal gradations of the image (namely, the light and shade toning of the image) as faithfully as possible. Therefore, original image data (RGB data) stored in the memory 144 is sent to the print controller 124 through the system controller 122, and is converted to the dot data for each ink color by a half-toning technique, using a threshold value matrix, error diffusion, or the like, in the print controller 124.

In other words, the print controller 124 performs processing for converting the input RGB image data into dot data for the four colors of K, C, M and Y. The dot data generated by the print controller 124 in this way is stored in the image buffer memory 148.

The head driver 130 outputs drive signals for driving the actuators 116 corresponding to the respective nozzles 102 of the ink heads 100, on the basis of the print data supplied by the print controller 124 (in other words, the dot data stored in the image buffer memory 148). A feedback control system for maintaining constant drive conditions in the head may be included in the head driver 130.

By supplying the drive signals output by the head driver 130 to the ink heads 100, ink is ejected from the corresponding nozzles 102. An image is formed on the recording medium 22 by controlling ink ejection from the ink heads 100 while conveying the recording medium 22 at a prescribed speed.

The system controller 122 controls the first intermediate conveyance control unit 128, the second intermediate conveyance control unit 132, the drying control unit 134, the fixing control unit 138 and the suction control unit 149. The compositions of the first and second intermediated conveyance units 26 and 28 are described later with reference to FIG. 11.

The first intermediate conveyance control unit 128 controls the operation of an intermediate conveyance body 30 and a conveyance guide 32 of the first intermediate conveyance unit 26, in accordance with instructions from the system controller 122. More specifically, with respect to the intermediate conveyance body 30, the first intermediate conveyance control unit 128 controls the actual rotational driving of the intermediate conveyance body 30, the rotation of the holding device 34 provided on the intermediate conveyance body 30, and the driving of a blower 38, and the like. Furthermore, with respect to the intermediate conveyance body 30, the first intermediate conveyance control unit 128 controls the operation of a pump 43 which performs a suction operation through the suction holes 42, and the like.

Figure 10:
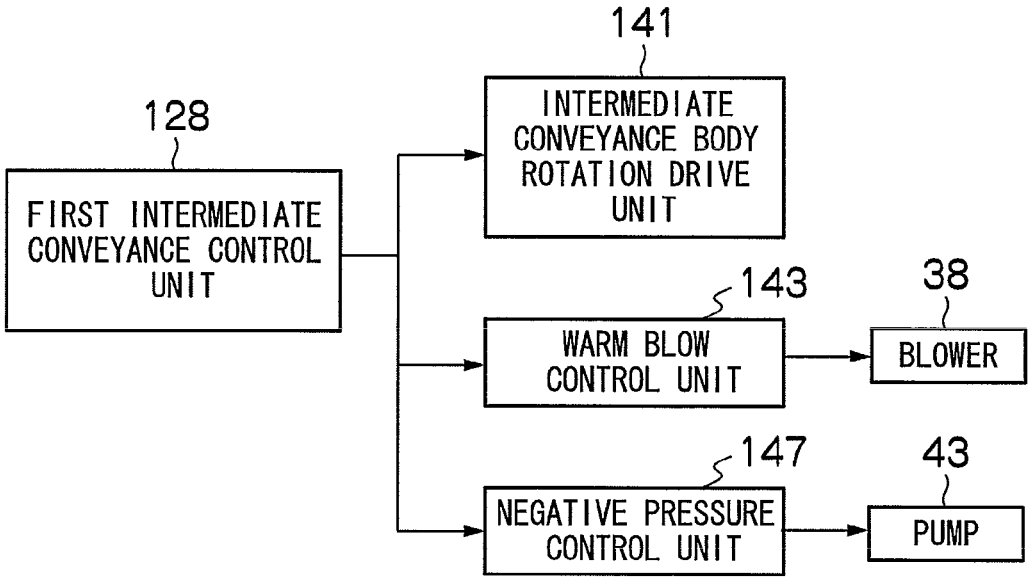
FIG. 10 is a principal block diagram showing the system composition of a first intermediate conveyance control unit.

FIG. 10 is a principal block diagram illustrating the system composition of the first intermediate conveyance control unit 128. As shown in FIG. 10, the first intermediate conveyance control unit 128 includes an intermediate conveyance body rotational drive unit 141, an air blowing control unit (warm air control unit) 143, and a negative pressure control unit 147.

The rotational driving of the actual intermediate conveyance body 30 is controlled by the intermediate conveyance body rotational drive unit 141.

The air blowing control unit 143 is able to control and adjust the temperature and flow rate of the wind blown from the blower 38, so as to promote the efficient drying of the moisture contained in the aqueous ink, reduction of the viscosity of the high-boiling-point solvent, and permeation of the solvent. Furthermore, it is also possible to control the flow rate of the air blown from the blower 38 and to control the magnitude of the positive pressure created by the blown air, in accordance with the type of recording medium 22. Furthermore, it is also possible to control the temperature of the air blown from the blower 38 in accordance with the type of recording medium 22 (such as high-quality paper, coated paper, and the like).

The pump 43 is controlled by the negative pressure control unit 147 to suck the recording medium 22 via the non-recording surface, which is the surface opposite to the recording surface, in such a manner that the solvent contained in the aqueous ink permeates through the recording medium. Furthermore, it is also possible to control the negative pressure applied by the pump 43 in such a manner that the pressure can be altered on the basis of at least one of the thickness of the recording medium 22 and the porosity of the recording medium 22. Furthermore, it is also possible to control the magnitude of the negative pressure applied by the pump 43 in accordance with the type of recording medium 22.

The second intermediate conveyance control unit 132 has a similar system structure to the first intermediate conveyance control unit 128, and controls the operations of the intermediate conveyance body 30 and the conveyance guide 32 of the second intermediate conveyance unit 28.

The drying control unit 134 controls the operations of the first IR heater 78, the warm-air blow-out nozzle 80 and the second IR heater 82 in the drying unit 16, in accordance with instructions from the system controller 122.

The fixing control unit 138 controls the operations of the first fixing roller 86 and the second fixing roller 88 in the fixing unit 18 in accordance with instructions from the system controller 122.

The suction control unit 149 controls the operation of the pump 75 which is connected to the suction holes 74 of the image formation drum 70 in the image formation unit 14.

The in-line sensor 90 provides the system controller 122 with determination signals of measurement results data for the test pattern applied to the recording medium 22, the moisture content, the surface temperature and the luster, and other characteristics, of the recording medium 22. Moreover, the encoder 91 provides the system controller 122 with determination signals for the speed of rotation of the image formation drum 70, and the droplet ejection timing of the ink head 100 is duly controlled via the head driver 130.

<Intermediate Conveyance Unit>

Next, the structure of the intermediate conveyance units will be described.

The first intermediate conveyance unit 26 is a conveyance device for conveying the recording medium 22 from the image formation drum 70 of the image formation unit 14 to the drying drum 76 of the drying unit 16. The second intermediate conveyance unit 28 is a conveyance device for conveying the recording medium 22 from the drying drum 76 of the drying unit 16 to the fixing drum 84 of the fixing unit 18.

The first intermediate conveyance unit 26 and the second intermediate conveyance unit 28 share a similar structure, and therefore the first intermediate conveyance unit 26 is described here as a representative example.

In broad terms, the first intermediate conveyance unit 26 is composed of the intermediate conveyance body 30 and the conveyance guide 32.

The intermediate conveyance body 30 is a device which holds an end of the recording medium 22 that has been received from the image formation drum 70, which is the pressure drum of the image formation unit 14, and causes the recording medium 22 to rotate and be transferred to the drying drum 76. The intermediate conveyance body 30 has the hook-shaped holding device 34 for holding the end of the recording medium 22. The holding device 34 rotates while tracing a circular path. In the present embodiment, two holding devices 34 are provided on the respective end portions of the intermediate conveyance body 30, but the number of holding devices 34 is not limited to this.

Figure 12A:
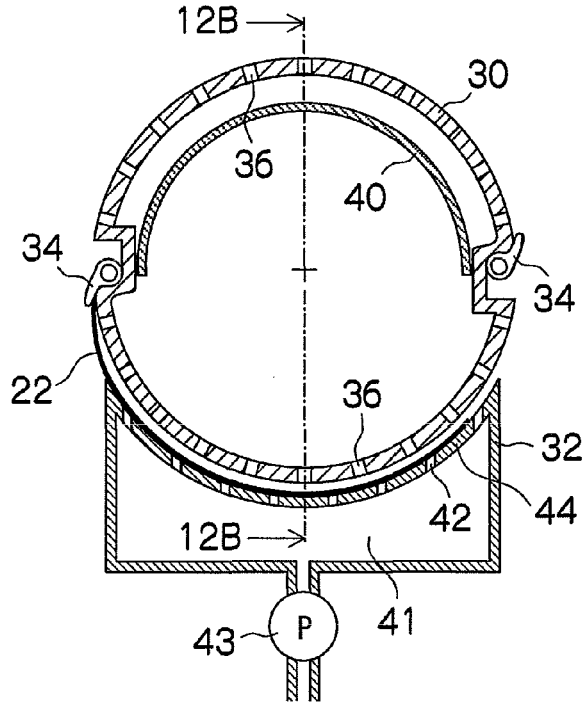
FIGS. 12A and 12B are cross-sectional diagrams of the first intermediate conveyance unit.
Figure 12B:
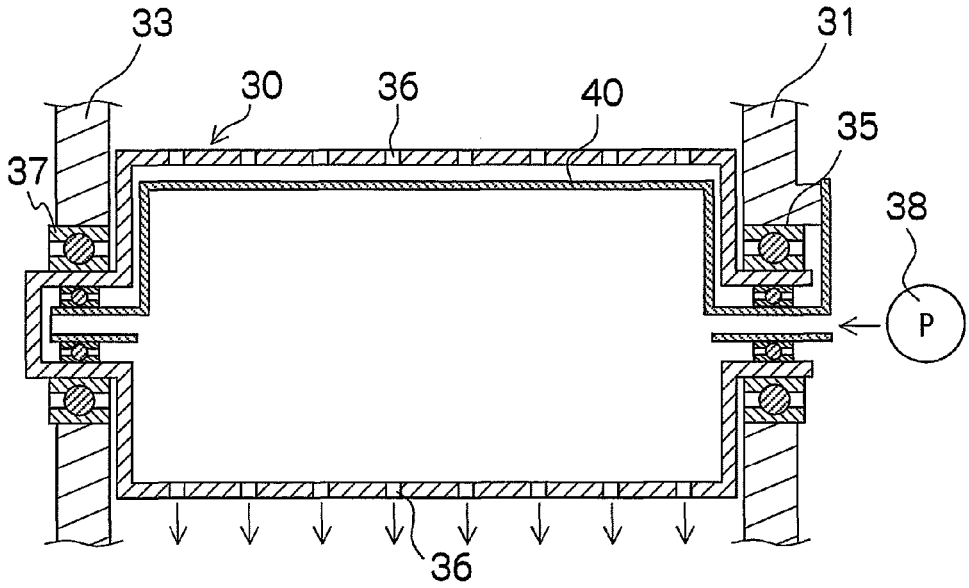

FIG. 12A is a cross-sectional diagram of the first intermediate conveyance unit 26, and FIG. 12B is a cross-sectional view along line 12B-12B in FIG. 12A.

As shown in FIG. 12B, the intermediate conveyance body 30 is rotatably arranged through bearings 35 and 37 on frames 31 and 33 which are fixed at an interval apart in the breadthways direction of the conveyed recording medium 22 (the direction perpendicular to the direction of conveyance).

As shown in FIGS. 12A and 12B, a plurality of blower ports 36 for blowing an air flow onto the recording surface of the recording medium 22 are formed in the surface of the intermediate conveyance body 30. The blower ports 36 are connected to the blower 38 which forms an air blowing device for blowing a flow of air. The air flow which is blown from the blower 38 is set, for example, to a temperature of 70° C. and a flow volume of 1 $m^3$/minute. Furthermore, desirably, an air flow is blown in a virtually perpendicular fashion onto the recording surface of the recording medium 22, from the plurality of blower ports 36.

Since the recording medium 22 is moved in rotation following the conveyance guide 32 due to the air blown from the blower ports 36, then the contact between the intermediate conveyance body 30 and the recording surface of the recording medium 22 is avoided and adherence of the ink to the intermediate conveyance body 30 can be prevented.

Furthermore, as shown in FIGS. 12A and 12B, the intermediate conveyance body 30 internally includes an air flow restriction guide 40 which partially restricts the air flow blown out from the blower ports 36. The air flow restriction guide 40 is fixed to the frame 31, as shown in FIG. 12B. For example, in FIG. 12A, a state is depicted in which the recording medium 22 is held by the holding device 34 on the left-hand side in the drawing, and the recording medium 22 is positioned toward the conveyance guide 32 side with respect to the intermediate conveyance body 30. In this case, the air flow restricting guide 40 restricts the to direction of the air flow in such a manner that an air flow is blown out from the blower ports 36 which oppose the recording surface of the recording medium 22.

By restricting the direction of the air flow by means of the air flow restricting guide 40, the recording medium 22 is moved in rotation following the conveyance guide 32 more reliably due to the air flow blown from the blower ports 36, and therefore the contact between the intermediate conveyance body 30 and the recording surface of the recording medium 22 is avoided more reliably and adherence of the ink to the intermediate conveyance body 30 can be prevented.

Moreover, the blower ports 36 and the blower 38, and the like, serve as a positive pressure application device which applies a positive pressure by blowing an air flow onto the recording surface of the recording medium 22, and they also serve as a back-tension application device which cause a force to act on the recording medium 22 in the direction opposite to the direction of rotation, and therefore the recording medium 22 is moved in rotation while a back tension is caused to act on the recording surface of the recording medium 22.

In this way, when the recording medium 22 is conveyed in tight contact with the drying drum 76 by means of the leading end of the recording medium 22 being held by the holding device 73 of the drying drum 76, a back tension acts on the recording surface of the trailing portion of the recording medium 22 due to the air flow emitted from the blower ports 36, and therefore wrinkling and curling of the recording medium 22 do not occur during its conveyance to the drying drum 76.

Figure 11:
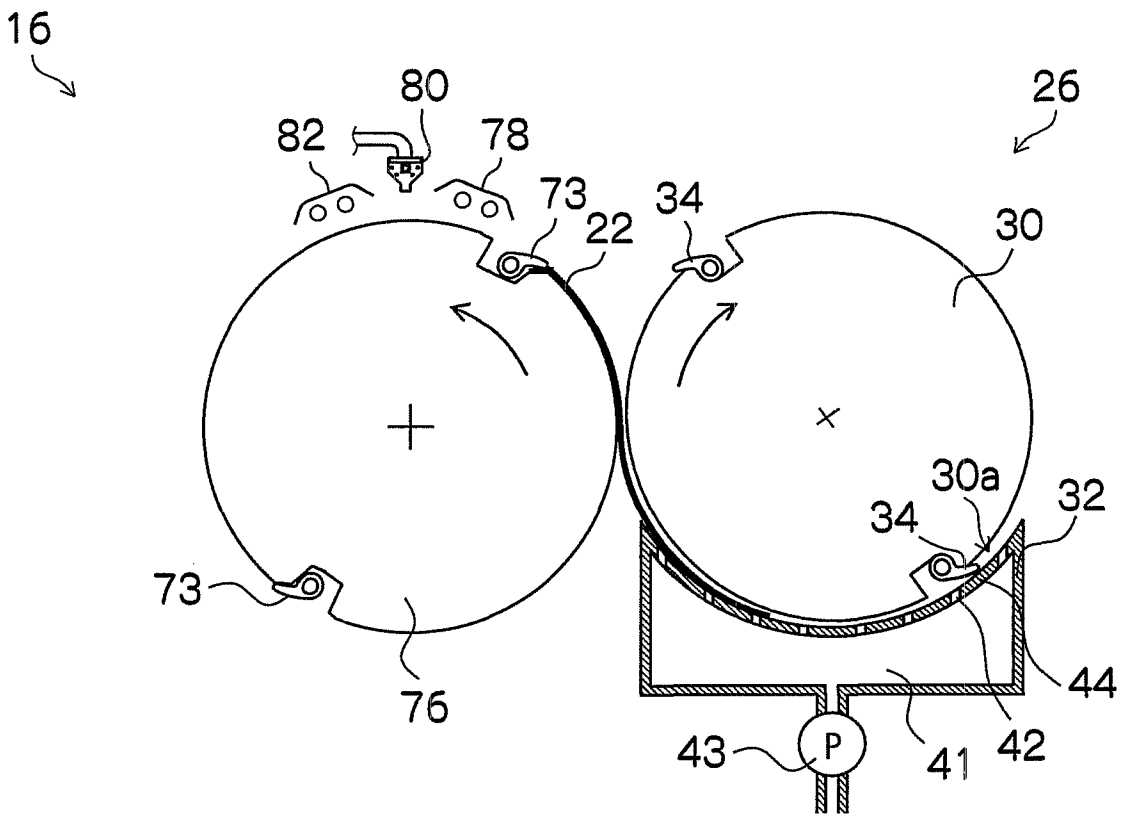
FIG. 11 is a schematic drawing showing the relationship between the first intermediate conveyance unit and the drying unit.

Furthermore, as shown in FIGS. 11 and 12, the conveyance guide 32 is disposed in the vicinity of the intermediate conveyance body 30. The conveyance guide 32 is formed in a circular arc shape and guides the rotational movement of the recording medium 22 while applying a back tension to the surface of the recording medium 22 opposite to the recording surface (below, this is referred to as the "non-recording surface"). More specifically, the conveyance guide 32 has a guide surface 30 a for guiding the conveyance of the recording medium 22, which is provided opposing the position where the holding devices 34 of the intermediate conveyance body 30 trace a circular arc-shaped path, and also has a back tension application device which causes a force to act on the recording medium 22 in the direction opposite to the direction of rotation of the recording medium 22.

For the back tension application device, it is possible to use a negative pressure application device which applies a negative pressure to the non-recording surface of the recording medium 22. More specifically, as the negative pressure application device, there are provided: a plurality of suction holes 42 which are formed in the guide surface 30*a*a chamber 41 which is connected to the suction holes 42, the pump 43 which is connected to the chamber 41, and so on.

Furthermore, the guide surface 30*a* has a plurality of supporting sections 44 which support and guide the recording medium 22.

In this way, when the recording medium 22 is conveyed in tight contact with the drying drum 76 by means of the leading end of the recording medium 22 being held by the holding device 73 of the drying drum 76, a back tension acts on the non-recording surface of the trailing portion of the recording medium 22 due to the sucking through the suction holes 42, and therefore wrinkling and curling of the recording medium 22 do not occur during its conveyance to the drying drum 76.

By means of the intermediate conveyance body 30 and the conveyance guide 32 which have the composition described above, the recording medium 22 is rotated and moved by means of the leading end thereof being held by the holding device 34 of the intermediate conveyance body 30, while the non-recording surface is attracted by suction with a negative pressure by the pump 43, through the suction holes 42 in the guide surface 30*a* of the conveyance guide 32. Consequently, the recording medium 22 is moved in rotation while being supported and guided by the holding sections 44. Thereafter, the recording medium 22 is transferred to the holding device 73 of the drying drum 76 from the holding device 34 of the intermediate conveyance body 30.

Here, the recording medium 22 is conveyed while the non-recording surface is supported by the supporting sections 44, and the recording surface of the recording medium 22 is conveyed without making contact with the constituent members of the intermediate conveyance body 30, the conveyance guide 32, and the like.

Furthermore, when the recording medium 22 is conveyed in tight contact with the drying drum 76 by means of the leading end of the recording medium 22 being held by the holding device 73 of the drying drum 76, then a back tension acts on the recording surface and the non-recording surface of the trailing portion of the recording medium 22, no wrinkling or curling of the recording medium 22 conveyed to the drying drum 76 occurs, and an image of high quality can be formed.

Apart from this, the back tension application device may be constituted of supporting sections 44 which have a large coefficient of friction on the surface thereof. More specifically, such a device may be constituted of supporting sections 44 having an increased surface roughness or supporting sections 44 having a surface made of a material such as rubber. It is thereby possible to achieve similar beneficial effects to a case where suction is applied.

As described above, a possible case is one in which the image formation unit 14 is provided with the intermediate conveyance unit (not shown) instead of the transfer drum 52, the intermediate conveyance body 30 of the intermediate conveyance unit holds the leading end of the recording medium 22 and moves the recording medium 22 in rotation, and the recording medium 22 is thereby transferred onto the image formation drum 70; in this case also, the intermediate conveyance unit also has a common structure to that of the first intermediate conveyance unit 26 and the second intermediate conveyance unit 28.

In this way, when the recording medium 22 is conveyed in tight contact with the image formation drum 70 by means of the leading end of the recording medium 22 being held by the holding device of the image formation drum 70, a back tension acts between the leading portion of the recording medium 22 and the portion conveyed in tight contact with the drum, and hence there is no occurrence of wrinkling or curling when the recording medium 22 is conveyed to the image formation drum 70 and a beneficial effect is achieved in that the ink can be precisely deposited on the recording medium 22.

Figure 13:
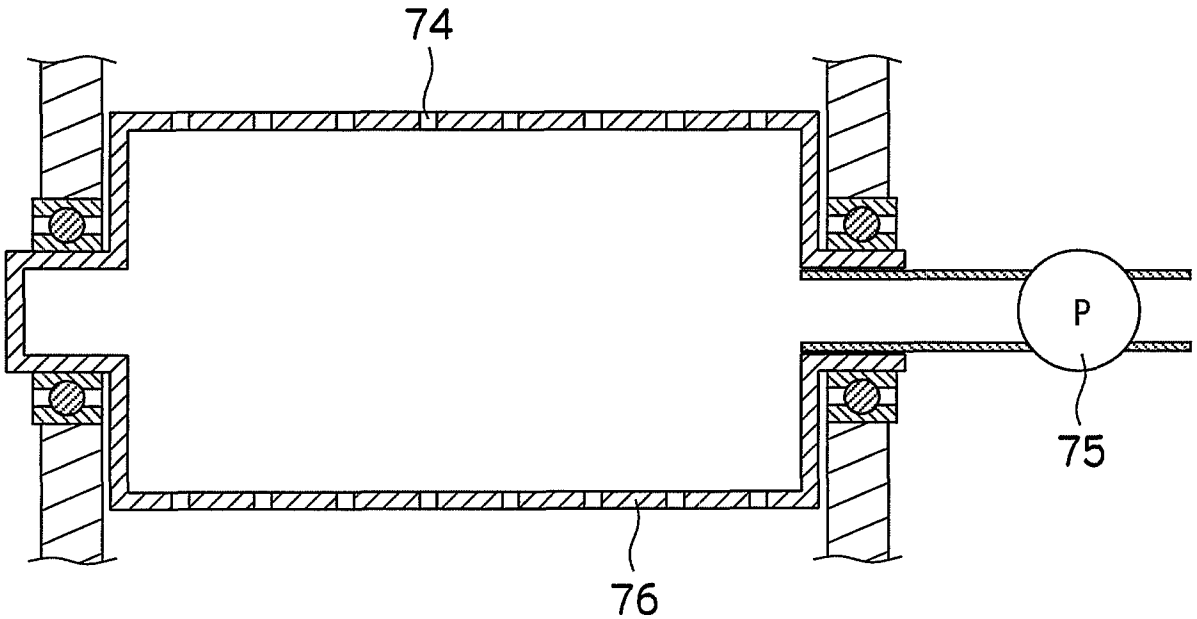
FIG. 13 is a cross-sectional diagram of a drying drum.

FIG. 13 is a cross-sectional diagram of the vicinity of the drying drum 76 when viewed in the breadthways direction of the recording medium 22 (the direction perpendicular to the direction of conveyance of the recording medium 22). As shown in FIG. 13, suction holes 74 for applying negative pressure which are connected to the pump 75 are provided in the outer circumferential side of the drying drum 76. Accordingly, when the recording medium 22 is conveyed in tight contact with the drying drum 76, the leading portion of the recording medium 22 is attracted by suction to make tight contact with the drying drum 76, while a back tension is caused to act on the trailing portion of the recording medium 22 by the first intermediate conveyance unit 26, and therefore it is possible to prevent the occurrence of wrinkling or curling of the recording medium 22 on the drying drum 76 in a more reliable fashion. It is also possible to keep the leading portion of the recording medium 22 in tight contact with the drying drum 76 by means of electrostatic attraction.

When the non-recording surface of the recording medium 22 is attracted by suction in each of the first and second intermediate conveyance units 26 and 28, the negative pressure applied by the pump 43 through the suction holes 42 can be controlled by the negative pressure control unit 147 of the control system (see FIG. 10) so as to be variable on the basis of at least one of the specifications of the recording medium 22, such as the thickness of the is recording medium 22, the porosity of the recording medium 22, the type of recording medium 22, and so on.

<Specific Effects of the Inkjet Recording Apparatus>

The below-described specific effects can be obtained with the inkjet recording apparatus 1 of the above-described configuration.

In the drying unit 16, the ink solvent on the recording medium 22 is dried by the first IR heater 78, warm-air blow-out nozzle 80, and second IR heater 82. Therefore, unevenness of image caused by the flow movement of the coloring material on the recording medium 22, and ink bleeding or color mixing occurring when a plurality of inks are applied are prevented and a high-quality image can be formed on the recording medium 22 at a high speed.

Concerning the relationship between the image formation unit 14 and the drying unit 16, the group of the inkjet heads 72C, 72M, 72Y, 72K and the group of the first IR heater 78, the warm-air blow-out nozzle 80 and the second IR heater 82 are arranged separately in terms of structure for the image formation drum 70 and the drying drum 76. Therefore, the image formation drum 70 itself is not heated, the meniscus of the inkjet heads 72C, 72M, 72Y, 72K is not dried, a non-ejection effect of the inkjet heads 72C, 72M, 72Y, 72K can be prevented, and a high-quality image can be formed at a high speed on the recording medium 22.

Concerning the relationship between the image formation unit 14, the drying unit 16 and the fixing unit 18, since the group of the inkjet heads 72C, 72M, 72Y and 72K, the group of the first IR heater 78, the warm-air blow-out nozzle 80 and the second IR heater 82, and the group of the first fixing roller 86 and the second fixing roller 88, are disposed as separate structures for the respective drums, then it is possible to set the temperatures of the first fixing roller 86 and the second fixing roller 88 freely.

Because the recording surface of the recording medium 22 does not come into contact with other structural members such as the intermediate conveyance body 30, the damage to image can be avoided.

Even in the case of a recording medium 22 of large size in which the recording surface of the recording medium is in a semi-wet state, it is possible to convey the medium accurately, and hence the position of the recording medium can be ensured to a high degree of accuracy.

By controlling the pressure applied to the recording medium 22 through controlling the blower 38 and the pump 43 in accordance with the type of the recording medium 22, by means of the air blowing control unit 143 and the negative pressure control unit 147, it is possible to achieve compatibility with the general characteristics of the recording medium 22.

If the pressure applied to the recording medium 22 is controlled by means of the air blowing control unit 143 and the negative pressure control unit 147 in accordance with at least one of the thickness of the recording medium 22 and the porosity of the recording medium 22, then it is possible to achieve compatibility with the general characteristics of the recording medium 22.

By blowing air flow onto the recording surface of the recording medium 22 from the blower ports 36 of the intermediate conveyance body 30, it is possible to further promote the permeation of the high-boiling-point solvent of the inks on the recording surface of the recording medium 22 into the recording medium 22.

By restricting the direction of the air flow using the air flow restriction guide 40 in such a manner that an air flow is blown from the blower ports 36 which oppose the recording surface of the recording medium 22, the permeation into the recording medium 22 of the high-boiling-point solvent of the inks on the recording surface of the recording medium 22 is promoted in a more reliable fashion.

Table 1 shows evaluation results on a viscosity characteristic of a high boiling-point solvent vs. a liquid temperature for the liquid including the high boiling-point solvent. Table 1 shows the evaluation results obtained when the content of the high boiling-point solvent was set to 5 levels and the liquid temperature was set to 3 levels. The viscosity unit is mPa·s (cP).

TABLE 1

| | | CONTENT OF HIGH BOILING-POINT SOLVENT (wt %) | | | | |
|---|---|---|---|---|---|---|
| | | 100 | 90 | 67 | 50 | 33 |
| TEMPERATURE OF LIQUID (° C.) | 25 | 507 | 264 | 33.9 | 10.85 | 4.146 |
| | 40 | 246 | 101.8 | 16.14 | 5.196 | 2.58 |
| | 60 | 82.44 | 33.72 | 7.308 | 3.204 | 1.56 |

As shown in Table 1, the viscosity of a high boiling-point solvent tends to decrease with the increase in liquid temperature. Therefore, the penetration of the solvent of the aqueous ink into the recording medium 22 can be enhanced by blowing warm air to increase the aqueous ink temperature and decrease the viscosity of the high boiling-point solvent of the aqueous ink.

When the conveying guide 32 in the intermediate conveyance body 30 transfers the recording medium 22 to the image formation drum 70, the drying drum 76, or the fixing drum 84, a force (back tension) acts in the direction opposite to the rotation direction of the recording medium 22. As a result, the occurrence of wrinkles or floating when the recording medium 22 is conveyed to the drying drum 76 or the fixing drum 84 can be reduced. Thus, because tension is applied to the recording medium 22 and drying is enhanced on the drying drum 76, the effect of reducing curling and codding is obtained, and because a tension is applied on the fixing drum 84 and the recording medium 22 is conveyed to the fixing unit 18, while reducing the floating of the recording medium 22, the effect of preventing the occurrence of wrinkles of the recording medium 22 in the fixing unit 18 is obtained.

A device that attracts the non-recording surface of the recording medium 22 by suction can be considered for applying a back tension to the recording medium 22. A device that blows air on the recording surface of the recording medium 22 also can be considered for applying a back tension to the recording medium 22. By partially restricting the flow of air blown onto the recording surface of the recording medium 22, for example, if the direction of air flow is restricted so that the air flow is blown from blower ports 36 in the direction facing the recording surface of the recording medium 22 by the blow control guide 40, a back tension can be effectively caused to act upon the recording medium 22. Other suitable methods include increasing the surface roughness of the guide surface 44 of the conveying guide 32 or attaching rubber or the like and increasing the friction force.

Further, where the image formation drum 70, or drying drum 76, or fixing drum 84 is provided with a device that brings the recording medium 22 into tight contact with the peripheral surface of the drum, the occurrence of wrinkles of floating can be reliably prevented when the recording medium 22 is conveyed to the image formation drum 70. A suction device or an electrostatic attraction device can be considered for bringing the recording medium 22 into tight contact with the peripheral surface of the drum.

Further, in the first intermediate conveyance unit 26, the recording medium 22 is rotated and moved, while the leading end of the recording medium 22 is held by the holding devices 34 of the intermediate conveyance body 30. In this case, the recording medium 22 is conveyed while the non-recording surface thereof is supported by the supporting sections 44, by performing at least any one from blowing an air flow from the blower ports 36 of the intermediate conveyance body 30 and creating suction from the suction holes 42 of the conveying guide 32. Therefore, the recording medium 22 is conveyed in a state in which the recording surface does not come into contact with the intermediate conveyance body 30. Therefore, the image formed by an aqueous ink applied on the recording surface of the recording medium in the image formation unit 14 remains intact.

By partially restricting the flow of air blown onto the recording surface of the recording medium 22, for example, if the direction of air flow is restricted so that the air flow is blown from the blower ports 36 in the direction facing the recording surface of the recording medium 22 by the blow control guide 40, a back tension can be effectively caused to act upon the recording medium 22.

Where either one from suction from the suction holes 42 of the conveying guide 32 and blowing an air flow from the blower ports 36 of the intermediate conveyance body 30 is performed in the first intermediate conveyance unit 26 and second intermediate conveyance unit 28, the high boiling-point solvent contained in the aqueous ink applied in the image formation unit 14 penetrates into the recording medium. Therefore, when the image is fixed using the first fixing roller 86 and the second fixing roller 88 in the fixing unit 18 of the subsequent process, because the high boiling-point solvent is not present on the surface of the recording medium 22, the adhesion of the aggregated coloring material and recording medium can be ensured, fixing ability of the image is increased, quality of the image is increased, and also the coloring material offset to the first fixing roller 86 and the second fixing roller 88 is improved.

When the non-recording surface of the recording medium 22 is attracted by suction, the negative pressure applied from the suction holes 42 by the pump 43 may be variably controlled based on at least one from among the thickness of the recording medium 22 and the porosity of the recording medium 22 with the negative pressure control unit 147 (see FIG. 10) of the control system. More specifically, where the thickness of the recording medium 22 is large, the negative pressure applied from the suction holes 42 by the pump 43 is increased to enhance the penetration of solvent into the recording medium 22. Further, where the porosity of the recording medium 22 is small, the negative pressure applied from the suction holes 42 by the pump 43 is increased to enhance the penetration of solvent into the recording medium 22.

Further, when warm air is blown on the recording surface of special paper from blower ports 36 of the intermediate conveyance body 30, in the first intermediate conveyance unit 26 and the second intermediate conveyance unit 28, the viscosity of the high boiling-point solvent contained in the ink is decreased, the penetration of the solvent into the recording medium 22 is enhanced, and the drying of the residual moisture contained in the ink is enhanced.

The temperature and amount of air blown from the blower 38 may be adjusted and controlled by the blower control unit 143 of the control system (see FIG. 10) so as to enhance efficiently the decrease in viscosity of the high boiling-point solvent and the drying of the residual moisture contained in the ink.

The inkjet recording apparatus and the inkjet recording method in accordance with the present invention are described hereinabove in details, but the present invention is not limited to the above-described examples and it goes without saying that various modification and changes may be made without departing from the scope of the present invention.

Recording Medium

The recording medium 22 used in the image forming method according to the present invention is described below in detail.

The recording medium 22 used in the present invention is composed of a base paper, a first layer and a second layer, and also has other layers selected appropriately according to requirements.

Figure 14:
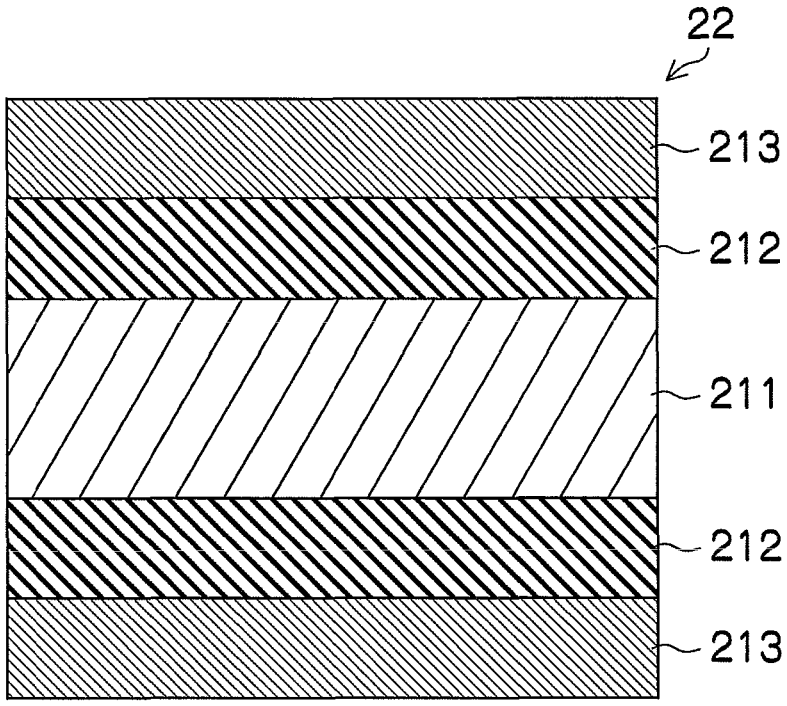
FIG. 14 is a cross-sectional diagram of a recording medium used in the image forming method according to an embodiment of the present invention.

For example, as shown in FIG. 14, the recording medium 22 is composed of a base paper 211 which uses high quality paper, a first layer 212 which is formed as a solvent blocking layer on the base paper 211, and a second layer 213 which is formed as an ink absorbing layer on the first layer 212. The recording medium 22 may be in the form of sheets or a roll.

<Base Paper>

There are no particular restrictions on the base paper 211, which can be selected appropriately from among commonly known papers in accordance with the objectives.

With regard to the pulp which can be used as the raw material of the base paper 211, from the viewpoint of achieving good balance between the surface smoothness, rigidity and dimensional stability (curl characteristics) of the base paper, as well as improving these properties to a sufficiently high level, broad-leaf beached kraft pulp (LBKP) is desirable, but it is also possible to use needle bleached kraft pulp (NBKP) or broad-leaf bleached sulfite pulp (LBSP) and the like.

It is possible to use a beater or refiner, or the like, to beat the pulp. According to requirements, various additives can be added to the pulp slurry obtained after beating the pulp (hereinafter referred to as "pulp paper material"), such as fillers, dry paper strengthening agents, sizing agents, wet paper strengthening agents, fixing agents, pH adjusters, or other chemicals.

Possible examples of a filling material are: calcium carbonate, clay, kaolin, white clay, talc, titanium oxide, diatomaceous earth, barium sulfate, aluminum hydroxide, magnesium hydroxide, and the like. Examples of dry paper strengthening agents include: cationic starch, cationic polyacrylamide, anionic polyacrylamide, amphoteric polyacrylamide, and carboxy-modified vinyl alcohol, and the like. Examples of sizing agents include: fatty acid salts, rosin and rosin derivatives such as maleic rosin, paraffin waxes, alkyl ketene dimers, alkenyl succinic anhydrides (ASA), epoxified fatty acid amides, and the like.

Examples of wet paper strengthening agents include: polyamine polyamide epichlorohydrin, melamine resins, urea resins, epoxified polyamide resins, and the like. Examples of fixing agents include: polyvalent metal salts, such as aluminum sulfate or aluminum chloride, cationic polymers such as cationic starch, and the like. Examples of pH adjusters include: caustic soda and sodium carbonate.

Examples of other chemicals include: defoaming agents, dyes, slime controlling agents, fluorescent whiteners, and the like. Furthermore, it is also possible to add a softening agent, or the like, according to requirements. A softening agent is described in pages 554 to 555 of Shin Kamikakobinran ("*New Paper Processing Handbook*") (published by Shiyaku Time, 1980).

A treatment liquid used in surface sizing treatment may include, for example, a water-soluble polymer, a sizing agent, a water-resistant material, a pigment, a pH adjuster, a dye, a fluorescent whitener, or the like. Possible examples of the water-soluble polymer include: cationic starch, polyvinyl alcohol, carboxy-modified polyvinyl alcohol, carboxy methyl cellulose, hydroxyethyl cellulose, cellulose sulfate, gelatin, casein, sodium polyacrylate, sodium salts of copolymers of styrene and maleic anhydride, and sodium polystyrene sulfonate, and the like.

Possible examples of sizing agents are: petroleum resin emulsions, ammonium salts of alkyl esters of styrene-maleic anhydride copolymers, rosin, higher fatty acid salts, alkyl ketene dimers (AKD), epoxified fatty acid amides, and the like.

Examples of the water-resistant material include: latexes or emulsions of styrene-butadiene copolymers, ethylene-vinyl acetate copolymers, polyethylene, vinylidene chloride copolymers, or the like, or polyamide polyamine epichlorohydrin.

Examples of pigments include: calcium carbonate, clay, kaolin, talc, barium sulfate, titanium oxide, and the like. Examples of pH adjusters include: hydrochloric acid, caustic soda and sodium carbonate.

Apart from the natural pulp papers described above, other possible examples of the material of the base paper 211 include: synthetic pulp paper, mixed paper which combines natural pulp and synthetic pulp, and various types of combination papers. The thickness of the base paper is 30 μm to 500 μm, desirably, 50 μm to 300 μm, and more desirably, 70 μm to 200 μm.

<First Layer>

There are no particular restrictions on the first layer 212, and it is possible to select a suitable material from amongst commonly known materials in accordance with the objectives, provided that it contains a binder and that the base paper 211 with the first layer 212 provided thereon has a water absorbency (Cobb method) of 5.0 $g/m^2$ or lower with a contact time of 15 seconds in a water absorbency test as specified in JIS P8140; and more desirably, the first layer 212 should have the following conditions.

Desirably, the base paper 211 with the first layer 212 provided thereon should have a Cobb water absorbency of 2.0 $g/m^2$ or lower with a contact time of 2 minutes based on a water absorbency test as specified in JIS P8140. Furthermore, desirably, the base paper 211 with the first layer 212 provided thereon should have a Cobb value of 5.0 $g/m^2$ or lower with a contact time of 2 minutes when using diethylene glycol in a water absorbency test as specified in JIS P8140. Furthermore, it is desirable that: the binder contains at least one of a thermoplastic resin and polyvinyl alcohol (desirably, an acetoacetyl-modified polyvinyl alcohol having a degree of polymerization of 1000 or above), the binder also contains a lamina inorganic compound, the weight ratio X/Y between the weight X of the polyvinyl alcohol and the weight Y of water-swellable synthetic mica forming the lamina inorganic compound is not lower than 1 and not higher than 30, the binder also contains a hardening agent, and the binder also contains a white pigment.

Binder

There are no particular restrictions on the binder contained in the first layer 212, provided that it contains at least one of a thermoplastic resin and a polyvinyl alcohol, but desirably it contains a thermoplastic resin.

There are no particular restrictions on the thermoplastic resin, and a commonly known thermoplastic resin or latex of same can be chosen appropriately, such as a polyolefin resin (for example, a homopolymer of an α-olefin, such as polyethylene, polypropylene, or a mixture of these or the like). Of these, a latex is desirable, and suitable examples are: a polyester urethane latex, an acrylic latex, an acrylic silicone latex, an acrylic epoxy latex, an acrylic styrene latex, an acrylic urethane latex, a styrene butadiene latex, an acrylonitrile-butadiene latex, and a vinyl acetate latex, or the like; desirably, at least one of these is chosen and used. Of these latexes, it is particularly desirable to choose at least one of a polyester urethane latex and an acrylic silicone latex.

Possible examples of the polyester urethane latex are: the Hydran AP series and the Hydran ECOS series manufactured by Dainippon Ink and Chemicals.

For the acrylic latex, it is possible to use commercial products, for example, water-dispersible latexes such as those described below. More specifically, possible examples of the acrylic resins are: "Cevian A 4635, 46583, 4601", and the like, manufactured by Daicel Chemical Industries and "Nipol LX811, 814, 821, 820, 857", and the like, manufactured by Nippon Zeon.

It is particularly desirable to use an acrylic emulsion of an acrylic silicone latex as described in Japanese Patent Application Publication Nos. 10-264511, 2000-43409, 2000-343811 and 2002-120452 (examples of commercially available products of this are: "Aquabrid series UM7760, UM7611, UM4901, MSi-045, ASi-753, ASi-903, ASi-89, ASi-91, ASi-86, 4635, MSi-04S, AU-124, AU-131, AEA-61, AEC-69 and AEC-162" manufactured by Daicel Chemical Industries).

The thermoplastic resins described above may be used independently or two or more types of resin may be used in combination.

The glass transition temperature (Tg) of the thermoplastic resin is desirably 5° C. to 70° C., and more desirably, 15° C. to 50° C. By setting the Tg value to this range in particular, there are no difficulties in handling during manufacture which give rise to problems such as drying and sticking of the liquid used to form the first layer (for example, a coating solution), and furthermore, it is possible to achieve high glossiness and high flatness readily, without the occurrence of problems such as failure to achieve the desired glossiness unless the Tg is set excessively high and the calender temperature is set fairly high, or increased likelihood of adhesion to the surface of a metal roll which is countered by deterioration of the surface condition.

The minimum film forming temperature of the thermoplastic resin is desirably 20° C. to 60° C., and more desirably, 25° C. to 50° C. By setting the minimum film forming temperature range in which film formation is possible to the aforementioned range in particular, then there are no difficulties in handling during manufacture which give rise to problems such as drying and sticking of the liquid used to form the first layer (for example, a coating solution), and furthermore, it is possible to form a layer which has sufficient microporosity to allow rapid passage of the ink solvent, without deterioration of the state of the coating surface of the layer as a result of large infiltration when forming the second layer 213. A layer which is only formed by applying a liquid (for example, a coating liquid) does not have good glossiness of itself, but a layer having high glossiness while preserving microporosity can be obtained by subsequently carrying out a soft calender process.

If the above-described composition is formed as a layer, then the content amount of the thermoplastic resin in the first layer 212 is desirably 15 wt % to 95 wt %, and more desirably, 30 wt % to 90 wt %, with respect to the solid content of the first layer 212. By setting the content amount to the aforementioned range in particular, it is possible to obtain good permeability of the ink solvent while more effectively preventing the occurrence of bleeding over time, without impairing the glossiness or flatness obtained from the calendering process.

The polyvinyl alcohol also includes, apart from polyvinyl alcohols (PVA), cation-modified polyvinyl alcohols, anion-modified polyvinyl alcohols, silanol-modified polyvinyl alcohols, acetoacetyl-modified polyvinyl alcohol and other polyvinyl alcohol derivatives. The polyvinyl alcohols may be used independently or in a combination or two or more types. Of these, it is preferable to use a polyvinyl alcohol or an acetoacetyl-modified polyvinyl alcohol.

Desirably, the polyvinyl alcohol has a degree of saponification of 70% to 99%, and more desirably 85% to 99%. Furthermore, desirably, the polyvinyl alcohol has a degree of polymerization of 1000 to 4500, and more desirably, 1500 to 4500. By setting the degree of saponification and the degree of polymerization to these ranges, it is possible to obtain suitable strength and extensibility in the film.

An acetoacetyl-modified polyvinyl alcohol which is one mode of the polyvinyl alcohols described above can generally be manufactured by adding a diketene in the form of liquid or gas to a solution, dispersion liquid or powder of a polyvinyl alcohol resin, to react with same. The degree of acetylation of the acetoacetyl-modified polyvinyl alcohol can be selected appropriately in accordance with the target quality of the recording medium, but desirably, it is 0.1 mol % to 20 mol % and more desirably, 0.5 mol % to 10 mol %.

The polyvinyl alcohol resins include a polyvinyl alcohol which can be obtained by saponification of a lower alcohol solution of polyvinyl acetate, and derivatives of same, and a saponification product of a copolymer of a monomer which can be copolymerized with a vinyl acetate and polyvinyl acetate. Possible examples of the monomer which can be copolymerized with vinyl acetate include: unsaturated carboxylic acids, such as maleic acid (anhydride), fumaric acid, crotonic acid, itaconic acid, (meth)acrylic acid, and esters thereof; α-olefins, such as ethylene and propylene; olefin sulfonates, such as (meth)allyl sulfonate, ethylene sulfonate and sulfonate maleate; olefin sulfonate alkali salts, such as sodium (meth)allyl sulfonate, sodium ethylene sulfonate, sodium sulfonate (meth)acrylate, sodium sulfonate (monoalkyl maleate) and sodium disulfonate alkyl maleate; amide group-containing monomers, such as N-methylol acrylamide and acrylamide alkyl sulfonate alkali salts; and N-vinyl pyrrolidone derivatives, and the like.

As the binder, apart from an acetyl-modified polyvinyl alcohol as described above, it is also possible to combine use of a compound which dissolves at 5 wt % or above in water at 25° C., in accordance with requirements. Possible examples of such binders include: polyvinyl alcohols (including modified polyvinyl alcohols, such as carboxyl-modified, itaconic acid-modified, maleic acid-modified, silica-modified and amino group-modified polyvinyl alcohols), methyl cellulose, carboxy methyl cellulose; starches (including modified starches), gelatin, gum arabic; casein, hydrolyzates of styrene-maleic anhydride copolymers, polyacrylamide, and saponification products of vinyl acetate-polyacrylic acid copolymers, and the like. These binders are used not only for the purpose of dispersion but also to improve the strength of the coated film, and in respect of this object, it is possible to combine use of a synthetic polymer latex binder, such as a styrene-butadiene copolymer, a vinyl acetate copolymer, a acrylonitrile-butadiene copolymer, a methyl acrylate-butadiene copolymer, polyvinylidene chloride, or the like. According to requirements, a suitable binder cross-linking agent may be added, depending on the type of binder.

Furthermore, the acetoacetyl-modified polyvinyl alcohol contained in the first layer 212 has a significant effect in suppressing the permeation of oxygen, and has a high S-S property. Here, the "S-S property" means the tensile energy absorption (toughness) as represented by the stress-elongation until rupture of the film. Therefore, the first layer 212 expands freely in response to processes which use heating and does not produce cracks and is not liable to blistering.

In the present invention, the degree of polymerization of the acetoacetyl-modified polyvinyl alcohol is desirably 1000 or above, and more desirably, 1500 or above. By making the degree of polymerization 1000 or above, a greater effect is obtained in suppressing the occurrence of cracks in low-humidity environments (for example, 20° C. and 10%). This can be laid down to the fact that setting the degree of polymerization to a relatively large figure of 1000 or above enables marked improvements in the strength and elongation of the film at rupture. Furthermore, setting a high degree of polymerization leads to increased viscosity of the coating liquid and a degraded coating surface state, but these drawbacks can be rectified by reducing the concentration of the coating liquid and the ratio of water-dispersible mica.

From the viewpoint of achieving water resistance by reaction with the film hardening agent and stability in an aqueous solution, the modification rate of the acetoacetyl-modified polyvinyl alcohol is desirably 0.05 mol % to 20 mol %, and more desirably, 0.05 mol % to 15 mol %.

There are no particular restrictions on the degree of saponification of the acetoacetyl-modified polyvinyl alcohol, and desirably, it is 80% to 99.5%. If the degree of saponification is low, then the elongation at the time of rupture becomes greater. If the degree of polymerization is high, then the degree of saponification becomes higher, but in the case of a low degree of polymerization, it is desirable that the degree of saponification should be low. Moreover, setting a low degree of saponification is advantageous in that while a large elongation can be obtained, the viscosity can be reduced and the leveling of the coated surface can be improved, thus improving the state of the coated surface.

<Cobb Water Absorbency>

The Cobb water absorbency is obtained by a water absorbency test as specified in JIS P8140 and measures the amount of water absorbed when one surface of paper makes contact with water for a prescribed period of time. The contact time was set as 15 seconds and 2 minutes.

<Cobb Value>

The Cobb value measures the amount of diethylene glycol absorbed when one surface of paper makes contact with diethylene glycol for a prescribed period of time, on the basis of the water absorbency test method specified in JIS P8140, with a contact time being 2 minutes. Here, the contact time was set to two minutes.

<Lamina Inorganic Compound>

Desirably, the first layer 212 also contains a lamina inorganic compound. The lamina inorganic compound is desirably a swellable inorganic lamina compound, and possible examples of such a compound include: swellable clay minerals, such as bentonite, hectorite, saponite, beedelite, nontronite, stevensite, beidellite, montmorillonite, or the like, swellable synthetic mica, swellable synthetic smectite, or the like. These swellable lamina inorganic compounds have a lamina structure constituted of individual crystal lattice layers having a thickness of 1 nm to 1.5 nm; the substitution of metal atoms in the lattice is markedly higher than in the other clay minerals. Consequently, a shortage of positive charge occurs in the lattice layers and in order to compensate for this, cations, such as $Na^+$, $Ca^{2+}$, $Mg^{2+}$, and the like are adsorbed between the layers. The cations present between the layers are called "exchangeable cations", and are exchanged with various cations. If the cation between layers is $Li^+$, $Na^+$, or the like, in particular, then since the ion has a small radius, the bond between the lamina crystal lattices becomes weak and hence large swelling occurs with water. If a shearing force is applied in this state, the bond is cleaved easily to form a sol which is stable in water. This tendency is stronger in bentonite and swellable synthetic mica, and hence these materials are preferable in view of the objects of the present invention. Water-swellable synthetic mica is particularly desirable.

Possible examples of the water-swellable synthetic mica include: Na tetrasic mica $NaMg_{2.5}(Si_4O_{10})F_2Na$, Li teniorite $(NaLi)Mg_2(Si_4O_{10})F_2Na$, or Li hectorite $(NaLi)/3Mg_2/3Li_{1/3}(Si_4O_{10})F_2$, or the like.

The size of the water-swellable synthetic mica used desirably in the present invention is: thickness of 1 nm to 5 nm, and plane size of 1 μm to 20 μm. In order to control diffusion, the smaller the thickness, the better, and the greater the plane size, the better, within a range that does not impair the smoothness or transparency of the coated surface. Therefore, the aspect ratio is 100 or above, desirably 200 or above, and especially desirably, 500 or above.

<Mass Ratio>

The mass ratio X/Y between the mass X of the acetoacetyl-modified polyvinyl alcohol and the mass Y of the water-swellable synthetic mica contained in the first layer 212 is desirably in the range of 1 to 30 both inclusive and more desirably in the range of 5 to 15 both inclusive. If the mass ratio is in the range of 1 to 30 both inclusive, then a large effect in suppressing the permeation of oxygen and preventing the occurrence of blistering is obtained.

<Film Hardening Agent>

The film hardening agent contained in the first layer 212 according to the present invention is at least one material chosen from: an aldehyde compound, 2,3-dihydroxy-1,4-dioxane and derivatives of same, and a compound containing, in a single molecule, two or more vinyl groups that are adjacent to substituents having a positive Hammett substituent constant σp. By adding, as a film hardening agent, to the first layer 212 according to the present invention, at least one material chosen from an aldehyde compound, 2,3-dihydroxy-1,4-dioxane and derivatives of same, and a compound containing, in a single molecule, two or more vinyl groups that are adjacent to substituents having a positive Hammett substituent constant σp, it is possible to react the hardening agent with the acetoacetyl-modified polyvinyl alcohol and to improve the water resistance of the recording material without increasing the viscosity of the first layer coating liquid. As a result of this, a recording material having improved water resistance and improved coating stability of the first layer coating liquid is obtained.

Possible examples of substituents having a positive Hammett substituent constant σp are: a $CF_3$ group (σp value: 0.54), a CN group (σp value: 0.66), a $COCH_3$ group (σp value: 0.50), a COOH group (σp value: 0.45), a COOR group (where R represents an alkyl group) (σp value: 0.45), a $NO_2$ group (σp value: 0.78), an $OCOCH_3$ group (σp value: 0.31), an SH group (σp value: 0.15), an $SOCH_3$ group (σp value: 0.49), an $SO_2CH_3$ group (σp value: 0.72), an $SO_2NH_2$ group (σp value: 0.57), an $SCOCH_3$ group (σp value: 0.44), an F group (σp value: 0.06), a Cl group (σp value: 0.23), a Br group (σp value: 0.23), an I group (σp value: 0.18), an $IO_2$ group (σp value: 0.76), an $N^+(CH_3)_2$ group (σp value: 0.82), an $S^+(CH_3)_2$ group (σp value: 0.90), and the like.

Examples of a compound containing, in a single molecule, two or more vinyl groups that are adjacent to substituents having a positive Hammett substituent constant σp include: 2-ethylene sulfonyl-N-[2-(2-ethylene sulfonyl-acetylamino)-ethyl]acetamide, bis-2-vinylsulfonyl ethyl ether, bisacryloylimide, N-N'-diacryloyl urea, 1,1-bisvinyl sulfone ethane, ethylene-bis-acrylamide, and furthermore: diacrylate and dimethacrylate compounds represented by the following chemical formulae:

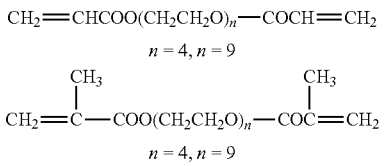

Of these, 2-ethylene sulfonyl-N-[2-(2-ethylene sulfonyl-acetylamino)-ethyl]acetamide is especially desirable.

The content in the first layer 212 of the compound containing, in a single molecule, two or more vinyl groups that are adjacent to substituents having a positive Hammett substituent constant σp is desirably not less than 0.1 wt % and not more than 30 wt %, and more desirably not less than 0.5 wt % and not more than 10 wt %, with respect to the acetoacetyl-modified polyvinyl alcohol. If the content of this compound in the first layer is not less than 0.5 wt % and not more than 10 wt % with respect to the acetoacetyl-modified polyvinyl alcohol, then the beneficial effects of the compound according to the present invention can be displayed further, in terms of being able to improve the water resistance of the recording material without causing an increase in the viscosity of the first layer coating liquid.

<White Pigment>

Possible examples of the white pigment are: titanium oxide, barium sulfate, barium carbonate, calcium carbonate, lithopone, alumina white, zinc oxide, silica, antimony trioxide, titanium phosphate, aluminum hydroxide, kaolin, clay, talc, magnesium oxide, magnesium hydroxide, and the like. These can be used individually or in a combination of two or more types. Of these pigments, kaolin is especially desirable.

<Kaolin>

Desirably, the kaolin has an aspect ratio (diameter/thickness ratio) of 30 or above. Examples of kaolin having an aspect ratio of 30 or above are: engineered grade kaolin (such as Contour 1500 (aspect ratio 59) or Astra-Plate (aspect ratio 34)). Furthermore, if the kaolin has high whiteness and a steep particle size distribution (uniform particle size), then it imparts excellent whiteness and printing compatibility to coated papers of various types.

With regard to the particle size of the white pigment, desirably, the ratio of particles of size 2 μm or smaller is 75% or above, and furthermore, desirably, the average particle size is 0.1 μm to 0.5 μm. By setting the particle size to the aforementioned range in particular, it is possible to avoid effectively any decline in the whiteness or decline in glossiness.

The titanium oxide may be rutile type or anatase type, and these may be used independently or in combination. Furthermore, the titanium oxide may be manufactured by a sulfuric acid method or by a chlorine method. The titanium oxide may be chosen appropriately from titanium oxides which are surface coated with an inorganic material, by means of a hydrous alumina treatment, a hydrous silicon dioxide treatment or a hydrous zinc oxide treatment; titanium oxides which are surface coated with an organic material such as trimethylol methane, trimethylol ethane, trimethylol propane, or 2,4-dihydroxy-2-methyl pentane; or titanium oxides which have undergone a siloxane treatment using polydimethyl siloxane, or the like.

Desirably, the refractive index of the white pigment is 1.5 or above. If a white pigment having a refractive index in this range is included, then it is possible to form an image of high quality.

Furthermore, desirably, the specific surface area of the white pigment based on a BET method is less than 100 $m^2/g$, and if a white pigment having a specific surface area in this range is included, then it is possible to prevent the coating liquid forming the second layer from infiltrating into the first layer when the second layer is applied and formed and therefore the ink absorbency of the second layer can be raised.

The BET method is one method of measuring the surface area of powder by a gas phase adsorption technique and determines the total surface area of 1 g of a sample, in other words, the specific surface area, from the adsorption isotherm. Normally, nitrogen gas is used as the adsorption gas, and the adsorption amount is measured from the change in the pressure or volume of the adsorbed gas. The Brunauer, Emmett, Teller equation (BET equation) is a well-known method of representing a multimolecular adsorption isotherm; using this equation, the amount of adsorption is determined and the surface area is obtained by multiplying this amount by the surface area occupied by the surface of one adsorbed molecule.

In a case where the composition is formed in a lamina shape, the content of the white pigment in the first layer varies depending on the type of white pigment, the type of the thermoplastic resin, the layer thickness, and the like, but normally, it is desirable that the content of white pigment should be approximately 50 parts by weight to 200 parts by weight with respect to 100 parts by weight of the thermoplastic resin.

It is also possible to add a commonly known additive, such as an antioxidant, to the first layer.

The film thickness when the first layer is formed using the composition described above is desirably in the range of 1 μm to 30 μm, and more desirably, in the range of 5 μm to 20 μm. By setting the film thickness to the aforementioned range in particular, it is possible to obtain good glossiness of the surface after a subsequent calendering process, and good whiteness with a small amount of white pigment, at the same time as achieving handling properties, such as bendability, on a par with those of coated paper and art paper. Furthermore, since the first layer contains a white pigment, beneficial effects are obtained in that it is possible to prevent sticking to the calender when carrying out a calendering process after applying the first layer.

<Second Layer>

There are no particular restrictions on the second layer 213 provided that it contains white pigment and that the water absorption amount according to Bristow's method with a contact time of 0.5 seconds is not lower than 2 $ml/m^2$ and not higher than 8 $ml/m^2$, and it is possible to chose a commonly known material appropriately in accordance with the objectives, but desirably, the following conditions are satisfied. More specifically, the second layer: has a water absorption amount of not lower than 1 $ml/m^2$ and not higher than 6 $ml/m^2$ as determined by Bristow's method using pure water containing 30 wt % of diethylene glycol with a contact time of 0.9 seconds; also contains a binder (thermoplastic resin); contains 10 parts by solid weight to 60 parts by solid weight of thermoplastic resin with respect to 100 parts by solid weight of the white pigment solid content; and has a pH of 4 or lower at the film surface, and the like.

<White Pigment>

There are no particular restrictions on the white pigment, and it is possible for example to chose one of the following white pigments which are commonly used in coated papers for printing: calcium carbonate, kaolin, titanium dioxide, aluminum trihydroxide, zinc oxide, barium sulfate, satin white and talc. If the second layer contains a white pigment, then a beneficial effect is obtained in that the pigment in the ink can be retained in the second layer.

Desirably, the white pigment is constituted of only a white pigment having a pH of lower than 8.0 (and preferably, 7.5 or below) based on the pH test method specified in JIS K5101 (normal temperature extraction method). If the pH exceeds 8.0, then the surface pH of the second layer becomes greater and since the coloring material generally contained in ink has anionic charge (anionic dissociable group), then relatively stable dissolution and dispersion of the coloring material is obtained and aggregation of the coloring material becomes less liable to occur, thus leading to a decline in image quality as a result of image bleeding and deformation of ink droplets after landing.

Moreover, desirably, the white pigment has a pH of lower than 6.0 (preferably, 5.0 or lower and more preferably, 4.0 or lower) after adding 0.1 ml of 1 mol/l hydrochloric acid to 10 g of measurement liquid based on the pH test method (normal temperature extraction method) as specified in JIS K5101. If the pH is 6.0 or above, the surface pH of the second layer becomes higher, which may lead to image bleeding and decline in image quality. Furthermore, when the second layer is adjusted to a low pH by using acid, or the like, in order to promote aggregation of the coloring material, then the beneficial effects of adjusting the pH are reduced since the white pigment is neutralized and the surface pH becomes higher, and this may lead to image bleeding and decline in the image quality.

Possible examples of pigments of this kind are: kaolin, titanium oxide, a mixture of kaolin and titanium oxide, and the like.

The content of the white pigment in the second layer is desirably 50 wt % to 98 wt % and more desirably 70 wt % to 97 wt %.

<Bristow's Method>

Bristow's method is the most common method of measuring the liquid absorption amount in a short time, and it is also employed by the Japan Technical Association of the Paper and Pulp Industry (J.TAPPI). The details of this test method are described in J.TAPPI No. 51 "Test Method for Liquid Absorption of Paper and Board". During measurement, the slit width of the head box of a Bristow tester is adjusted in accordance with the surface tension of the ink. Furthermore, the escape of ink to the rear side of the paper is excluded from the calculation.

<Binder (Thermoplastic Resin)>

There are no particular restrictions on the binder (thermoplastic resin), and it is possible to use the same binder as that used in the first layer 212. The content of binder in the second layer 213 is desirably 2 parts by weight to 50 parts by weight, and more desirably, 3 parts by weight to 30 parts by weight with respect to 100 parts by weight of the white pigment.

<Layer Surface pH>

By adjusting the layer surface pH of the second layer 213 to an acidic pH, it is possible to cause the ink to aggregate and thereby improve the fixing of the ink.

The layer surface pH of the second layer 213 must be 5.5 or lower and more desirably, 4.5 or lower, after pH adjustment, in order to prevent landing interference.

Here, the surface pH is measured by using method A (application method) in the film surface pH measurement stipulated by the Japan Technical Association of the Paper and Pulp Industry (J.TAPPI); for example, it is possible to use the "Type MPC" paper surface pH measurement set manufactured by Kyoritsu Chemical-Check Lab., which corresponds to method A described above.

Desirably, the pH is adjusted by addition to the coating liquid on the surface of the second layer 213, but depending on the circumstances, it is also possible to deposit an acid onto the surface of the recording medium. More specifically, the pH is adjusted by depositing a treatment liquid containing an acidic material. The acidic material may be a phosphoric acid group, phosphonic acid group, phosphinic acid group, sulfuric acid group, sulfonic acid group, sulfinic acid group or carboxylic acid group or salts thereof, and a phosphoric acid group, a sulfonic acid group and a carboxylic acid group are most desirable. Possible examples of the phosphoric acid are: phosphoric acid, polyphosphoric acid, metaphosphoric acid, or derivatives or salts of these. Possible examples of the sulfuric acid are methane sulfonic acid, polysulfonic acid, or derivatives or salts of these. Possible examples of the carboxylic acid are oxalic acid, tartaric acid, malic acid, malonic acid, citric acid, fumaric acid, maleic acid, succinic acid, salicylic acid, phthalic acid, lactic acid, acetic acid, trichioroacetic acid, chloroacetic acid, polyacrylic acid or derivatives or salts of these, or a compound having a furan structure, pyrrole structure, pyrroline structure, pyrrolidone structure, pyrone structure, thiophene structure, indole structure, pyridine structure and quinoline structure and also containing a carboxyl group as a functional group, or the like, such as pyrrolidone carboxylic acid, pyrone carboxylic acid, pyrrole carboxylic acid, furan carboxylic acid, pyridine carboxylic acid, coumaric acid, thiophene carboxylic acid, nicotinic acid or derivatives or salts of these. Moreover, it is also possible to use an acid, such as hydrochloric acid, sulfuric acid, nitric acid, or the like.

<Other Layers>

There are no particular restrictions on the other layers, and it is possible to select these appropriately in accordance with the objectives.

Method of Manufacturing Recording Medium

The method of manufacturing the recording medium 22 according to the present invention includes a first forming step and a second forming step, and also includes other steps which are chosen appropriately in accordance with the requirements.

<First Forming Step>

In the first forming step, a first layer 212 is formed on the base paper 211, and this first forming step is not subjected to particular restrictions, apart from the fact that thermoplastic polymer micro-particles provided on the surface of the base paper 211 are heated treated in a temperature range at or above the minimum film forming temperature of the thermoplastic polymer micro-particles, and hence this step may be chosen appropriately in accordance with the objectives. Pressure may be applied in the heating treatment.

There are no particular restrictions on the thermoplastic resin micro-particles, which include all thermoplastic resin particles that are commonly known. Examples of such commonly known thermoplastic resins include: generic thermoplastic polymers such as a polyolefin, like polyethylene, polypropylene or polyvinyl chloride; a polyamide or polyimide; and a polyester such as polyethylene terephthalate; or a monopolymer including: an α-methylene aliphatic monocarboxylate, such as methyl(meth)acrylate, ethyl(meth)acrylate, butyl(meth)acrylate, dodecyl(meth)acrylate, octyl(meth) acrylate or phenyl(meth)acrylate; a styrene, such as styrene, chlorostyrene or vinyl styrene; a vinyl ester, such as vinyl acetate, vinyl propionate, vinyl benzoate or vinyl butylate; a vinyl ether, such as methyl vinyl ether, ethyl vinyl ether or butyl vinyl ether; or a vinyl ketone, such as vinyl methyl ketone, vinyl hexyl ketone or vinyl isopropenyl ketone; or a desired copolymer containing any one of these compositional units.

Furthermore, it is also possible to use thermoplastic resin particles of one type independently, or to use a combination of two or more types of same.

Desirably, the thermoplastic resin particles have an average particle size of 10 nm to 200 nm. Here, the average particle size of the resin particles uses the value measured by a dynamic light scattering method (with a device: Otsuka Electronics ELS-800). Furthermore, desirably, the thermoplastic resin constituting the polymer micro-particles has a minimum film forming temperature (MFT) of 5° C. to 60° C.

Moreover, desirably, the coating amount of the thermoplastic resin is 1 g/m$^2$ to 30 g/m$^2$.

From the viewpoint of suppressing cockling, improving bleeding over time and achieving good manufacturability, and other factors, it is desirable that the thermoplastic resin particles should contain dispersed particles of water-dispersible latex.

The water-dispersible latex is obtained by dispersing a hydrophobic polymer that is insoluble or very poorly soluble in water, in the form of very fine particles, in an aqueous-phase dispersion medium. The dispersed state may be any of the following states: a state in which a polymer is emulsified or emulsion polymerized or micellar dispersed in a dispersion medium, or a state in which the polymer molecule has a hydrophilic structure in part, and the molecule chains themselves are molecularly dispersed, and so on. Polymer latex of this kind is described in detail in "Synthetic Resin Emulsions," Taira Okada & Hiroshi Inagaki, eds., (published by Kobunshi Kankokai, 1978); "Synthetic latex applications," Takaaki Sugimura, Yasuo Kataoka, Soichi Suzuki & Keiji Kasahara, eds., (published by Kobunshi Kankokai, 1993); and "The Chemistry of synthetic latexes," Soichiro Muroi, (published by Kobunshi Kankokai, 1970), and so on.

More specifically, it is desirable that the water-dispersible latex should be at least one latex selected from: acrylic latexes, acrylic silicone latexes, acrylic epoxy latexes, acrylic styrene latexes, acrylic urethane latexes, styrene-butadiene latexes, acrylonitrile-butadiene latexes, and vinyl acetate latexes.

The molecular weight of the water-dispersible latex is desirably 3,000 to 100,000 by number-average molecular weight, and particularly desirably, about 5,000 to 100,000. If the molecular weight is too low, then the dynamic strength of the undercoating layer may be insufficient, and if it is too high, then this is disadvantageous in terms of manufacturability, such as dispersion stability and viscosity.

Of the aforementioned water-dispersible latexes, from the viewpoint of being able to achieve both economy and manufacturability, while raising the effects of suppressing permeability of the ink solvent and cockling, in the first layer according to the present invention, it is most desirable to use at least one latex selected from acrylic silicone latexes and acrylic styrene latexes.

<Second Forming Step>

There are no particular restrictions on the second forming step, apart from the fact that a second layer 213 is formed on the first layer 212, and the second forming step can be selected appropriately in accordance with the objectives. However, desirably, the coating liquid used to form the second layer 213 has a high-shear viscosity not lower than 20 mPa·s and not higher than 150 mPa·s when the shearing speed D which is specified by the coating speed S (m/min) and the thickness t of the applied layer (μm) ($D=S/(t\times60\times10^{-6})$) in the range of not lower than $10^3$ ($s^{-1}$) and not higher than $10^2$ ($s^{-1}$), and the coating liquid for forming the second layer 213 is applied by a blade application method.

<High-Shear Viscosity>

The high-shear viscosity of the coating liquid for the second layer is desirably in the range from 30 mPa·s to 150 mPa·s, and more desirably, from 40 mPa·s to 140 mPa·s.

If it is less than 20 mPa·s, then since the second layer coating liquid does not infiltrate into the first layer 211, in contrast to direct coating onto the base paper 211, then the coating amount cannot be increased with the blade application method, whereas if it is greater than 150 mPa·s, then the fluidity of the second layer coating liquid is impaired, which is disadvantageous in terms of handling.

<Blade Application Method>

A blade application method is an application method in which a relatively large shearing force is produced at the instant of scraping a coating material that has been applied onto a paper support.

<Other Steps>

There are no particular restrictions on the other steps, and it is possible to select these appropriately in accordance with the objectives.

Aqueous Ink

The aqueous ink used in the image forming method according to the present invention will be described below in greater detail.

The aqueous ink in accordance with the present invention is configured as a special ink including at least a resin dispersant (A), a pigment (B) that is dispersed by the resin dispersant (A), self-dispersible polymer microparticles (C), and an aqueous liquid medium (D).

<Resin Dispersant (A)>

The resin dispersant (A) is used as a dispersant for the pigment (B) in the aqueous liquid medium (D) and may be any appropriate resin, provided that it can disperse the pigment (B). The preferred structure of the resin dispersant (A) includes a hydrophobic structural unit (a) and a hydrophilic structural unit (b). If necessary, the resin dispersant (A) can also include a structural unit (c) that is different from the hydrophobic structural unit (a) and hydrophilic structural unit (b).

As for the compounding ratio of the hydrophobic structural unit (a) and hydrophilic structural unit (b), it is preferred that the hydrophobic structural unit (a) takes more than 80 wt %, preferably 85 wt % or more of the total weight of the resin dispersant (A). Thus, the compounding ratio of the hydrophilic structural unit (b) has to be not more than 15 wt %. Where the compounding ratio of the hydrophilic structural unit (b) is more than 15 wt %, the amount of component that is independently dissolved in the aqueous liquid medium (D), without participating in the dispersion of the pigment, increases, thereby causing degradation of performance such as dispersivity of the pigment (B) and worsening the ejection ability of ink for inkjet recording.

<Hydrophobic Structural Unit (a)>

The hydrophobic structural unit (a) of the resin dispersant (A) in accordance with the present invention includes at least a hydrophobic structural unit (a1) having an aromatic ring that is not directly coupled to an atom forming the main chain of the resin dispersant (A).

The expression "that is not directly coupled to" as used herein means a structure in which an aromatic ring and an atom forming the main chain structure of the resin are coupled via a linking group. With such a configuration, an adequate distance is maintained between the hydrophilic structural unit in the resin dispersant (A) and the hydrophobic aromatic ring. Therefore, interaction easily occurs between the resin dispersant (A) and pigment (B), strong adsorption is induced, and therefore dispersivity is increased.

<Hydrophobic Structural Unit (a1) Having Aromatic Ring>

From the standpoint of pigment dispersion stability, ejection stability, and cleaning ability, it is preferred that the hydrophobic structural unit (a1) having an aromatic ring that is not directly coupled to an atom forming the main chain of the resin dispersant (A) have a content ratio not less than 40 wt % and less than 75 wt %, more preferably not less than 40 wt % and less than 70 wt %, and even more preferably not less than 40 wt % and less than 60 wt % based on the total weight of the resin dispersant (A).

From the standpoint of improving the pigment dispersion stability, ejection stability, cleaning ability, and abrasion resistance, it is preferred that the aromatic ring that is not directly coupled to an atom forming the main chain of the resin dispersant (A) be contained in the resin dispersant (A) at a ratio not less than 15 wt % and not more than 27 wt %, more preferably not less than 15 wt % and not more than 25 wt %, and even more preferably not less than 15 wt % and not more than 20 wt %.

Within the above-described ranges, the pigment dispersion stability, ejection stability, cleaning ability, and abrasion resistance can be improved.

In accordance with the present invention, the hydrophobic structural unit (a1) having an aromatic ring in the hydrophobic structural unit (a) is preferably introduced in the resin dispersant (A) in the structure represented by a General Formula (1) below.

(1)

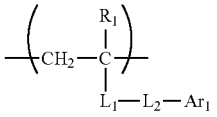

In the General Formula (1), R1 represents a hydrogen atom, a methyl group, or a halogen atom; L1 represents (main chain side) —COO—, —OCO—, —CONR2-, —O—, or substituted or unsubstituted phenylene group; and R2 represents a hydrogen atom and an alkyl group having 1 to 10 carbon atoms. L2 represents a single bond or a divalent linking group having 1 to 30 carbon atom; when it is a divalent linking group, the linking group preferably has 1 to 25 carbon atoms, more preferably 1 to 20 carbon atoms. Examples of suitable substituents include a halogen atom, an alkyl group, an alkoxy group, a hydroxyl group, and a cyano group, but this list is not limiting. Ar1 represents a monovalent group derived from an aromatic ring.

In the General Formula (1) the following combination of structural units is preferred: R1 is a hydrogen atom or a methyl group, L1 is (main chain side) —COO—, and L2 is a divalent linking group having 1 to 25 carbon atoms and including an alkyleneoxy group and/or alkylene group. In the even more preferred combination, R1 is a hydrogen atom or a methyl group, L1 is (main chain side) —COO—, and L2 is (main chain side) —$(CH_2\text{-}CH_2\text{-}O)_n$— (n represents the average number of structural repeating units; n=1 to 6).

The aromatic ring in the Ar1 contained in the hydrophobic structural unit (a1) is not particularly limited, and examples of suitable aromatic rings include a benzene ring, a condensed aromatic ring having 8 or more carbon atoms, a hetero ring containing condensed aromatic rings, or two or more linked benzene rings.

The condensed aromatic ring having 8 or more carbon atoms as referred to herein is an aromatic compound having 8 or more carbon atoms that is composed of an aromatic ring having at least two or more condensed benzene rings, and/or at least one or more aromatic rings and an alicyclic hydrocarbon condensed to the aromatic ring. Specific examples thereof include naphthalene, anthracene, fluorene, phenanthrene, and acenaphthene.

The hetero ring in which aromatic rings are condensed are compounds in which an aromatic compound having no heteroatoms (preferably a benzene ring) and a cyclic compound having a heteroatom are condensed. The cyclic compound having a heteroatom is preferably a five-membered ring or a six-membered ring. The preferred examples of the heteroatom are a nitrogen atom, an oxygen atom, and a sulfur atom. The cyclic compound having a heteroatom may have a plurality of heteroatoms. In this case, the heteroatoms may be identical or different. Specific examples of the hetero ring in which aromatic rings are condensed include phthalimide, acridone, carbazole, benzoxazole, and benzothiazole.

Specific examples of monomers that can form the hydrophobic structural unit (a1) including a benzene ring, a condensed aromatic ring having 8 or more carbon atoms, a hetero ring in which aromatic rings are condensed, or a monovalent group derived from two or more benzene rings connected to each other are presented below, but the present invention is not limited to the below-described specific examples.

M-1

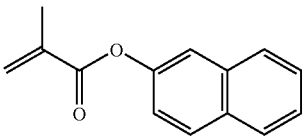

M-2

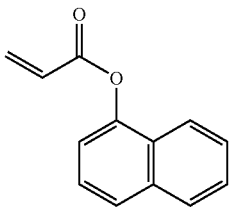

-continued
M-3
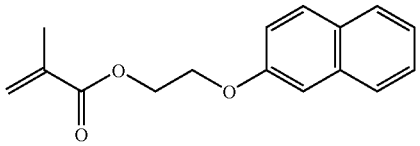
M-4
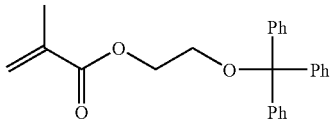
M-5
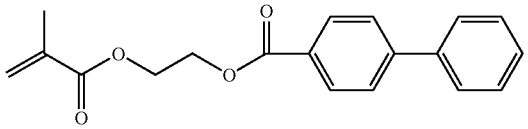
M-6
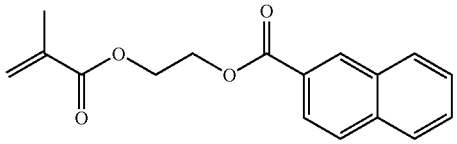
M-7
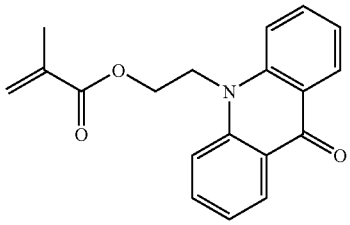
M-8
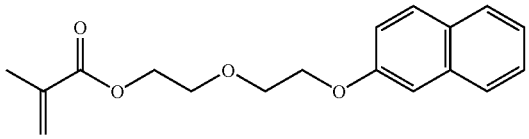
M-9
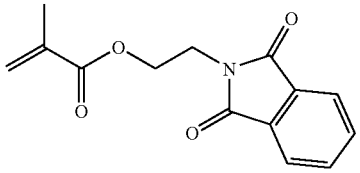
M-10
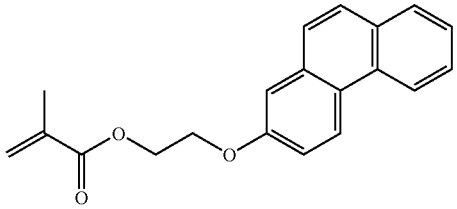
M-11
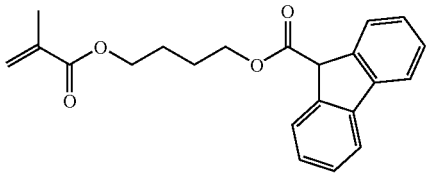
M-12
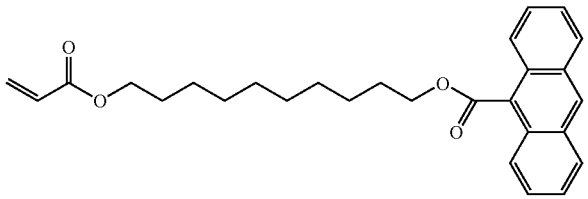
M-13
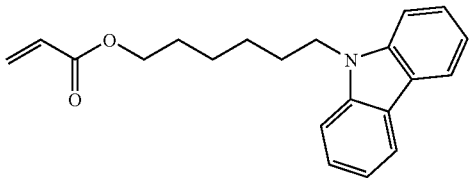
M-14
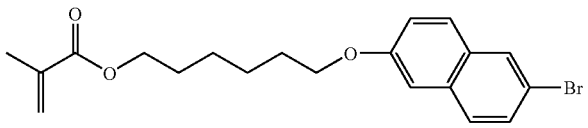
M-15
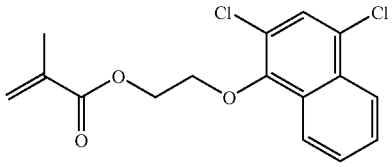
M-16
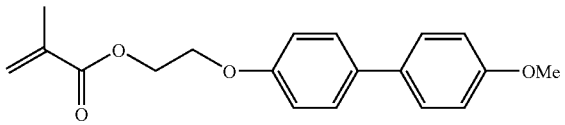
M-17
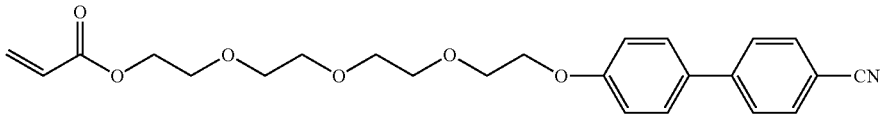

-continued

M-18

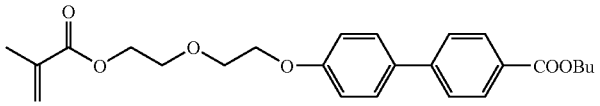

M-19

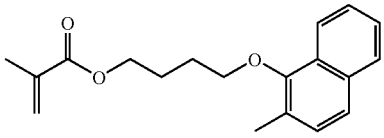

M-20

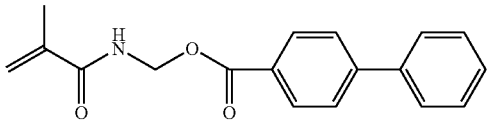

M-21

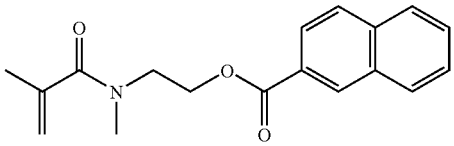

M-22

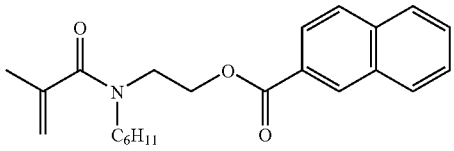

M-23

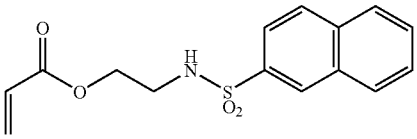

M-24

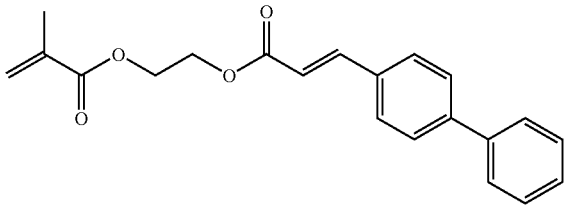

M-25

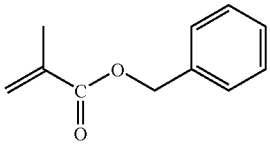

M-26

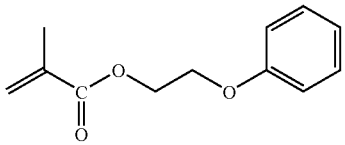

M-27

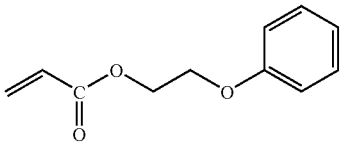

In accordance with the present invention, from the standpoint of dispersion stability, among the hydrophobic structural units (a1) having an aromatic ring that is directly coupled to an atom that forms the main chain of the resin dispersant (A), the preferred structural units are derived from at least any one from among benzyl methacrylate, phenoxyethyl acrylate, and phenoxyethyl methacrylate.

<Hydrophobic Structural Unit (a2) Derived from an Alkyl Ester Having 1 to 4 Carbon Atoms of Acrylic Acid or Methacrylic Acid>

The hydrophobic structural unit (a2) derived from an alkyl ester having 1 to 4 carbon atoms of acrylic acid or methacrylic acid that is contained in the resin dispersant (A) has to be contained in the resin dispersant (A) at a content ratio at least not less than 15 wt %, preferably not less than 20 wt % and not more than 60 wt %, and more preferably not less than 20 wt % and not more than 50 wt %.

Specific examples of the (meth)acrylates include methyl (meth)acrylate, ethyl (meth)acrylate, (iso)propyl (meth)acrylate, and (iso or tertiary) butyl (meth)acrylate.

The number of carbon atoms in the alkyl group is preferably 1 to 4, more preferably 1 to 2.

<Hydrophilic Structural Unit (b)>

The hydrophilic structural unit (b) constituting the resin dispersant (A) in accordance with the present invention will be described below.

The hydrophilic structural unit (b) is contained at a ratio of more than 0 wt % and not more than 15 wt %, preferably not less than 2 wt % and not more than 15 wt %, more preferably not less than 5 wt % and not more than 15 wt %, and even more preferably not less than 8 wt % and not more than 12 wt %.

The resin dispersant (A) includes at least acrylic acid and/or methacrylic acid (b1) as the hydrophilic structural unit (b).

<Hydrophilic Structural Unit (b1)>

The content of the hydrophilic structural unit (b1) has to change depending on the amount of the below-described structural unit (b2) or the amount of the hydrophobic structural unit (a), or both these amounts.

Thus, the resin dispersant (A) in accordance with the present invention may contain the hydrophobic structural unit (a) at a content ratio higher than 80 wt % and the hydrophilic structural unit (b) at a content ratio not more than 15 wt % and is determined by the hydrophobic structural units (a1) and (a2), hydrophilic structural units (b1) and (b2), and structural unit (c).

For example, when the resin dispersant (A) is configured only by the hydrophobic structural units (a1) and (a2), hydrophilic structural unit (b1), and structural unit (b2), the content ratio of the acrylic acid and methacrylic acid (b1) can be found by (100−(wt % of hydrophobic structural units (a1) and (a2))−(wt % of structural unit (b2))). In this case, the sum total of the (b1) and (b2) has to be not more than 15 wt %.

When the resin dispersant (A) is configured by the hydrophobic structural units (a1) and (a2), hydrophilic structural unit (b1), and structural unit (c), the content ratio of the hydrophilic structural unit (b1) can be found by "100−(wt % of hydrophobic structural units (a1) and (a2))−(wt % of structural unit (c))".

The resin dispersant (A) can be also configured only by the hydrophobic structural unit (a1), hydrophobic structural unit (a2), and hydrophilic structural unit (b1).

The hydrophilic structural unit (b1) can be obtained by polymerization of acrylic acid and/or methacrylic acid.

The acrylic acid and methacrylic acid can be used individually or in a mixture.

From the standpoint of pigment dispersibility and stability in storage, the acid value of the resin dispersant (A) in accordance with the present invention is preferably not lower than 30 mg KOH/g and not higher than 100 mg KOH/g, more preferably not lower than 30 mg KOH/g and lower than 85 mg KOH/g, and even more preferably not lower than 50 mg KOH/g and lower than 85 mg KOH/g.

The acid value as referred to herein is defined as a weight (mg) of KOH required to neutralize completely 1 g of the resin dispersant (A) and can be measured by a method described in a JIS standard (JIS K0070, 1992).

<Structural Unit (b2)>

The structural unit (b2) preferably has a nonionic aliphatic group. The structural unit (b2) can be formed by polymerizing a monomer corresponding thereto, and an aliphatic functional group may be introduced into the polymer chain after the polymerization of the polymer.

The monomer forming the structural unit (b2) is not particularly limited provided that it has a functional group that can form the polymer and a nonionic hydrophilic functional group. Well known suitable monomers can be used, but from the standpoint of availability, handleability, and utility, vinyl monomers are preferred.

Examples of vinyl monomers include (meth)acrylates, (meth)acrylamides, and vinyl esters having hydrophilic functional groups having a hydrophilic functional group.

Examples of the hydrophilic functional group include a hydroxyl group, an amino group, an amido group (with unsubstituted nitrogen atom), and the below-described alkylene oxide polymers such as polyethylene oxide and polypropylene oxide.

Among them hydroxyethyl (meth)acrylate, hydroxybutyl (meth)acrylate, (meth)acrylamide, aminoethyl acrylate, aminopropyl acrylate, and (meth)acrylates including alkylene oxide polymers are especially preferred.

The structural unit (b2) preferably includes a hydrophilic structural unit having an alkylene oxide polymer structure.

From the standpoint of hydrophility, it is preferred that the alkylene in the alkylene oxide polymer have 1 to 6 carbon atoms, more preferably 2 to 6 carbon atoms, and even more preferably 2 to 4 carbon atoms.

The degree of polymerization of the alkylene oxide polymer is preferably 1 to 120, more preferably 1 to 60, and even more preferably 1 to 30.

It is also preferred that the structural unit (b2) be a hydrophilic structural unit having a hydroxyl group.

The number of hydroxyl groups in the structural unit (b2) is not particularly limited. From the standpoint of hydrophility of the resin (A) and mutual solubility of the solvent or other monomers during the polymerization, it is preferred that this number be 1 to 4, more preferably 1 to 3, even more preferably 1 to 2.

<Structural Unit (c)>

As described above, the resin dispersant (A) in accordance with the present invention can also include a structural unit (c) having a structure different from that of the hydrophobic structural unit (a1), hydrophobic structural unit (a2), and hydrophilic structural unit (b) (this structural unit will be referred to hereinbelow simply as "structural unit (c)".

The structural unit (c) different from the hydrophobic structural unit (a1), hydrophobic structural unit (a2), and hydrophilic structural unit (b), as referred to herein, is a structural unit (c) having a structure different from that of the (a1), (a2), and (b), and it is preferred that the structural unit (c) be a hydrophobic structural unit.

The structural unit (c) can be a hydrophobic structural unit, but it has to be a structural unit having a structure different from that of the hydrophobic structural unit (a1) and hydrophobic structural unit (a2).

The content ratio of the structural unit (c) is preferably not more than 35 wt %, more preferably not more than 20 wt %, and even more preferably not more than 15 wt % based on the entire weight of the resin dispersant (A).

The structural unit (c) can be formed by polymerizing a monomer corresponding thereto. A hydrophobic functional group may be introduced into the polymer chain after the polymerization.

The monomer suitable in the case where the structural unit (c) is a hydrophobic structural unit is not particularly limited, provided that it has a functional group that can form a polymer and a hydrophobic functional group, and well known suitable monomers can be used.

From the standpoint of availability, handleability, and utility, vinyl monomers ((meth)acrylamides, styrenes, and vinyl esters) are preferred as the monomers that can form the hydrophobic structural unit.

Examples of (meth)acrylamides include N-cyclohexyl (meth)acrylamide, N-(2-methoxyethyl) (meth)acrylamide, N,N,-diallyl (meth)acrylamide, and N-allyl (meth)acrylamide.

Examples of styrenes include styrene, methyl styrene, dimethyl styrene, trimethyl styrene, ethyl styrene, isopropyl styrene, n-butyl styrene, tert-butyl styrene, methoxystyrene, butoxystyrene, acetoxystyrene, chlorostyrene, dichlorostyrene, bromostyrene, chloromethyl styrene, hydroxystyrene protected by a group (for example, t-Boc) that can be deprotected by an acidic substance, methylvinyl benzoate, and α-methyl styrene, and vinyl naphthalene. Among them, styrene and α-methyl styrene are preferred.

Examples of vinyl esters include vinyl acetate, vinyl chloroacetate, vinyl propionate, vinyl butyrate, vinyl methoxyacetate, and vinyl benzoate. Among them, vinyl acetate is preferred.

The aforementioned compounds can be used individually or in mixtures of two or more thereof.

The resin dispersant (A) in accordance with the present invention may be a random copolymer into which the structural units are introduced irregularly, or a block copolymer into which the structural units are introduced regularly. When resin dispersant is a block copolymer, the synthesis may be performed by introducing the structural units in any order and the same structural component may be used two or more times. From the standpoint of utility and productivity, it is preferred that the resin dispersant be a random copolymer.

Further, the molecular weight range of the resin dispersant (A) in accordance with the present invention is preferably 30,000 to 150,000, more preferably 30,000 to 100,000, and even more preferably 30,000 to 80,000 as represented by a weight-average molecular weight (Mw).

Setting the molecular weight within the aforementioned ranges is preferred because the steric repulsion effect of the dispersant tends to be good and the time for adsorption to a pigment tends to be eliminated by the steric effect.

The molecular weight distribution (represented by the ratio of the weight-average molecular weight to the number-average molecular weight) of the resin used in accordance with the present invention is preferably 1 to 6, more preferably 1 to 4.

Setting the molecular weight distribution within the aforementioned ranges is preferred from the standpoint of ink dispersion stability and ejection stability. The number-average molecular weight and weight-average molecular weight are a molecular weight detected with a differential refractometer by using THF as a solvent in a GPC analyzer employing TSKgel, GMxL, TSKgel, G4000HxL, TSKgel, G2000HxL (all are trade names of products manufactured by Tosoh Co.) and represented by recalculation using polystyrene as a standard substance.

The resin dispersion (A) used in accordance with the present invention can be synthesized by a variety of polymerization methods, for example, by solution polymerization, precipitation polymerization, suspension polymerization, lump polymerization, and emulsion polymerization. The polymerization reaction can be carried out by conventional operations, for example, in a batch mode, a semi-continuous mode, or a continuous mode.

A method using a radical initiator and a method using irradiation with light or radiation are known as polymerization initiation methods. These polymerization methods and polymerization initiation methods are described in Teiji Tsuruda "Kobunshi Gosei Hoho", Kaiteiban (Nikkan Kogyo Shinbunsha Kan, 1971) and Takayuki Otsu, Masaetsu Kinoshita "Kobunshi Gosei-no Jikkenho" Kagaku Dojin, 1972, p. 124 to 154.

A solution polymerization method using radical initiation is especially preferred as the polymerization method. Examples of solvents that can be used in the solution polymerization method include a variety of organic solvents such as ethyl acetate, butyl acetate, acetone, methyl ethyl ketone, methyl isobutyl ketone, cyclohexaneone, tetrahydrofuran, dioxane, N,N-dimethylformamide, N,N-dimethylacetamide, benzene, toluene, acetonitrile, methylene chloride, chloroform, dichloroethane, methanol, ethanol, 1-propanol, 2-propanol, and 1-butanol. These solvents may be used individually or in mixtures of two or more thereof. A mixed solvent additionally containing water may be also used.

The polymerization temperature has to be set according to the molecular weight of the polymer to be synthesized and the type of polymerization initiator. Usually, the polymerization temperature is about 0° C. to 100° C., but it is preferred that the polymerization be conducted within a range of 50° C. to 100° C.

The reaction pressure can be set appropriately. Usually the reaction pressure is 1 kg/cm$^2$ to 100 kg/cm$^2$, and preferably 1 kg/cm$^2$ to 30 kg/cm$^2$. The reaction time is about 5 hours to 30 hours. The resin obtained may be subjected to purification such as reprecipitation.

The preferred specific examples of the resin dispersant (A) in accordance with the present invention are presented below, but the present invention is not limited thereto.

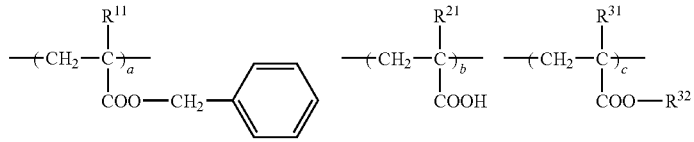

| | $R^{11}$ | $R^{21}$ | $R^{31}$ | $R^{32}$ | a | b | c | Mw |
|---|---|---|---|---|---|---|---|---|
| B-1 | $CH_3$ | $CH_3$ | $CH_3$ | $—CH_3$ | 60 | 10 | 30 | 46000 |
| B-2 | H | H | H | $—CH_3$ | 60 | 10 | 30 | 50000 |
| B-3 | $CH_3$ | $CH_3$ | $CH_3$ | $—CH_2CH_3$ | 61 | 10 | 29 | 43000 |
| B-4 | $CH_3$ | $CH_3$ | $CH_3$ | $—CH_2CH_2CH_2CH_3$ | 61 | 9 | 30 | 51000 |
| B-5 | $CH_3$ | $CH_3$ | $CH_3$ | $—CH_2(CH_3)CH_3$ | 60 | 9 | 31 | 96000 |
| B-6 | H | H | H | $—CH_2(CH_3)(CH_3)CH_3$ | 60 | 10 | 30 | 32000 |
| B-7 | $CH_3$ | $CH_3$ | $CH_3$ | $—CH_2CH(CH_3)CH_3$ | 60 | 5 | 30 | 75000 |

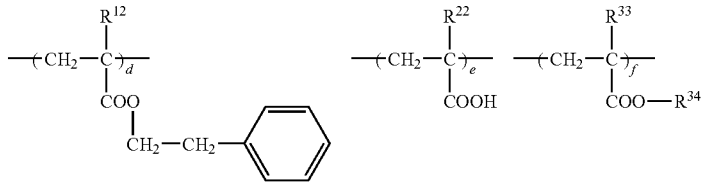

| | $R^{12}$ | $R^{22}$ | $R^{33}$ | $R^{32}$ | d | e | f | Mw |
|---|---|---|---|---|---|---|---|---|
| B-8 | $CH_3$ | $CH_3$ | $CH_3$ | $—CH_3$ | 55 | 12 | 33 | 31000 |
| B-9 | H | H | H | —CH2CH(CH3)CH3 | 70 | 10 | 20 | 34600 |

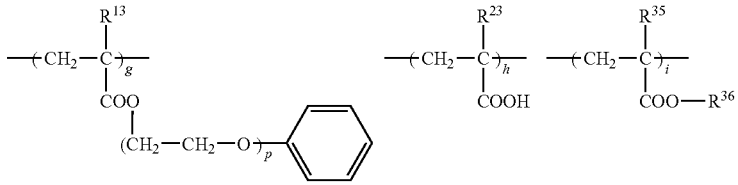

| | $R^{13}$ | p | $R^{23}$ | $R^{35}$ | $R^{36}$ | g | h | i | Mw |
|---|---|---|---|---|---|---|---|---|---|
| B-10 | $CH_3$ | 1 | $CH_3$ | $CH_3$ | $—CH_3$ | 60 | 9 | 31 | 35500 |
| B-11 | H | 1 | H | H | $—CH_2CH_3$ | 69 | 10 | 21 | 41200 |
| B-12 | $CH_3$ | 2 | $CH_3$ | $CH_3$ | $—CH_3$ | 70 | 11 | 19 | 68000 |
| B-13 | $CH_3$ | 4 | $CH_3$ | $CH_3$ | $—CH_2(CH_3)CH_3$ | 70 | 7 | 23 | 72000 |

-continued
| | | | | | | | | | |
|---|---|---|---|---|---|---|---|---|---|
| B-14 | H | 5 | H | H | —$CH_3$ | 70 | 10 | 20 | 86000 |
| B-15 | H | 5 | H | H | —$CH_2CH(CH_3)CH_3$ | 70 | 2 | 28 | 42000 |
B-16
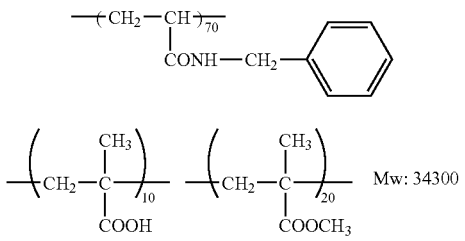
| | | Mw |
|---|---|---|
| B-17 | 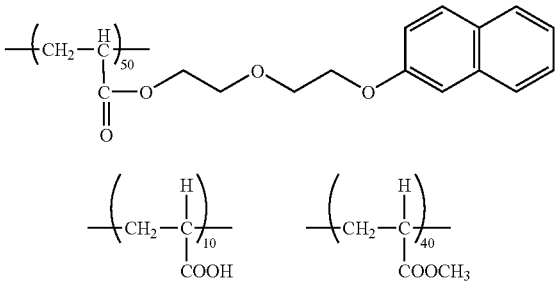 | 72400 |
| B-18 | 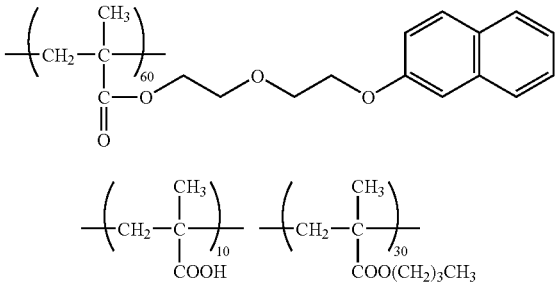 | 33800 |
| B-19 | 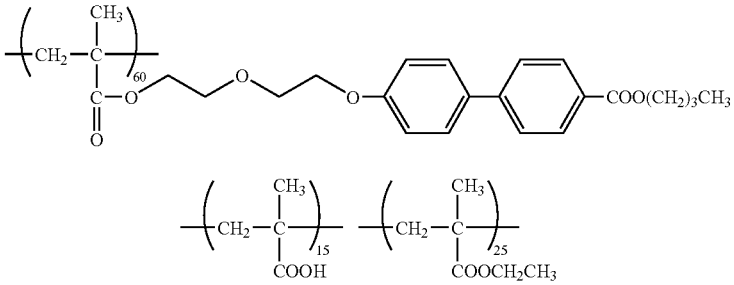 | 39200 |
| B-20 | 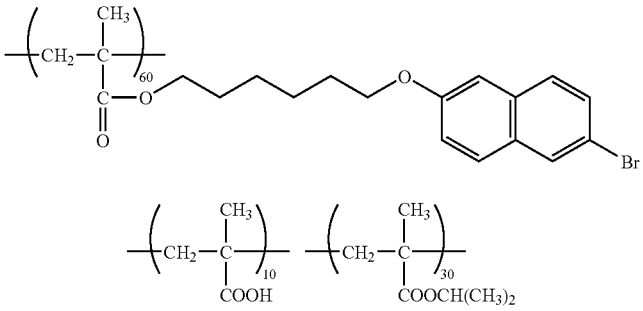 | 55300 |
(a, b and c represent respective compositions (wt %))
(d, e and f represent respective compositions (wt %))
(g, h and i represent respective compositions (wt %))

<Ratio of Pigment (B) and Resin Dispersant (A)>

The weight ratio of the pigment (B) and resin dispersant (A) is preferably 100:25 to 100:140, more preferably 100:25 to 100:50. When the resin dispersant is present at a ratio not lower than 100:25, the dispersion stability and abrasion resistance tend to improve, and where the resin dispersant is present at a ratio of 100:140 or less, the dispersion stability tends to improve.

<Pigment (B)>

In accordance with the present invention, the pigment (B) is a general term for color substances (including white color when the pigment is inorganic) that are practically insoluble in water and organic solvents, as described in Kagaku Daijiten (third edition), published on Apr. 1, 1994, (ed. by Michinori Oki), p. 518, and organic pigments and inorganic pigments can be used in accordance with the present invention.

Further, "the pigment (B) dispersed by the resin dispersant (A)" in the description of the present invention means a pigment that is dispersed and held by the resin dispersant (A) and is preferably used as a pigment that is dispersed and held by the resin dispersant (A) in the aqueous liquid medium (D). An additional dispersant may be optionally contained in the aqueous liquid medium (D).

The pigment (B) dispersed by the resin dispersant (A) in accordance with the present invention is not particularly limited, provided that it is a pigment that is dispersed and held by the resin dispersant (A). From the standpoint of pigment dispersion stability and ejection stability, microcapsulated pigments produced by a phase transition method are more preferred from among the aforementioned pigments.

A microcapsulated pigment represents a preferred example of the pigment (B) employed in accordance with the present invention. The microcapsulated pigment as referred to herein is a pigment coated by the resin dispersant (A).

The resin of the microcapsulated pigment has to use the resin dispersant (A), but it is preferred that a polymer compound having self-dispersibility or solubility in water and also having an anionic (acidic) group be used in a resin other than the resin dispersant (A).

<Manufacture of Microcapsulated Pigment>

A microcapsulated pigment can be prepared by conventional physical and chemical methods using the above-described components such as the resin dispersant (A). For example, a microcapsulated pigment can be prepared by methods disclosed in Japanese Patent Application Publication Nos. 9-151342, 10-140065, 11-209672, 11-172180, 10-025440, and 11-043636. Methods for manufacturing a microcapsulated pigments will be reviewed below.

A phase transition method or acid precipitation method described in Japanese Patent Application Publication Nos. 9-151342 and 10-140065 can be used as methods for manufacturing microcapsulated pigments, and among them the phase transition method is preferred from the standpoint of dispersion stability.

(a) Phase Transition Method

The phase transition method as referred to in the description of the present invention is basically a self-dispersion (phase transition emulsification) method by which a mixed melt of a pigment and a resin having self-dispersibility or solubility is dispersed in water. The mixed melt may also include the above-described curing agent or polymer compound. The mixed melt as referred to herein is presumed to include a state obtained by mixing without dissolution, a state obtained by mixing with dissolution, and both these states. A more specific manufacturing method of the "phase transition method" may be identical to that disclosed in Japanese Patent Application Publication No. 10-140065.

(b) Acid Precipitation Method

The acid precipitation method as referred to in the description of the present invention is a method for manufacturing a microcapsulated pigment by using a water-containing cake composed of a resin and a pigment and neutralizing all or some of the anionic groups contained in the resin within the water-containing cake by using a basic compound.

More specifically, the acid precipitation method includes the steps of: (1) dispersing a resin and a pigment in an alkaline aqueous medium and, if necessary, performing a heat treatment to gel the resin; (2) hydrophobizing the resin by obtaining neutral or acidic pH and strongly fixing the resin to the pigment; (3) if necessary, performing filtration and water washing to obtain a water-containing cake; (4) neutralizing all or some of the anionic groups contained in the resin in the water-containing cake by using a basic compound and then re-dispersing in an aqueous medium; and (5) if necessary, performing a heat treatment and gelling the resin.

More specific manufacturing methods of the above-described phase transition method and acid precipitation method may be identical to those disclosed in Japanese Patent Application Publication Nos. 9-151342 and 10-140065. Methods for manufacturing coloring agents described in Japanese Patent Application Publication Nos. 11-209672 and 11-172180 can be also used in accordance with the present invention.

The preferred manufacturing method in accordance with the present invention basically includes the following manufacturing steps: (1) mixing a resin having an anionic group or a solution obtained by dissolving the resin in an organic solvent with an aqueous solution of a basic compound to cause neutralization; (2) admixing a pigment to the mixed liquid to form a suspension and then dispersing the pigment with a dispersing apparatus to obtain a pigment dispersion; (3) if necessary, removing the solvent by distillation and obtaining an aqueous dispersion in which the pigment is coated with the resin having an anionic group.

In accordance with the present invention, kneading and dispersion treatment mentioned hereinabove can be performed using, for example, a ball mill, a roll mill, a beads mill, a high-pressure homogenizer, a high-speed stirring dispersing apparatus, and an ultrasound homogenizer.

<Pigment B>

The following pigments can be used in accordance with the present invention. Thus, examples of yellow ink pigments include C. I. Pigment Yellow 1, 2, 3, 4, 5, 6, 7, 10, 11, 12, 13, 14, 14C, 16, 17, 24, 34, 35, 37, 42, 53, 55, 65, 73, 74, 75, 81, 83, 93, 95, 97, 98, 100, 101, 104, 108, 109, 110, 114, 117, 120, 128, 129, 138, 150, 151, 153, 154, 155, 180.

Examples of magenta ink pigments include C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 48 (Ca), 48 (Mn), 48:2, 48:3, 48:4, 49, 49:1, 50, 51, 52, 52:2, 53:1, 53, 55, 57 (Ca), 57:1, 60, 60:1, 63:1, 63:2, 64, 64:1, 81, 83, 87, 88, 89, 90, 101 (Bengal), 104, 105, 106, 108 (cadmium red), 112, 114, 122 (quinacridone magenta), 123, 146, 149, 163, 166, 168, 170, 172, 177, 178, 179, 184, 185, 190, 193, 202, 209, 219. Among them, C. I. Pigment Red 122 is especially preferred.

Examples of cyan ink pigments include C. I. Pigment Blue 1, 2, 3, 15, 15:1, 15:2, 15:3, 15:4, 16, 17:1,22, 25, 56, 60, C. I. Vat Blue 4, 60, 63. Among them, C. I. Pigment Blue 15:3 is especially preferred.

Examples of other color ink pigments include C. I. Pigment Orange 5, 13, 16, 17, 36, 43, 51, C. I. Pigment Green 1, 4, 7, 8, 10, 17, 18, 36, C. I. Pigment Violet 1 (Rhodamine Lake), 3, 5:1, 16, 19 (quinacridone red), 23, 28. Processed pigments such as graft carbon that are obtained by treating the pigment surface with a resin or the like can be also used.

Carbon black is an example of a black pigment. Specific examples of carbon black include No. 2300, No. 900, MCF88, No. 33, No. 40, No. 45, No. 52, MA 7, MA8, MA100, and No. 2200B manufactured by Mitsubishi Chemical, Raven 5750, Raven 5250, Raven 5000, Raven 3500, Raven 1255, and Raven 700 manufactured by Colombia, Regal 400R, Regal 1330R, Regal 1660R, Mogul L, Monarch 700, Monarch 800, Monarch 880, Monarch 900, Monarch 1000, Monarch 1100, Monarch 1300, and Monarch 1400 manufactured by Cabot Corp., and Color Black FW1, Color Black FW2, Color Black FW2V, Color Black FW18, Color Black FW200, Color Black S150, Color Black S160, Color Black S170, Printex 35, Printex U, Printex V, Printex 140U, Special Black 6, Special Black 5, Special Black 4A, and Special Black 4 manufactured by Degussa Co., Ltd.

The aforementioned pigments may be used individually or in combinations obtained by selecting a plurality of pigments in each of the above-described groups or a plurality of pigments from different groups.

From the standpoint of dispersion stability and concentration of the aqueous ink, the content ratio of the pigment (B) in the aqueous ink in accordance with the present invention is preferably 1 wt % to 10 wt %, more preferably 2 wt % to 8 wt %, and even more preferably 2 wt % to 6 wt %.

<Self-Dispersible Polymer Microparticles>

The aqueous ink used in accordance with the present invention includes self-dispersible polymer microparticles of at least one kind. Self-dispersible polymer microparticles as referred to herein mean microparticles of a water-insoluble polymer containing no free emulsifying agent, this water-insoluble polymer being capable of assuming a dispersion state in an aqueous medium under the effect of functional groups (especially acidic groups or salt thereof) of the resin itself, without the presence of another surfactant.

The dispersion state as referred to herein includes both an emulsion state (emulsion) in which the water-insoluble polymer is dispersed in a liquid state in the aqueous medium and a dispersion state (suspension) in which the water-insoluble polymer is dispersed in a solid state in the aqueous medium.

From the standpoint of ink stability and ink aggregation speed in the case the water-insoluble polymer is contained in a water-soluble ink, it is preferred that the water-insoluble polymer in accordance with the present invention be a water-insoluble polymer that can assume a dispersion state in which the water-insoluble polymer is dispersed in a solid state.

The dispersion state of the self-dispersible polymer microparticles in accordance with the present invention represents a state such that the presence of a dispersion state can be visually confirmed with good stability at least over a week at a temperature of 25° C. in a system obtained by mixing a solution obtained by dissolving 30 g of a water-insoluble polymer in 70 g of an organic solvent (for example, methyl ethyl ketone), a neutralizing agent capable of 100% neutralization of salt-forming groups of the water-insoluble polymer (where the salt-forming group is anionic, the neutralizing agent is sodium hydroxide, and where the salt-forming group is cationic, the neutralizing agent is acetic acid), and 200 g water, stirring (apparatus: stirring apparatus equipped with a stirring impeller, revolution speed 200 rpm, 30 min, 25° C.), and then removing the organic solvent from the mixed liquid.

The water-insoluble polymer as referred to herein is a resin that dissolves in an amount of 10 g or less when dried for 2 hours at 105° C. and then dissolved in 100 g of water at 25° C. The amount dissolved is preferably not more than 5 g, more preferably not more than 1 g. The amount dissolved refers to a state upon 100% neutralization with sodium hydroxide or acetic acid, correspondingly to the type of the salt-forming group of the water-insoluble polymer.

The aqueous medium may be composed of water or, if necessary, may also include a hydrophilic organic solvent. In accordance with the present invention, a composition including water and a hydrophilic organic solvent at a content ratio not more than 0.2 wt % with respect to the water is preferred, and a composition including only water is more preferred.

A main chain skeleton of the water-insoluble polymer is not particularly limited and a vinyl polymer or a condensation polymer (an epoxy resin, a polyester, a polyurethane, a polyamide, cellulose, a polyether, a polyurea, a polyimide, a polycarbonate, etc.) can be used. Among them, a vinyl polymer is preferred.

The preferred examples of vinyl polymers and monomers constituting vinyl polymers are described in Japanese Patent Application Publication Nos. 2001-181549 and 2002-088294. A vinyl polymer having a dissociative group introduced into the end of the polymer chain by radical polymerization of a vinyl monomer using a chain transfer agent, a polymerization initiator, or an iniferter having a dissociative group (or a substituent that can derive a dissociative group) or by ion polymerization using a compound having a dissociative group (or a substituent that can derive a dissociative group) for either an initiator or a stopping agent can be also used.

The preferred examples of condensation polymers and monomers constituting the condensation polymers are described in Japanese Patent Application Publication No. 20001-247787.

From the standpoint of self-dispersibility, it is preferred that the self-dispersible polymer microparticles in accordance with the present invention include a water-insoluble polymer including a hydrophilic structural unit and a structural unit derived from a monomer having an aromatic group.

The hydrophilic structural unit is not particularly limited provided that it is derived from a monomer including a hydrophilic group, and this structural unit may be derived from one monomer having a hydrophilic group or two or more monomers having a hydrophilic group. The hydrophilic group is not particularly limited and may be a dissociative group or a nonionic hydrophilic group.

From the standpoint of enhancing the self dispersion and also from the standpoint of stability of emulsion or dispersion state that has been formed, it is preferred that the hydrophilic group in accordance with the present invention be a dissociative group, more preferably an anionic dissociative group. Examples of dissociative groups include a carboxyl group, a phosphate group, and a sulfonate group. Among them, from the standpoint of fixing ability when the ink composition is configured, a carboxyl group is preferred.

From the standpoint of self-dispersibility and aggregation ability, it is preferred that the monomer having a hydrophilic group in accordance with the present invention be a monomer having a dissociative group, more preferably a monomer having a dissociative group that has a dissociative group and an ethylenic unsaturated body.

Examples of suitable monomers having a dissociative group include an unsaturated carboxylic acid monomer, an unsaturated sulfonic acid monomer, and an unsaturated phosphoric acid monomer.

Specific examples of the unsaturated carboxylic acid monomer include acrylic acid, methacrylic acid, crotonic acid, itaconic acid, maleic acid, fumaric acid, citraconic acid, and 2-methacryloyloxymethylsuccinic acid. Specific examples of the unsaturated sulfonic acid monomer include styrenesulfonic acid, 2-acrylamido-2-methylpropanesulfonic acid, 3-sulfopropyl (meth)acrylate, and bis-(3-sulfopropyl)-itaconic acid esters. Specific examples of the unsaturated phosphoric acid monomer include vinylphosphonic acid, vinyl phosphate, bis(methacryloxyethyl) phosphate, diphenyl-2-acryloyloxyethyl phosphate, diphenyl-2-methacryloyloxyethyl phosphate, dibutyl-2-acryloyloxyethyl phosphate.

Among the monomers including a dissociative group, from the standpoint of dispersion stability and ejection stability, unsaturated carboxylic acid monomers are preferred and acrylic acid and methacrylic acid are especially preferred.

From the standpoint of self-dispersibility and aggregation speed during contact with a reaction liquid, it is preferred that the self-dispersible polymer microparticles in accordance with the present invention include a first polymer having a carboxyl group and an acid value (mg KOH/g) of 25 to 100. Furthermore, from the standpoint of self-dispersibility and aggregation speed during contact with a reaction liquid, it is preferred that the acid value be 25 to 80, more preferably 30 to 65. Where the acid value is not lower than 25, good stability of self-dispersibility is obtained. Where the acid value is not higher than 100, aggregation ability is improved.

The monomer including an aromatic groups is not particularly limited, provided it is a compound having an aromatic group and a polymerizable group. The aromatic group may be a group derived from an aromatic hydrocarbon or a group derived from an aromatic hetero ring. In accordance with the present invention, from the standpoint of particle shape stability in the aqueous medium, it is preferred that the aromatic group be derived from an aromatic hydrocarbon.

The polymerizable group may be a condensation polymerizable group or an addition polymerizable group. In accordance with the present invention, from the standpoint of particle shape stability in the aqueous medium, it is preferred that the polymerizable group be an addition polymerizable group, more preferably a group including an ethylenic unsaturated bond.

The monomer including an aromatic group in accordance with the present invention is preferably a monomer having an aromatic group derived from an aromatic hydrocarbon and an ethylenic unsaturated body, more preferably a (meth)acrylate monomer including an aromatic group. In accordance with the present invention, the monomer including an aromatic group of one kind may be used or a combination of monomers of two or more kinds may be used.

Examples of the monomer including an aromatic group include phenoxyethyl (meth)acrylate, benzyl (meth)acrylate, phenyl (meth)acrylate, and styrene monomers. Among them, from the standpoint of hydrophilic-hydrophobic balance of the polymer chain and ink fixing ability, it is preferred that the monomer including an aromatic group be of at least of one kind selected from phenoxyethyl (meth)acrylate, benzyl (meth)acrylate, and phenyl (meth)acrylate. Among them, phenoxyethyl (meth)acrylate is preferred, and phenoxyethyl acrylate is even more preferred.

"(Meth)acrylate" means acrylate or methacrylate.

The self-dispersible polymer microparticles in accordance with the present invention include a structural unit derived from a (meth)acrylate monomer including an aromatic group, and the content ratio thereof is preferably 10 wt % to 95 wt %. Where the content ratio of the (meth)acrylate monomer including an aromatic group is 10 wt % to 95 wt %, the stability of self-emulsion or dispersion state is improved. In addition, the increase in ink viscosity can be inhibited.

In accordance with the present invention, from the standpoint of stability of the self-dispersion state, stabilization of particle shape in the aqueous medium by hydrophobic interaction of aromatic rings with each other, and decrease in the amount of water-soluble components caused by adequate hydrophobization of the particles, it is preferred that the content ratio of the (meth)acrylate monomer including an aromatic group be 15 wt % to 90 wt %, preferably 15 wt % to 80 wt %, more preferably 25 wt % to 70 wt %.

The self-dispersible polymer microparticles in accordance with the present invention can be configured, for example, by a structural unit including a monomer having an aromatic group and a structural unit including a monomer having a dissociative group. If necessary, the microparticles may also include other structural units.

The monomers forming other structural units are not particularly limited, provided that they are monomers copolymerizable with the monomer having an aromatic group and the monomer having a dissociative group. Among them, from the standpoint of flexibility of the polymer skeleton and easiness of controlling the glass transition temperature (Tg), a monomer including an alkyl group is preferred.

Examples of the monomer including an alkyl group include alkyl (meth)acrylates such as methyl (meth)acrylate, ethyl (meth)acrylate, isopropyl (meth)acrylate, n-propyl (meth)acrylate, n-butyl (meth)acrylate, isobutyl (meth)acrylate, t-butyl (meth)acrylate, hexyl (meth)acrylate, and ethylhexyl (meth)acrylate; ethylenic unsaturated monomers having a hydroxyl group, such as hydroxymethyl (meth)acrylate, 2-hydroxyethyl (meth)acrylate, 2-hydroxypropyl (meth) acrylate, 4-hydroxybutyl (meth)acrylate, hydroxypentyl (meth)acrylate, and hydroxyhexyl (meth)acrylate; dialkylaminoalkyl (meth)acrylates such as dimethylaminoethyl (meth)acrylate; N-hydroxyalkyl (meth)acrylamides such as N-hydroxymethyl (meth)acrylamide, N-hydroxyethyl (meth)acrylamide, and N-hydroxybutyl (meth)acrylamide; and (meth)acrylamides such as N-alkoxyalkyl (meth)acrylamides, for example, N-methoxymethyl (meth)acrylamide, N-ethoxymethyl (meth)acrylamide, N-(n-, iso)butoxymethyl (meth)acrylamide, N-methoxyethyl (meth)acrylamide, N-ethoxyethyl (meth)acrylamide, and N-(n-, iso)butoxyethyl (meth)acrylamide.

The molecular weight range of the water-insoluble polymer constituting the self-dispersible polymer microparticles in accordance with the present invention is preferably 3000 to 200,000, more preferably 50000 to 150,000, even more preferably 10,000 to 100,000, as a weight-average molecular weight. Where the weight-average molecular weight is not less than 3000, the amount of water-soluble components can be effectively inhibited. Where the weight-average molecular weight is not more than 200,000, self-dispersion stability can be increased. The weight-average molecular weight can be measured by gel permeation chromatography (GPC).

From the standpoint of controlling the hydrophilicity and hydrophobicity of the polymer, it is preferred that the water-insoluble polymer constituting the self-dispersible polymer microparticles in accordance with the present invention include a (meth)acrylate monomer including an aromatic group at a copolymerization ratio of 15 wt % to 90 wt %, a monomer including a carboxyl group, and a monomer including an allsyl group, have an acid value of 25 to 100, and have a weight-average molecular weight of 3000 to 200,000. It is even more preferred that the water-insoluble polymer constituting the self-dispersible polymer microparticles include a (meth)acrylate monomer including an aromatic group at a copolymerization ratio of 15 wt % to 80 wt %, a monomer including a carboxyl group, and a monomer including an alkyl group, have an acid value of 25 to 95, and have a weight-average molecular weight of 5000 to 150,000.

Exemplary Compounds B-01 to B-19 are presented below as specific examples of the water-insoluble polymer constituting the self-dispersible polymer microparticles, but the present invention is not limited thereto. The weight ratio of the copolymer components is shown in the parentheses.

B-01: phenoxyethyl acrylate-methyl methacrylate-acrylic acid copolymer (50/45/5).

B-02: phenoxyethyl acrylate-benzyl methacrylate-isobutyl methacrylate-methacrylic acid copolymer (30/35/29/6).

B-03: phenoxyethyl methacrylate-isobutyl methacrylate-methacrylic acid copolymer (50/44/6).

B-04: phenoxyethyl acrylate-methyl methacrylate-ethyl acrylate-acrylic acid copolymer (30/55/10/5).

B-05: benzyl methacrylate-isobutyl methacrylate-methacrylic acid copolymer (35/59/6).

B-06: styrene-phenoxyethyl acrylate-methyl methacrylate-acrylic acid copolymer (10/50/35/5).

B-07: benzyl acrylate-methyl methacrylate-acrylic acid copolymer (55/40/5).

B-08: phenoxyethyl methacrylate-benzyl acrylate-methacrylic acid copolymer (45/47/8).

B-09: styrene-phenoxyethyl acrylate-butyl methacrylate-acrylic acid copolymer (5/48/40/7).

B-10: benzyl methacrylate-isobutyl methacrylate-cyclohexyl methacrylate-methacrylic acid copolymer (35/30/30/5).

B-11: phenoxyethyl acrylate-methyl methacrylate-butyl acrylate-methacrylic acid copolymer (12/50/30/8).

B-12: benzyl acrylate-isobutyl methacrylate-acrylic acid copolymer (93/2/5).

B-13: styrene-phenoxyethyl methacrylate-butyl acrylate-acrylic acid copolymer (50/5/20/25).

B-14: styrene-butyl acrylate-acrylic acid copolymer (62/35/3).

B-15: methyl methacrylate-phenoxyethyl acrylate-acrylic acid copolymer (45/51/4).

B-16: methyl methacrylate-phenoxyethyl acrylate-acrylic acid copolymer (45/49/6).

B-17: methyl methacrylate-phenoxyethyl acrylate-acrylic acid copolymer (45/48/7).

B-18: methyl methacrylate-phenoxyethyl acrylate-acrylic acid copolymer (45/47/8).

B-19: methyl methacrylate-phenoxyethyl acrylate-acrylic acid copolymer (45/45/10).

A method for manufacturing the water-insoluble polymer constituting the self-dispersible polymer microparticles in accordance with the present invention is not particularly limited. Examples of suitable methods include a method for performing emulsion polymerization in the presence of a polymerizable surfactant and inducing covalent coupling of the surfactant and a water-insoluble polymer and a method for copolymerizing a monomer mixture including the above-described monomer including a hydrophilic group and the monomer including an aromatic group by a well-known polymerization method such as a solution polymerization method and a lump polymerization method. Among the aforementioned polymerization methods, from the standpoint of aggregation speed and stability of deposition in the case of an aqueous ink, the solution polymerization method is preferred, and a solution polymerization method using an organic solvent is more preferred.

From the standpoint of aggregation speed, it is preferred that the self-dispersible polymer microparticles in accordance with the present invention include a first polymer synthesized in an organic solvent and that this first polymer be prepared as a resin dispersion having carboxyl groups and an acid number of 20 to 100, wherein at least some of carboxyl groups of the first polymer are neutralized and water is contained as a continuous phase.

Thus, the method for manufacturing the self-dispersible polymer microparticles in accordance with the present invention preferably includes a step of synthesizing the first polymer in an organic solvent and a dispersion step of obtaining an aqueous dispersion in which at least some of carboxyl groups of the first polymer are neutralized.

The dispersion step preferably includes the following step (1) and step (2).

Step (1): a step of stirring a mixture including a first polymer (water-insoluble polymer), an organic solvent, a neutralizing agent, and an aqueous medium.

Step (2): a step of removing the organic solvent from the mixture.

The step (1) is preferably a treatment in which the first polymer (water-insoluble polymer) is dissolved in an organic solvent, then the neutralizing agent and aqueous medium are gradually added, the components are mixed and stirred, and a dispersion is obtained. By adding the neutralizing agent and aqueous medium to a solution of the water-insoluble polymer obtained by dissolving in an organic solvent, it is possible to obtain self-dispersible polymer particles of a particle size that ensures higher stability in storage. The method for stirring the mixture is not particularly limited and a mixing and stirring apparatus of general use and, if necessary, a dispersing apparatus such as an ultrasound dispersing apparatus or a high-pressure homogenizer can be used.

An alcohol-based solvent, a ketone-based solvent, or an ether-based solvent is preferred as the organic solvent. Examples of the alcohol-based solvent include isopropyl alcohol, n-butanol, t-butanol, and ethanol. Examples of ketone solvents include acetone, methyl ethyl ketone, diethyl ketone, and methyl isobutyl ketone. Examples of ether solvents include dibutyl ether and dioxane. Among these solvents, ketone-based solvents such as methyl ethyl ketone and alcohol-based solvents such as isopropyl alcohol are preferred. Further, with the object of moderating the variations of polarity in a phase transition from an oil system to an aqueous system, it is preferred that isopropyl alcohol and methyl ethyl ketone be used together. Where the two solvents are used together, aggregation and precipitation and also fusion of particles with each other are prevented and self-dispersible polymer microparticles of a fine particle size and high dispersion stability can be obtained.

The neutralizing agent is used so that the dissociative groups be partially or completely neutralized and the self-dispersible polymer form a stable emulsion or dispersion state in water. When the self-dispersible polymer in accordance with the present invention has anionic dissociative groups (for example, carboxyl groups) as the dissociative groups, basic compounds such as organic amine compounds, ammonia, and alkali metal hydroxides can be used as the neutralizing agent. Examples of the organic amine compounds include monomethylamine, dimethylamine, trimethylamine, monoethylamine, diethylamine, triethylamine, monopropylamine, dipropylamine, monoethanolamine, diethanolamine, triethanolamine, N,N-dimethylethanolamine, N,N-diethylethanolamine, 2-dimethylamino-2-methyl-1-propanol, 2-amino-2-methyl-1-propanol, N-methyldiethanolamine, N-ethyldiethanolamine, monoisopropanolamine, diisopropanolamine, and triisopropanolamine. Examples of alkali metal hydroxides include lithium hydroxide, sodium hydroxide, and potassium hydroxide. Among them, from the standpoint of stabilizing the dispersion of the self-dispersible polymer microparticles in accordance with the present invention in water, sodium hydroxide, potassium hydroxide, triethylamine, and triethanolamine are preferred.

These basic compounds are used preferably at 5 mol % to 120 mol %, more preferably 10 mol % to 110 mol %, and even more preferably 15 mol % to 100 mol % per 100 mol of dissociative groups. Where the ratio of the basic compound is not less than 15 mol %, the stabilization effect of particle dispersion in water is demonstrated, and where the ratio is not more than 100 mol %, the amount of water-soluble components is decreased.

In the step (2), the organic solvent is distilled out by the usual method such as vacuum distillation from the dispersion obtained in the step (1), thereby inducing phase transition to an aqueous system and making it possible to obtain an aqueous dispersion of self-dispersible polymer particles. The organic solvent contained in the obtained aqueous dispersion is substantially removed, and the amount of organic solvent is preferably not more than 0.2 wt %, more preferably not more than 0.1 wt %.

The mean particle size of the self-dispersible polymer microparticles in accordance with the present invention is preferably within a range of 10 nm to 400 nm, more preferably 10 nm to 200 nm, and even more preferably 10 nm to 100 nm. Particles with a mean size of 10 nm or more are more suitable for manufacture. Where the mean particle size is not more than 400 nm, stability in storage is improved.

The particle size distribution of the self-dispersible polymer microparticles in accordance with the present invention is not particularly limited, and particles with a wide particle size distribution or a monodisperse particle size distribution may be used. Furthermore, water-insoluble particles of two or more kinds may be used as a mixture.

The mean particle size and particle size distribution of the self-dispersible polymer microparticles can be measured, for example, by using a light scattering method.

The self-dispersible polymer microparticles in accordance with the present invention can be advantageously contained in an aqueous ink composition, and the particles of one kind may be used individually, or particles of two or more kinds may be used together.

<Aqueous Liquid Medium (D)>

In the aqueous ink of the inkjet recording system, the aqueous liquid medium (D) represents a mixture of water and a water-soluble organic solvent. The water-soluble organic solvent (also can be referred to hereinbelow as "solvent medium") is used as a drying preventing agent, wetting agent, and penetrating agent.

A drying preventing agent is used with the object of preventing the ink ejection port of a nozzle from clogging by the dried inkjet ink. A water-soluble organic solvent with a vapor pressure lower than that of water is preferred as the drying preventing agent and wetting agent. Further, a water-soluble organic solvent can be advantageously used as a penetrating agent with the object of ensuring better penetration of the ink for inkjet printing into the recording medium (paper and the like).

Examples of water-soluble organic solvents include alkane diols (polyhydric alcohols) such as glycerin, 1,2,6-hexanetriol, trimethylolpropane, ethylene glycol, propylene glycol, diethylene glycol, triethylene glycol, tetraethylene glycol, pentaethylene glycol, dipropylene glycol, 2-butene-1,4-diol, 2-ethyl-1,3-hexanediol, 2-methyl-2,4-pentanediol, 1,2-octanediol, 1,2-hexanediol, 1,2-pentanediol, and 4-methyl-1,2-pentanediol; sugars such as glucose, mannose, fructose, ribose, xylose, arabinose, galactose, aldonic acid, glucitol (sorbit), maltose, celiobiose, lactose, sucrose, trehalose, and maltotriose; sugar alcohols; hyaluronic acids; the so-called solid wetting agents such as urea; alkyl alcohols having 1 to 4 carbon atoms such as ethanol, methanol, butanol, propanol, and isopropanol, glycol ethers such as ethylene glycol monomethyl ether, ethylene glycol monoethyl ether, ethylene glycol monobutyl ether, ethylene glycol monomethyl ether acetate, diethylene glycol monomethyl ether, diethylene glycol monoethyl ether, diethylene glycol mono-n-propyl ether, ethylene glycol mono-iso-propyl ether, diethylene glycol mono-iso-propyl ether, ethylene glycol mono-n-butyl ether, ethylene glycol mono-t-butyl ether, diethylene glycol mono-t-butyl ether, 1-methyl-1-methoxybutanol, propylene glycol monomethyl ether, propylene glycol monoethyl ether, propylene glycol mono-n-butyl ether, propylene glycol mono-n-propyl ether, propylene glycol mono-iso-propyl ether, dipropylene glycol monomethyl ether, dipropylene glycol monoethyl ether, dipropylene glycol mono-n-propyl ether, and dipropylene glycol mono-iso-propyl ether; 2-pyrrolidone, N-methyl-2-pyrrolidone, 1,3-dimethyl-2-imidazolidinone, formamide, acetamide, dimethylsulfoxide, sorbit, sorbitan, acetin, diacetin, triacetin, and sulfolan. These compounds can be used individually or in combinations of two or more thereof.

A polyhydric alcohol is useful as a drying preventing agent or a wetting agent. Examples of suitable polyhydric alcohols include glycerin, ethylene glycol, diethylene glycol triethylene glycol, propylene glycol, dipropylene glycol, tripropylene glycol, 1,3-butanediol, 2,3-butanediol, 1,4-butanediol, 3-methyl-1,3-butanediol, 1,5-pentanediol, tetraethylene glycol, 1,6-hexanediol, 2-methyl-2,4-pentanediol, polyethylene glycol, 1,2,4-butanetriol, and 1,2,6-hexanetriol. These alcohols can be used individually or in combinations of two or more thereof.

A polyol compound is preferred as a penetrating agent. Examples of aliphatic diols include 2-ethyl-2-methyl-1,3-propanediol, 3,3,-dimethyl-1,2,-butanediol, 2,2-diethyl-1,3-propanediol, 2-methyl-2-propyl-1,3-propanediol, 2,4-dimethyl-2,4-pentanediol, 2,5-dimethyl-2,5-hexanediol, 5-hexene-1,2-diol, and 2-ethyl-1,3-hexanediol. Among them, 2-ethyl-1,3-hexanediol and 2,2,4-trimethyl-1,3-pentanediol are preferred.

The water-soluble organic solvents may be used individually or in mixtures of two or more thereof. The content ratio of the water-soluble organic solvent in the ink is preferably not less than 1 wt % and not more than 60 wt %, more preferably not less than 5 wt % and not more than 40 wt %.

The amount of water added to the ink is not particularly limited, but it is preferably not less than 10 wt % and not more than 99 wt %, more preferably not less than 30 wt % and not more than 80 wt %. It is especially preferred that the amount of water be not less than 50 wt % and not more than 70 wt %, From the standpoint of dispersion stability and ejection stability, it is preferred that the content ratio of the aqueous liquid medium (D) in accordance with the present invention be not less than 60 wt % and not more than 95 wt %, more preferably not less than 70 wt % and not more than 95 wt %.

<Surfactant>

It is preferred that a surfactant (can be also referred to hereinbelow as "surface tension adjusting agent") be added to the aqueous ink in accordance with the present invention. examples of surfactants include nonionic, cationic, anionic, and betaine surfactants. The amount of the surface tension adjusting agent added to the ink is preferably such as to adjust the surface tension of the aqueous ink in accordance with the present invention to 20 mN/m to 60 mN/m, more preferably to 20 mN/m to 45 mN/m, and even more preferably to 25 mN/m to 40 mN/m, in order to eject the ink with an inkjet.

A compound having a structure having a combination of a hydrophilic portion and a hydrophobic portion in a molecule can be effectively used as the surfactant, and anionic surfactants, cationic surfactants, amphoteric surfactants, and nonionic surfactants can be used. Furthermore, the above-described polymer substance (polymer dispersant) can be also used as the surfactant.

Specific examples of anionic surfactants include sodium dodecylbenzenesulfonate, sodium lauryl sulfate, sodium alkyldiphenyl ether disulfonates, sodium alkyl naphthalenesulfonate, sodium dialkylsulfosuccinates, sodium stearate, potassium oleate, sodium dioctylsulfosuccinate, polyoxyethylene alkyl ether sulfuric acid sodium, polyoxyethylene alkyl ether sulfuric acid sodium, polyoxyethylene alkyl phenyl ether sulfuric acid sodium, sodium dialkylsulfosuccinates, sodium stearate, sodium oleate, and t-octylphenoxyethoxypolyethoxyethyl sulfuric acid sodium salt. These surfactants can be used individually or in combinations of two or more thereof.

Specific examples of nonionic surfactants include polyoxyethylene laurylether, polyoxyethylene octyl phenyl ether, polyoxyethylene oleyl phenyl ether, polyoxyethylene nonyl phenyl ether, oxyethylene oxypropylene block copolymer, t-octyl phenoxyethyl polyethoxy ethanol, nonyl phenoxyethyl polyethoxy ethanol. These surfactants can be used individually or in combinations of two or more thereof.

Examples of cationic surfactants include tetraalkylammonium salts, alkylamine salts, benzalkonium salts, alkylpyridium salts, and imidazolium salts. Specific examples include dihydroxyethylstearylamine, 2-heptadecenyl-hydroxyethyl imidazoline, lauryldimethylbenzyl ammonium chloride, cetyl pyridinium chloride, and stearamidomethyl pyridium chloride.

The amount of the surfactant added to the aqueous ink for inkjet recording in accordance with the present invention is not particularly limited, but preferably this amount is not less than 1 wt %, more preferably 1 wt % to 10 wt %, and even more preferably 1 wt % to 3 wt %.

<Other Components>

The aqueous ink used in accordance with the present invention may also include other additives. Examples of other additives include such well-known additives as an ultraviolet absorbent, a fading preventing agent, an antimold agent, a pH adjusting agent, an antirust agent, an antioxidant, an emulsion stabilizer, a preservative, an antifoaming agent, a viscosity adjusting agent, a dispersion stabilizer, and a chelating agent.

Examples of the ultraviolet absorbent include a benzophenone-type ultraviolet absorbent a benzotriazole-type ultraviolet absorbent, a salicylate-type ultraviolet absorbent, a cyanoacrylate ultraviolet absorbent, and a nickel complex-type ultraviolet absorbent.

Examples of the fading preventing agent include agents of a variety of organic and metal complex systems. Examples of organic fading preventing agents include hydroquinones, alkoxyphenols, dialkoxyphenols, phenols, anilines, amines, indanes, coumarones, alkoxyanilines, and hetero rings. Examples of metal complexes include nickel complexes and zinc complexes.

Examples of the antimold agent include sodium dehydroacetate, sodium benzoate, sodium pyridinethione-1-oxide, p-hydroxybenzoic acid ethyl ester, 1,2-benzisothiazoline-3-one, sodium sorbitate, and pentachlorophenol sodium. The antimold agent is preferably used at 0.02 wt % to 1.00 wt % in the ink.

The pH adjusting agent is not particularly limited, provided that it can adjust the pH to a desired value, without adversely affecting the prepared recording ink, and the agent can be selected appropriately according to the object. Examples of suitable agents include alcohol amines (for example, diethanolamine, triethanolamine, and 2-amino-2-ethyl-1,3-propanediol), alkali metal hydroxides (for example, lithium hydroxide, sodium hydroxide, and potassium hydroxide), ammonium hydroxides (for example, ammonium hydroxide and quaternary ammonium hydroxide), phosphonium hydroxide, and alkali metal carbonates.

Examples of antirust agents include acidic sulfites, sodium thiosulfate, ammonium thiodiglycolate, diisoproplylammonium nitrate, pentaerythritol tetranitrate, dicyclohexyl ammonium nitrite.

Examples of the antioxidant include phenolic antioxidants (including hindered phenol antioxidants), amine antioxidants, sulfur-containing antioxidants, and phosphorus-containing antioxidants.

Examples of the chelating agent include ethylenediaminetetracetatic acid sodium salt, nitrilotriacetic acid sodium salt, hydroxyethylethylenediaminetriacetic acid sodium salt, diethylenetriaminepentaacetic acid sodium salt, and uramyldiacetic acid sodium salt.

EXAMPLES

Experiment A

There follows a description of experiments carried out to compare the image quality (present invention) obtained when each of the inkjet recording apparatus, the recording medium and the aqueous ink used in image formation satisfy the conditions of the present invention and the image quality (comparative examples) obtained when at least one of the inkjet recording apparatus, the recording medium and the aqueous ink used in image formation does not satisfy the conditions of the present invention.

<The Inkjet Recording Apparatus Used in the Present Examples>

Respective aqueous inks of colors CMY (cyan, magenta and yellow) were ejected as droplets from the heads 72C, 72M and 72Y in accordance with an image signal, onto a recording medium 22 taken up onto the image formation drum 70 from the paper supply unit 10 of the inkjet recording apparatus shown in FIG. 1. The ink ejection volume was 1.4 pl in the highlight portions and 3 pl (2 drops) in the high-density portions, and the recording density was 1200 dpi in both the main scanning direction and the sub-scanning direction.

Thereupon, the aqueous ink ejected in the form of droplets onto the recording surface of the recording medium 22 was dried on the drying drum 76 by means of the first IR heater 78 (surface temperature 180° C.), the air blowing nozzle 80 (warm air flow at 70° C.), and the second IR heater 82 (surface temperature 180° C.). The drying time was 2 seconds.

Next, the recording medium 22 on which an image had been formed was conveyed to the fixing roller, and was heated and fixed by the pressure drum (fixing drum 84) at 50° C., and first and second fixing rollers 86 and 88 at a temperature of 80° C. and a nip pressure of 0.14 MPa.

The recording medium 22 was conveyed at a conveyance speed of 535 mm/s by drum conveyance by means of the drums 70, 76 and 84.

<The Inkjet Recording Apparatus Used for Comparison>

Figure 15:
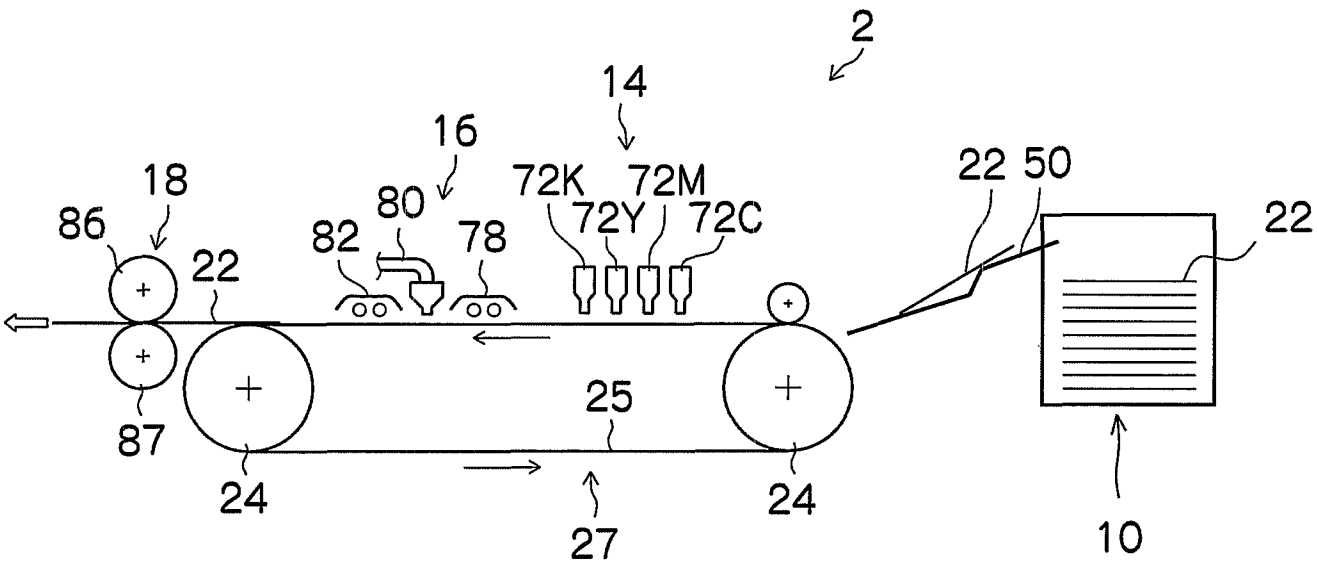
FIG. 15 is a general schematic drawing of an inkjet recording apparatus used in comparative examples in Experiment A.

As the inkjet recording apparatus for comparison, as shown in FIG. 15, an apparatus having the same conditions as the inkjet recording apparatus of the present invention in terms of the ink droplet ejection conditions, drying conditions, fixing conditions, and the like, was used, apart from the fact that the conveyance system was changed from the drum conveyance system to a belt conveyance apparatus 27 constituted of a pair of rollers 24 and an endless belt 25. In other words, the inkjet heads 72C, 72M, 72Y and 72K, the first IR heater 78, the warm-air blow-out nozzle 80, the second IR heater 82 and the fixing roller 86 used in the inkjet recording apparatus of the present invention were provided (a back-up roller 87 made of a similar material to the pressure drum was provided for the fixing roller 86), and their respective temperatures were controlled in a similar manner. Consequently, in FIG. 15, similar reference numerals are applied to the same members as in FIG. 1.

<Preparation of Recording Medium S-1>

<<Preparation of Coating Liquid A for Forming First Layer>>

100 parts of kaolin (product name: Kaobright 90, manufactured by Shiraishi Calcium), 3.8 parts of 0.1N sodium hydroxide (manufactured by Wako Junyaku Kogyo), 1.3 parts of 40% sodium polyacrylate (product name: Aron T-50, manufactured by Toa Gosei) and 49.6 parts of water were mixed together and dispersed using a non-bubbling kneader (product name: NBK-2 manufactured by Nippon Seiki Seisakusyo) to yield a 65% kaolin dispersion liquid.

Thereupon, 100 parts of a 22.5% aqueous dispersion liquid of polyester urethane latex (glass transition temperature 49° C., minimum film forming temperature 29° C., product name: Hydran AP-40F, manufactured by Dainippon Ink and Chemicals) were taken and to this were added 5 parts of water, 7.0 parts of the 65% kaolin dispersion liquid obtained above, and 0.8 parts of 10% Emulgen 109P (manufactured by Kao Corp.). The mixture was sufficiently agitated and mixed, whereupon the liquid temperature of the obtained mixture was kept at 15° C. to 25° C., thereby obtaining a 24.0% coating liquid A for forming the first layer.

<<Preparation of Coating Liquid "a" for Forming the Second Layer>>

100 parts of kaolin (product name: Kaobright 90, manufactured by Shiraishi Calcium), and 1.3 parts of 40% sodium polyacrylate (product name: Aron T-50, manufactured by Toa Gosei) were mixed together. The mixture was then dispersed in water, 100 parts of a 7% aqueous solution of PVA 245 (manufactured by Kuraray) and 3.5 parts of a 10% aqueous solution of Emulgen 109P (manufactured by Kao Corp.) were added, and moronic acid was also added so as to achieve a layer surface pH of 3.5 after coating, thereby yielding a coating liquid "a" for forming the second layer having a final solid content of 27%.

<<Forming First Layer>>

The obtained undercoating layer coating liquid was applied using an extrusion die coater to both surfaces of high-quality paper having a basis weight of 81.4 g/m$^2$ (product name: Shiraoi, manufactured by Nippon Paper Industries), one side at a time, while adjusting the coating amount on each side to 8.0 g/m$^2$. A first layer was formed by drying for one minute in a warm air flow at 85° C. and a flow speed of 15 m/s. Furthermore, the soft calendering process described below was carried out on the first layer thus formed. The thickness of the first layer thus obtained was 8.1 μm.

<<Forming Second Layer>>

The coating liquid "a" for forming the second layer prepared as described above was then applied onto both surfaces of the high-quality paper on which the first layer had been formed, using an extrusion die coater, one side at a time, while adjusting the dried weight per side to be 20 g/m$^2$. The second layer was formed by drying for one minute in a drying air flow at 70° C. and flow rate of 10 m/s. In this way, the inkjet recording medium S-1 was completed. The thickness of the second layer thus obtained was 20.2 μM.

The recording medium S-1 had a Cobb water absorbency of 1.4 g/m$^2$ and a water absorption amount of 3.1 g/m$^2$ at a contact time of 0.5 seconds according to Bristow's method.

<Preparation of Recording Medium S-2>

The surface of the recording medium S-1 obtained as described above was subjected to a soft calendering process using a soft calender having a pair of rollers constituted of a metal roll and a resin roll, under conditions of: metal roll surface temperature 50° C., nip pressure 50 kg/cm. By this means, the recording medium S-2 was prepared. The recording medium S-2 had a Cobb water absorbency of 1.4 g/m$^2$ and a water absorption amount of 3.1 g/m$^2$ at a contact time of 0.5 seconds according to Bristow's method.

<Preparation of Recording Medium Used for Comparative Examples>

As a recording medium used in the comparative examples, Tokubishi Art having a basis weight of 104.7 g/m$^2$ (manufactured by Mitsubishi Paper Mills) was prepared. Tokubishi Art has a one-layer composition, a water absorption amount of 5.5 g/m$^2$ with a contact time of 0.5 seconds according to Bristow's method, and a layer surface pH of 7.1, and it does not have the characteristic features of the recording medium according to the present invention.

<Preparation of Aqueous Ink Used in the Present Example>

<<Synthesis of Resin Dispersant P-1>>

A resin dispersant P-1 representing one mode of the resin dispersant (A) was synthesized according to the following scheme.

(P-1)

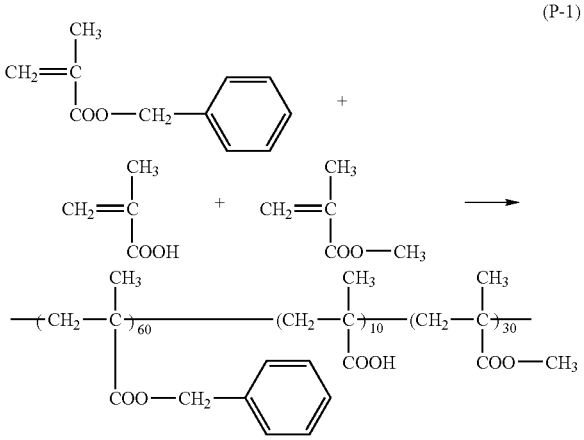

A total of 88 g of methyl ethyl ketone was placed in a three-neck flask with a capacity of 1000 milliliters (ml) equipped with a stirrer and a cooling tube, heating to 72° C. was performed under a nitrogen atmosphere, and then a solution obtained by dissolving 0.85 g of dimethyl 2,2'-azobisisobutyrate, 60 g of benzyl methacrylate, 10 g of methacrylic acid, and 30 g of methyl methacrylate in 50 g of methyl ethyl ketone was dropwise added within 3 hours. Upon completion of dropping, the reaction was conducted for 1 hour, then a solution obtained by dissolving 0.42 g of dimethyl 2,2'-azobisisobutyrate in 2 g of methyl ethyl ketone was added, the temperature was raised to 78° C. and heating was performed for 4 hours. The reaction solution obtained was twice reprecipitated in a large excess amount of hexane, and the precipitated resin was dried to obtain 96 g of the resin dispersant P-1.

The composition of the obtained resin dispersant P-1 was verified by H-NMR, and the weight-average molecular weight (Mw) found by GPC was 44,600. Further, the acid value of the polymer was found by a method described in a JIS standard (JIS K0070: 1992). The result was 65.2 mg KOH/g.

<<Synthesis of Self-Dispersible Polymer Microparticles B-01>>

Self-dispersible polymer microparticles B-01 representing an embodiment of self-dispersible polymer microparticles (C) were synthesized by the following scheme.

A total of 360.0 g of methyl ethyl ketone was loaded into a reaction container formed from a three-neck flask of two liters and equipped with a stirrer, a thermometer, a reflux cooler, and a nitrogen gas introducing tube, and the temperature was raised to 75° C.

A mixed solution including 180.0 g of phenoxyethyl acrylate, 162.0 g of methyl methacrylate, 18.0 g of acrylic acid, 72 g of methyl ethyl ketone, and 1.44 g of "V-601" (manufactured by Wako Junyaku) was dropwise added at a constant rate so that the dropwise addition was completed within 2 hours, while maintaining the temperature inside the reaction container at 75° C.

Upon completion of dropping, a solution including 0.72 g of "V-601" and 36.0 g of methyl ethyl ketone was added and stirring was performed for 2 hours at a temperature of 75° C. Then, a solution including 0.72 g of "V-601" and 36.0 g of isopropanol was added and stirring was performed for 2 hours at 75° C., followed by heating to 85° C. and further stirring for 2 hours.

The weight-average molecular weight (Mw) of the copolymer obtained was 64,000, and the acid value was 38.9 (mg KOH/g). The weight-average molecular weight (Mw) was calculated by polystyrene recalculation by gel permeation chromatography (GPC). The columns TSKgel SuperHZM-H, TSKgel SuperHZ4000, and TSKgel SuperHZ200 (manufactured by Tosoh Corp.) were used in this process.

A total of 668.3 g of the polymerization solution of the copolymer was then weighed, 388.3 g of isopropanol and 145.7 ml of 1 mol/L aqueous NaOH solution were added, and the temperature inside the reaction container was raised to 80° C. Then, 720.1 g of distilled water was dropwise added at a rate of 20 ml/min and an aqueous dispersion was obtained. The temperature inside the reaction container was then maintained for 2 hours at 80° C., for 2 hours at 85° C., and for 2 hours at 90° C. under atmospheric pressure, and the pressure inside the reaction container was then lowered to distill out a total of 913.7 g of isopropanol, methyl ethyl ketone, and distilled water. As a result, an aqueous dispersion (emulsion) of self-dispersible polymer microparticles (B-01) with a concentration of solids of 28.0% was obtained.

A chemical structure formula of the self-dispersible polymer microparticles (B-01) is presented below. The numerical values relating to each structural unit represent a weight ratio.

(B-01)

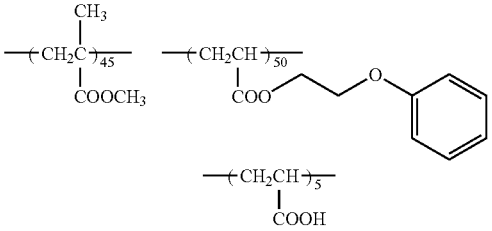

<<Preparation of Dispersion of Resin Particles Including a Cyan Pigment>>

A total of 10 parts by weight by a Pigment Blue 15:3 (Phthalocyanine Blue A220, manufactured by Dainichi Seika Color & Chemicals), 5 parts by weight of the resin dispersant (P-1) described in Table 1, 42 parts by weight of methyl ethyl ketone, 5.8 parts by weight of 1N aqueous NaOH solution, and 86.9 parts by weight of deionized water were mixed and dispersed for 2 hours to 6 hours in a bead mill using zirconia beads with a diameter of 0.1 mm.

The methyl ethyl ketone was removed from the obtained dispersion at 55° C. under reduced pressure and part of water was then removed to obtain a dispersion of resin particles including a cyan pigment with a pigment concentration of 10.2 wt %.

<<Preparation of Cyan Ink Composition C-1>>

The obtained dispersion of resin particles including a cyan pigment and self-dispersible polymer microparticles (B-01) were used to prepare a water-soluble cyan ink composition C-1 of the following composition:

Dispersion of resin particles including a cyan pigment: 39.2 parts by weight.

Self-dispersible polymer microparticles (B-01): 28.6 parts by weight.

Glycerin: 20.0 parts by weight.

Diethylene glycol: 10.0 parts by weight.

Olfine E1010: (manufactured by Nisshin Kagaku Kogyo): 1.0 part by weight.

Deionized water: 1.2 part by weight.

<<Preparation of Magenta Ink Composition M-1>>

A magenta ink composition M-1 was prepared in the same manner as the cyan ink composition, except that Cromophthal Jet Magenta DWQ (PR-122) manufactured by Chiba Specialty Chemicals was used instead of the Pigment Blue 15:3 (Phthalocyanine Blue A220, manufactured by Dainichi Seika Color & Chemicals) used in the preparation of the cyan pigment dispersion.

<<Preparation of Yellow Ink Composition Y-1>>

A yellow ink composition Y-1 was prepared in the same manner as the cyan ink composition, except that Irgalite Yellow GS (PY74) manufactured by Chiba Specialty Chemicals was used instead of the Pigment Blue 15:3 (Phthalocyanine Blue A220, manufactured by Dainichi Seika Color & Chemicals) used in the preparation of the cyan pigment dispersion.

<<Preparation of Black Ink Composition Bk-1>>

A black ink composition Bk-1 was prepared in the same manner as the cyan ink composition, except that Carbon Black MA100 manufactured by Mitsubishi Chemicals was used instead of the Pigment Blue 15:3 (Phthalocyanine Blue A220, manufactured by Dainichi Seika Color & Chemicals) used in the preparation of the cyan pigment dispersion.

<<Preparation of Cyan Ink Composition C-2, Magenta Ink Composition M-2, Yellow Ink Composition Y-2, and Black Ink Composition Bk-2>>

Further, aqueous inks satisfying the conditions set forth by the present invention were also prepared by replacing glycerin used as a high boiling-point solvent in the above-described preparation of cyan ink composition C-1, magenta ink composition M-1, yellow ink composition Y-1, and black ink composition Bk-1 with half amount of GP-250 (trioxypropylene glyceryl ether, Sunnix GP250, manufactured by Sanyo Chemical Industries), replacing diethylene glycol with half amount DEGmEE (diethylene glycol mono ethyl ether), and making up a difference with water. As a result, cyan ink composition C-2, magenta ink composition M-2, yellow ink composition Y-2, and black ink composition Bk-2 were prepared.

<Preparation of Aqueous Ink Used in Comparative Examples>

<<Preparation of Cyan Ink Composition C-3, Magenta Ink Composition M-3, Yellow Ink Composition Y-3 and Black Ink Composition Bk-3>>

The cyan ink composition C-3, magenta ink composition M-3, yellow ink composition Y-3 and black ink composition Bk-3 used in the comparative examples were prepared as described below.

The self-dispersible polymer micro-particles (B-01) were excluded from the cyan ink composition C-1, magenta ink composition M-1, yellow ink composition Y-1 and black ink composition Bk-1 described above which were prepared as aqueous inks according to the practical examples, and the shortage created by this exclusion was made up with water. By this means, the cyan ink composition C-3, magenta ink composition M-3, yellow ink composition Y-3 and black ink composition Bk-3 used in the comparative examples were prepared.

<<Preparation of Cyan Ink Composition C-4, Magenta Ink Composition M-4, Yellow Ink Composition Y-4 and Black Ink Composition Bk-4>>

As other aqueous inks for use in the comparative examples, a cyan ink composition C-4, magenta ink composition M-4, yellow ink composition Y-4 and black ink composition Bk-4 were prepared similarly to the cyan ink composition C-1, magenta ink composition M-1, yellow ink composition Y-1 and black ink composition Bk-1, apart from the fact that the resin dispersant P-1 used when preparing the pigment dispersions of the cyan ink composition C-1, magenta ink composition M-1, yellow ink composition Y-1 and black ink composition Bk-1 described above was replaced with an equivalent amount of low-molecular-weight dispersant 2-1.

The chemical structure of the low-molecular-weight dispersant 2-1 used for comparison is as follows:

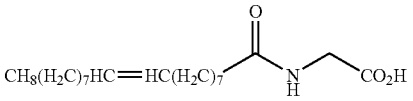

(Low-Molecular-Weight Dispersant 2-1)

Test Results

The table in FIG. 16 shows the experimental results of Experiment A (Experiments 1 to 15) which used the inkjet recording apparatuses, the recording medium and the aqueous inks described above.

In Experiment 1, image formation was carried out by ejecting droplets of the cyan ink composition C-1, magenta ink composition M-1, yellow ink composition Y-1 and black ink composition Bk-1 prepared as described above onto the recording medium S-1 prepared as described above, using the inkjet recording apparatus 1 shown in FIG. 1 (the present invention).

In Experiment 2, image formation was carried out in a similar fashion to Experiment 1, apart from the fact that the aqueous inks in Experiment 1 were replaced with the cyan ink composition C-3, magenta ink composition M-3, yellow ink composition Y-3 and black ink composition Bk-3 (a comparative example in which the aqueous inks do not satisfy the conditions according to the present invention).

In Experiment 3, image formation was carried out in a similar fashion to Experiment 1, apart from the fact that the aqueous inks in Experiment 1 were replaced with the cyan ink composition C-4, magenta ink composition M-4, yellow ink composition Y-4 and black ink composition Bk-4 (a comparative example in which the aqueous inks do not satisfy the conditions according to the present invention).

In Experiment 4, image formation was carried out in a similar fashion to Experiment 1, apart from the fact that the recording medium S-1 in Experiment 1 was replaced with Tokubishi Art paper (a comparative example in which the recording medium does not satisfy the conditions according to the present invention).

In Experiment 5, image formation was carried out in a similar fashion to Experiment 1, apart from the fact that the aqueous inks in Experiment 1 were replaced with the cyan ink composition C-3, magenta ink composition M-3, yellow ink composition Y-3 and black ink composition Bk-3 and furthermore the recording medium S-1 in Experiment 1 was replaced with Tokubishi Art paper (a comparative example in which the aqueous inks and the recording medium do not satisfy the conditions according to the present invention).

In Experiment 6, image formation was carried out in a similar fashion to Experiment 1, apart from the fact that the aqueous inks in Experiment 1 were replaced with the cyan ink composition C-4, magenta ink composition M-4, yellow ink composition Y-4 and black ink composition Bk-4 and furthermore the recording medium S-1 in Experiment 1 was replaced with Tokubishi Art paper (a comparative example in which the aqueous inks and the recording medium do not satisfy the conditions according to the present invention).

In Experiment 7, image formation was carried out in a similar fashion to Experiment 1, apart from the fact that the inkjet recording apparatus 1 in Experiment 1 was replaced with the inkjet recording apparatus 2 shown in FIG. 15 (a comparative example in which the inkjet recording apparatus does not satisfy the conditions according to the present invention).

In Experiment 8, image formation was carried out in a similar fashion to Experiment 1, apart from the fact that the image recording apparatus 1 in Experiment 1 was replaced with the inkjet recording apparatus 2 shown in FIG. 15 and the aqueous inks in Experiment 1 were replaced with the cyan ink composition C-3, magenta ink composition M-3, yellow ink composition Y-3 and black ink composition Bk-3 (a comparative example in which the inkjet recording apparatus and the aqueous inks do not satisfy the conditions according to the present invention).

In Experiment 9, image formation was carried out in a similar fashion to Experiment 1, apart from the fact that the image recording apparatus 1 in Experiment 1 was replaced with the inkjet recording apparatus 2 shown in FIG. 15 and the aqueous inks in Experiment 1 were replaced with the cyan ink composition C-4, magenta ink composition M-4, yellow ink composition Y-4 and black ink composition Bk-4 (a comparative example in which the inkjet recording apparatus and the aqueous inks do not satisfy the conditions according to the present invention).

In Experiment 10, image formation was carried out in a similar fashion to Experiment 1, apart from the fact that the image recording apparatus 1 in Experiment 1 was replaced with the inkjet recording apparatus 2 shown in FIG. 15 and the recording medium S-1 in Experiment 1 was replaced with Tokubishi Art paper (a comparative example in which the inkjet recording apparatus and the recording medium do not satisfy the conditions according to the present invention).

In Experiment 11, image formation was carried out in a similar fashion to Experiment 1, apart from the fact that the image recording apparatus 1 in Experiment 1 was replaced with the inkjet recording apparatus 2 shown in FIG. 15 and the aqueous inks in Experiment 1 were replaced with the cyan ink composition C-2, magenta ink composition M-2, yellow ink composition Y-2 and black ink composition Bk-2 (a comparative example in which the inkjet recording apparatus and the recording medium do not satisfy the conditions according to the present invention).

In Experiment 12, image formation was carried out in which the image recording apparatus 1 in Experiment 1 was replaced with the inkjet recording apparatus 2 shown in FIG. 15 and furthermore, the recording medium S-1 in Experiment 1 was replaced with Tokubishi Art paper, and the aqueous inks in Experiment 1 were replaced with the cyan ink composition C-3, magenta ink composition M-3, yellow ink composition Y-3 and black ink composition Bk-3 (a comparative example in which none of the inkjet recording apparatus, the recording medium and the aqueous inks satisfies the conditions according to the present invention).

In Experiment 13, image formation was carried out in a similar fashion to Experiment 1, apart from the fact that the recording medium S-1 in Experiment 1 was replaced with the recording medium S-2 (the present invention).

In Experiment 14, image formation was carried out in a similar fashion to Experiment 1, apart from the fact that the aqueous inks in Experiment 1 were replaced with the cyan ink composition C-2, magenta ink composition M-2, yellow ink composition Y-2 and black ink composition Bk-2 (the present invention).

In Experiment 15, image formation was carried out in a similar fashion to Experiment 1, apart from the fact that the recording medium S-1 in Experiment 1 was replaced with the recording medium S-2, and furthermore the aqueous inks in Experiment 1 were replaced with the cyan ink composition C-2, magenta ink composition M-2, yellow ink composition Y-2 and black ink composition Bk-2 (the present invention).

Four evaluation items, namely, landing interference, image contraction, text reproducibility and curling, were evaluated and divided into three evaluation levels (Good, Fair, Poor) in respect of the Experiments 1 to 15.

<Evaluation Criteria for Landing Interference>

Good: variation in line thickness was not more than 5 μm when line was drawn using four adjacent nozzles Fair: variation in line thickness was more than 5 μM and not more than 10 μm when line was drawn using four adjacent nozzles Poor: variation in line thickness was more than 10 μm when line was drawn using four adjacent nozzles <Evaluation Criteria for Image Contraction>

A 50 dot by 50 dot square shape was printed at a 100% rate of the dot percentage by superimposing magenta and cyan, and the ratio of the actual surface area with respect to the theoretical surface area was found.

Good: image contraction was not higher than 1%

Fair: image contraction was higher than 1% and not higher than 5%

Poor: image contraction was higher than 5%

<Evaluation Criteria for Text Reproducibility>

Good: a 3-point Japanese character "Hawk" with high density of strokes was reproduced Fair: a 3-point Japanese character "Hawk" with high density of strokes was not reproduced, but a 4-point Japanese character "Hawk" with high density of strokes was reproduced Poor: a 4-point Japanese character "Hawk" with high density of strokes was not reproduced <Evaluation Criteria for Curl>

A sample or a recording medium printed at a print rate of 250% was cut to 5 mm×50 mm in such a manner that the longer edges traced an arc, and the curvature C of the sample was measured as described below. Curl was evaluated on the basis of the following evaluation criteria.

<<Method of Measuring Curvature>>

The curvature C of a sample onto which aqueous ink had been applied was measured after storing for a prescribed time in an environment of 25° C. temperature and relative humidity 50%. The curvature C can be expressed in terms of an arc of a circle having a radius of R (meter) as: $C=1/R$.

<<Evaluation Criteria>>

Good: curvature C of sample did not exceed 20 after storing for one day after application of aqueous ink Fair: curvature C of sample did not exceed 20 after storing for seven days after application of aqueous ink Poor: curvature C of sample exceeded 20 after storing for seven days after application of aqueous ink <Results of Experiment A>

Consequently, as can be seen from the table in FIG. 16, the image quality achieved when each of the inkjet recording apparatus, the recording medium and the aqueous inks used in image formation complies with the conditions of the present invention (Experiments 1, 13, 14 and 15) was "good" in respect of each of the evaluation items: landing interference, image contraction, text reproducibility and curl.

On the other hand, in cases where at least one of the inkjet recording apparatus, the recording medium and the aqueous inks used in image formation does not comply with the conditions according to the present invention (Experiments 2 to 12), the image quality showed a "poor" evaluation in respect of at least one of the landing interference, the image contraction, text reproducibility and curl.

The asterisk (*) indicated for image contraction in Experiment 7 represents that the image contraction deteriorated from "good" to "fair" when printing was performed continuously for ten minutes.

From the results in Experiment A, it was demonstrated that in implementing the image forming method according to the present invention, it is necessary that all of the inkjet recording apparatus, the recording medium and the aqueous inks must comply with the conditions of the present invention, in order to obtain a good evaluation verdict in respect of each of the landing interference, the image contraction, the text reproducibility and the curl.

Experiment B

Experiment B served to investigate the evaluation results for image quality and curl when the conditions of the recording medium are changed, while maintaining constant apparatus conditions using the inkjet recording apparatus 1 in FIG. 1 and constant ink conditions using the aqueous inks constituted of the cyan ink composition C-1, magenta ink composition M-1, yellow ink composition Y-1 and black ink composition Bk-1.

The recording medium used in the image forming method according to the present invention satisfies the following three conditions:

Condition 1: the base paper with the first layer provided thereon has a Cobb water absorbency of 5.0 $g/m^2$ or lower with a contact time of 15 seconds based on a water absorbency test as specified in JIS P8140;

Condition 2: the second layer has a water absorption amount of not lower than 2 $ml/m^2$ and not higher than 8 $ml/m^2$ with a contact time of 0.5 seconds according to Bristow's method; and Condition 3: the second layer has a surface pH of 5.5 or lower after pH adjustment.

The following 16 types of recording media, S-2 to S-17, were prepared in cases where the three conditions described above were satisfied, and cases where they were not satisfied.

In preparing the recording medium, since the method of preparation has already been described in Experiment A in respect of the recording medium S-2, then further description thereof is omitted here.

<Preparation of Recording Medium S-2>

The recording medium S-2 was prepared in a similar fashion to the method of preparation described in Experiment A and was used in Experiment 1. Experiment 1 satisfies all of the conditions 1 to 3 described above.

<Preparation of Recording Medium S-3>

The recording medium S-3 was prepared in a similar fashion to the recording medium S-2, apart from the fact that the thickness of the first layer was set to 4.5 μm in the preparation of the recording medium S-2. This recording medium S-3 was used in Experiment 2. Experiment 2 does not satisfy the condition 1 described above.

<Preparation of Recording Medium S-4>

The recording medium S-4 was prepared in a similar fashion to the recording medium S-2, apart from the fact that the thickness of the first layer was set to 5 μm in the preparation of the recording medium S-2. This recording medium S-4 was used in Experiment 3. Experiment 3 satisfies all of the conditions 1 to 3 described above.

<Preparation of Recording Medium S-5>

The recording medium S-5 was prepared in a similar fashion to the recording medium S-2, apart from the fact that the thickness of the first layer was set to 5.8 μm in the preparation of the recording medium S-2. This recording medium S-5 was used in Experiment 4. Experiment 4 satisfies all of the conditions 1 to 3 described above.

<Preparation of Recording Medium S-6>

The recording medium S-6 was prepared in a similar fashion to the recording medium S-2 with the exception that 30 parts of the 100 parts of kaolin (product name: Kaobright 90, manufactured by Shiraishi Calcium) was replaced with Kaocal (manufactured by Shiraishi Calcium) in the formation of the second layer in the preparation of the recording medium S-2. The recording medium S-6 was used in Experiment 5. Experiment 5 does not satisfy the upper limit of the condition 2 described above.

<Preparation of Recording Medium S-7>

The recording medium S-7 was prepared in a similar fashion to the recording medium S-2 with the exception that 27 parts of the 100 parts of kaolin (product name: Kaobright 90, manufactured by Shiraishi Calcium) was replaced with Kaocal (manufactured by Shiraishi Calcium) in the formation of the second layer in the preparation of the recording medium S-2. The recording medium S-7 was used in Experiment 6. Experiment 6 satisfies all of the conditions 1 to 3 described above.

<Preparation of recording Medium S-8>

The recording medium S-8 was prepared in a similar fashion to the recording medium S-2 with the exception that 10 parts of the 100 parts of kaolin (product name: Kaobright 90, manufactured by Shiraishi Calcium) was replaced with Kaocal (manufactured by Shiraishi Calcium) in the formation of the second layer in the preparation of the recording medium S-2. The recording medium S-8 was used in Experiment 7. Experiment 7 satisfies all of the conditions 1 to 3 described above.

<Preparation of Recording Medium S-9>

The recording medium S-9 was prepared in a similar fashion to the recording medium S-2, apart from the fact that the added amount of 7% aqueous solution of PVA245 (manufactured by Kuraray) was set to 157 parts in the formation of the second layer in the preparation of the recording medium S-2. This recording medium S-9 was used in Experiment 8. Experiment 8 satisfies all of the conditions 1 to 3 described above.

<Preparation of Recording Medium S-10>

The recording medium S-10 was prepared in a similar fashion to the recording medium S-2, apart from the fact that the added amount of 7% aqueous solution of PVA245 (manufactured by Kuraray Co., Ltd.) was set to 214 parts in the formation of the second layer in the preparation of the recording medium S-2. This recording medium S-10 was used in Experiment 9. Experiment 9 does not satisfy the lower limit of the condition 2 described above.

<Preparation of Recording Medium S-11>

The recording medium S-11 was prepared in a similar fashion to the recording medium S-2, apart from the fact that maronic acid was added in such a manner that the layer surface pH after coating became 6 in the formation of the second layer in the preparation of the recording medium S-2. This recording medium S-11 was used in Experiment 10. Experiment 10 does not satisfy the condition 3 of the present invention described above.

<Preparation of Recording Medium S-12>

The recording medium S-12 was prepared in a similar fashion to the recording medium S-2, apart from the fact that maronic acid was added in such a manner that the layer surface pH after coating became 5.5 in the formation of the second layer in the preparation of the recording medium S-2. This recording medium S-12 was used in Experiment 11. Experiment 11 satisfies all of the conditions 1 to 3 described above.

<Preparation of Recording Medium S-13>

The recording medium S-13 was prepared in a similar fashion to the recording medium S-2, apart from the fact that maronic acid was added in such a manner that the layer surface pH after coating became 4.5 in the formation of the second layer in the preparation of the recording medium S-2. This recording medium S-13 was used in Experiment 12. Experiment 12 satisfies all of the conditions 1 to 3 described above.

<Preparation of Recording Medium S-14>

The recording medium S-14 was prepared in a similar fashion to the recording medium S-2, apart from the fact that maronic acid was added in such a manner that the layer surface pH after coating became 2.5 in the formation of the second layer in the preparation of the recording medium S-2. This recording medium S-14 was used in Experiment 13. Experiment 13 satisfies all of the conditions 1 to 3 described above.

<Preparation of Recording Medium S-15>

The recording medium S-15 was prepared in a similar fashion to the recording medium S-2, apart from the fact that maronic acid was added in such a manner that the layer surface pH after coating became 1.5 in the formation of the second layer in the preparation of the recording medium S-2. This recording medium S-15 was used in Experiment 14. Experiment 14 satisfies all of the conditions 1 to 3 described above.

<Preparation of Recording Medium S-16>

The recording medium S-16 was prepared in a similar fashion to the recording medium S-2 with the exception that, in the preparation of the recording medium S-2, the thickness of the first layer was set to 5 μm and 27 parts of the 100 parts of kaolin (product name: Kaobright 90, manufactured by Shiraishi Calcium) was replaced with Kaocal (manufactured by Shiraishi Calcium) and that maronic acid was added in such a manner that the layer surface pH after coating became 5.0 in the formation of the second layer. The recording medium S-16 was used in Experiment 15. Experiment 15 satisfies all of the conditions 1 to 3 described above.

<Preparation of Recording Medium S-17>

The recording medium S-17 was prepared in a similar fashion to the recording medium S-2 with the exception that, in the preparation of the recording medium S-2, the thickness of the first layer was set to 5 μm, and the added amount of 7% aqueous solution of PVA245 (manufactured by Kuraray) was changed to 157 parts and maronic acid was added in such a manner that the layer surface pH after coating became 5.0 in the formation of the second layer. The recording medium S-17 was used in Experiment 16. Experiment 16 satisfies all of the conditions 1 to 3 described above.

<Results of Experiment B>

Similarly to Experiment A, the four items, landing interference, image contraction, text reproducibility and curl were evaluated in three levels (Good, Fair, Poor) in respect of Experiments 1 to 16, in other words, the recording media S-2 to S-17. As described above, the inkjet recording apparatus and the aqueous inks used were the same.

The table in FIG. 17 shows the results relating to Experiment B.

As the table in FIG. 17 reveals, in the case of Experiments 1, 3, 4, 6 to 8 and 11 to 16 which use the recording media satisfying all of the conditions 1 to 3 according to the present invention, an evaluation verdict of "good" was obtained for all of the items: landing interference, image contraction, text reproducibility and curl.

On the other hand, Experiments 2, 5, 9 and 10 which use the recording media not satisfying at least one of the conditions 1 to 3 according to the present invention produced a "poor" evaluation verdict for at least one of the landing interference, image contraction, text reproducibility and curl.

On this basis, it was demonstrated that in implementing the image forming method according to the present invention, it is necessary that the recording medium must comply with all of the conditions 1 to 3 stated above, in order to obtain a good evaluation verdict in respect of each of the landing interference, the image contraction, the text reproducibility and the curl.

Furthermore, from the results in Experiments A and B, it was demonstrated that in implementing the image forming method according to the present invention, it is necessary that all of the inkjet recording apparatus, the recording medium and the aqueous inks comply with the conditions of the present invention, and that the recording medium complies with all of the conditions 1 to 3 stated above, in order to obtain a good evaluation verdict in respect of each of the landing interference, the image contraction, the text reproducibility and the curl.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method of forming an image by directly depositing aqueous ink ejected from an inkjet recording apparatus onto a recording medium, the method comprising:

using, as the inkjet recording apparatus, an apparatus including: an image formation unit having a line head type inkjet head disposed opposite a circumferential surface of an image formation drum, the inkjet head depositing the aqueous ink onto the recording medium while the recording medium is held and conveyed in rotation on the circumferential surface of the image formation drum; and a drying unit arranged on a downstream side of the image formation unit, the drying unit having a drying device disposed opposite a circumferential surface of a drying drum, the drying device drying a solvent in the aqueous ink deposited on the recording medium, the drying unit drying the solvent by means of the drying device while the recording medium is held and conveyed in rotation on the circumferential surface of the drying drum;

using, as the recording medium, a special paper which is a recording medium successively laminated from a base paper, a first layer containing a binder and a second layer containing a white pigment, the base paper with the first layer provided thereon having a Cobb water absorbency of not higher than 5.0 g/m$^2$ with a contact time of 15 seconds based on a water absorbency test stipulated in JIS P8140, and the second layer having a water absorption amount of not lower than 2 ml/m$^2$ and not higher than 8 ml/m$^2$ with a contact time of 0.5 seconds according to Bristow's method, and having a layer surface pH of not higher than 5.5 after pH adjustment; and using, as the aqueous ink, a special ink containing at least a resin dispersant (A), a pigment (B) that is dispersed by the resin dispersant (A), self-dispersible polymer microparticles (C) and an aqueous liquid medium (D).

2. The method as defined in claim 1, wherein a fixing unit is arranged on a downstream side of the drying unit in the inkjet recording apparatus, the fixing unit having a fixing device disposed opposite a circumferential surface of a fixing drum, the fixing device fixing the ink that has been deposited on the recording medium by applying heat and pressure to the ink, the fixing unit fixing the ink by means of the fixing device while the recording medium is held and conveyed in rotation on the circumferential surface of the fixing drum.

3. The method as defined in claim 1, wherein:

each of the drums in the inkjet recording apparatus includes a holding device which holds a leading end of the recording medium;

an intermediate conveyance unit is arranged between the drums, the intermediate conveyance unit including an intermediate conveyance body and a conveyance guide, the intermediate conveyance body having a holding device for holding the leading end of the recording medium, the intermediate conveyance body holding the leading end of the recording medium by means of the holding device and moving the recording medium in rotation, the conveyance guide guiding a non-recording surface of the recording medium which is moved in rotation by the intermediate conveyance body; and the recording medium is conveyed by being transferred by means of the holding device arranged on each of the drums and the holding device arranged on the intermediate conveyance body.

4. The method as defined in claim 1, wherein the line type inkjet head in the inkjet recording apparatus has a head width of not shorter than 50 cm, and nozzles arranged at a nozzle density of not lower than 1000 dpi in a sub-scanning direction.

5. The method as defined in claim 1, wherein the base paper of the recording medium with the first layer provided thereon has a Cobb value of not higher than 5.0 g/m$^2$ with a contact time of 2 minutes as determined using diethylene glycol in the water absorbency test stipulated in JIS P8140, and the second layer has a water absorption amount of not lower than 1 ml/m$^2$ and not higher than 6 ml/m$^2$ with a contact time of 0.9 seconds as determined using pure water containing 30 wt % of diethylene glycol according to Bristow's method.

6. The method as defined in claim 1, wherein:

the resin dispersant (A) in the aqueous ink has a hydrophobic structural unit (a) and a hydrophilic structural unit (b);

the hydrophobic structural unit (a) includes at least 40 wt % of a hydrophobic structural unit (a1) having an aromatic ring which is not directly bonded to atoms forming a main chain of the resin (A), and at least 15 wt % of a hydrophobic structural unit (a2) derived from an alkyl ester of one of acrylic acid and methacrylic acid having 1 to 4 carbon atoms; and the hydrophilic structural unit (b) includes a structural unit (b1) derived from at least one of acrylic acid and methacrylic acid, and a ratio of the hydrophilic structural unit (b) is not higher than 15 wt %.

7. The method as defined in claim 1, wherein an aromatic ring which is not directly bonded to atoms forming a main chain of the resin dispersant (A) in the aqueous ink is present in a ratio of not lower than 15 wt % and not higher than 27 wt % in the resin dispersant (A).

8. The method as defined in claim 1, wherein the self-dispersible polymer micro-particles (C) in the aqueous ink contain a structural unit derived from an aromatic group-containing (meth)acrylate monomer, a content ratio thereof being 10 wt % to 95 wt %.

9. The method as defined in claim 1, wherein the self-dispersible polymer micro-particles (C) in the aqueous ink contain a first polymer having a carboxyl group and an acid number of 25 to 100.

10. The method as defined in claim 9, wherein the first polymer is prepared in an organic solvent and as a polymer dispersion with water as a continuous phase, by neutralizing at least a portion of the carboxyl group in the first polymer.

* * * * *